US006432624B1

(12) United States Patent
Kikuchi et al.

(10) Patent No.: US 6,432,624 B1
(45) Date of Patent: Aug. 13, 2002

(54) METHOD OF PROCESSING SILVER HALIDE COLOR PHOTOGRAPHIC LIGHTSENSITIVE MATERIAL

(75) Inventors: Makoto Kikuchi; Yoshio Ishii; Toshio Kawagishi, all of Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/846,397

(22) Filed: May 2, 2001

(30) Foreign Application Priority Data

May 8, 2000 (JP) ..... 2000-134730
Jun. 8, 2000 (JP) ..... 2000-172788

(51) Int. Cl.[7] ..... G03C 7/407
(52) U.S. Cl. ..... 430/405; 430/448
(58) Field of Search ..... 430/405, 448

(56) References Cited

U.S. PATENT DOCUMENTS 4,582,786 A * 4/1986 Ikeda et al. ..... 430/577
5,643,711 A * 7/1997 Takada ..... 430/546
5,830,625 A * 11/1998 Hirano ..... 430/435
5,919,611 A * 7/1999 Maruyama ..... 430/567

FOREIGN PATENT DOCUMENTS

JP 10-39468 2/1998
JP 10221798 * 8/1998
JP 10-301247 11/1998

* cited by examiner

*Primary Examiner*—Hoa Van Le
(74) *Attorney, Agent, or Firm*—Burns, Doane, Swecker & Mathis, LLP

(57) ABSTRACT

A method of processing a silver halide color photographic lightsensitive material. The material comprises a support and at least one lightsensitive silver halide emulsion layer containing a binder and lightsensitive silver halide grains comprising tabular grains on the support. The material further comprises a developing agent or its precursor, and a compound capable of forming a dye by a coupling reaction with the developing agent in an oxidized form. The method comprises (a) exposing the material under natural light of 2000–9000 K color temperature or artificial light corresponding thereto, for 1/10–1/1000 sec, in an exposure amount such that 80–90% (numerical ratio) of the grains contained in the lightsensitive layer have at least one development initiating point per grain, and (b) color developing the exposed material so that the tabular grains have 3.0 or more (average) development initiating points per grain at the completion of the development.

16 Claims, No Drawings

METHOD OF PROCESSING SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Applications No. 2000-134730, filed May 8, 2000; and No. 2000-172788, filed Jun. 8, 2000, the entire contents of both of which are incorporated herein by reference.

BACKGROUND OF THE INVENTION

The present invention relates to a novel method of processing a silver halide color photographic lightsensitive material for image recording (hereinafter may be referred to simply as "lightsensitive material").

Rapid progress has been made in recent years with respect to the photographic lightsensitive material based on a silver halide, and now a high-quality color image reproduction can be obtained easily. For example, generally, in the system known as "color photography", photographing is first performed with the use of a color negative film. Then, the color negative film is developed, and the image information recorded in the developed color negative film is optically printed on a color photographic paper. Thus, a color print is obtained. In recent years, this process has marked a high progress, and now everyone can readily enjoy color photographs by virtue of the spread of color laboratories which are large-scale centers where a large number of color prints can be produced with high efficiency, or so-called minilabos which are small simple printer processors installed at shops.

The currently spread color photograph, as its principle, employs the color reproduction according to the subtractive color process. The common color negative comprises a transparent support and lightsensitive layers each constituted of a silver halide emulsion, which are a lightsensitive elements furnished with light sensitivity in blue, green and red regions, on a support. In the lightsensitive layer, so-called color couplers capable of forming yellow, magenta and cyan dyes which are complementary hues are contained in combination. The color negative film having been subjected to imagewise exposure by photographing is developed in a color developer containing a developing agent of aromatic primary amine. At the development, the exposed silver halide grains are developed, namely reduced, by the developing agent. Coupling reactions occur between the simultaneously formed developing agent in an oxidized form and the above color couplers with the result that dyes are formed. Metallic silver formed by development (developed silver) and unreacted silver halide are removed by bleaching and fixing, respectively, to thereby obtain dye images. A color print composed of dye images, reproducing the original scene, can be obtained by subjecting a color photographic paper which is a color lightsensitive material comprising a reflective support furnished, by coating, with lightsensitive layers having a similar combination of lightsensitive wavelength region and colored hue to optical exposure through the developed color negative film and by further subjecting the resultant color photographic paper to similar color development, bleaching and fixing.

Although the above system is now widely spread, the demand for greater simplicity thereof is increasing. First, with respect to the processing baths for carrying out the above color development, bleaching and fixing, it is needed to accurately control the composition and the temperature thereof, so that expert knowledge and skilled operation are required. Secondly, the processing solutions contain color developing agents, iron chelate compounds as bleaching agents and other substances whose effluence must be regulated from the viewpoint of environment, so that it is often that exclusive equipment is needed at the installation of developing apparatus. Thirdly, the development requires an extensive time is needed, although shortened as a result of technical development of recent years, so that it should be admitted that meeting the demand for rapid reproduction of recorded image is still unsatisfactory.

Jpn. Pat. Appln. KOKAI Publication No. (hereinafter referred to as JP-A-) 10-39468 discloses a method of achieving a rapid processing without detriment to color reproduction and sharpness.

The method disclosed in this publication increases a processing speed but invites a side effect of graininess deterioration. Therefore, an improvement has been desired. With respect to the processing time as well, further shortening has been desired.

JP-A-10-301247 discloses a technology wherein, in a system comprising sticking a lightsensitive material and a processing material to each other in the presence of a small amount of water and thereafter carrying out heat development, use is made of an emulsion containing tabular grains wherein the average number of development initiating points per grain is 5 or more.

However, the technology disclosed in this publication has a drawback in that, in addition to the lightsensitive material, a waste material (processing material) is outputted. Therefore, a developing system not inviting the outputting of waste material has been desired.

Generally, although a lightsensitive material of excellent graininess can be obtained by increasing the silver coating amount (number of grains) with respect to a high-speed emulsion, there exists a limit in that the increase of silver coating amount invites an increase of radiation fog and a high cost.

On the other hand, it is possible to, for example, intensify a chemical sensitization to thereby form dispersive chemical sensitization nuclei with the result that the number of development initiating points per grain is increased.

However, as described in, for example, The Theory of The Photographic Process, pp. 177–178 (T. H. James), it is known in the art to which the invention pertains that, according to conventional knowledge, in such instances, the formation of silver nuclei starts at multiple points of each grain to thereby form multiple latent sub-images with the result that a drop of latent image forming efficiency and a sensitivity lowering are invited. Therefore, it has been believed that there is a limit in the reconciliation of speed increase and graininess improvement.

BRIEF SUMMARY OF THE INVENTION

It is an object of the present invention to provide a method of processing a silver halide color photographic lightsensitive material, which realizes an excellent ratio of speed/graininess despite rapid processing. It is another object of the present invention to provide a method of processing a silver halide color photographic lightsensitive material, wherein use is made of a simple development processing system free from the outputting of waste materials.

These objects have effectively been attained by the present invention described below. That is, the present invention provides the following methods of processing a silver halide color photographic lightsensitive material:

(I) A method of processing a silver halide color photographic lightsensitive material comprising a support and at least one lightsensitive silver halide emulsion layer containing a binder and lightsensitive silver halide grains comprising tabular silver halide grains on the support; wherein the lightsensitive material contains a developing agent or its precursor, and a compound capable of forming a dye by a coupling reaction with the developing agent in an oxidized form, wherein the method comprises:

exposing the silver halide color photographic lightsensitive material under the following conditions:

light source: natural light of 2000 to 9000 K color temperature or artificial light corresponding thereto, exposure time: 1/10 to 1/1000 sec, and exposure amount: such that 80 to 90% (numerical ratio) of the lightsensitive silver halide grains contained in the lightsensitive silver halide emulsion layer have at least one development initiating point; and color developing the exposed silver halide color photographic lightsensitive material so that the tabular silver halide grains have an average number of development initiating points of 3.0 or more per grain at the time of completion of the color development.

(II) The method according to item (I) above, wherein the developing agent is selected from the group consisting of the compounds represented by the following general formulae (1) to (5):

(1)

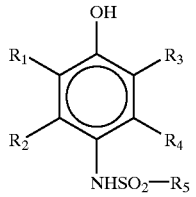

(2)

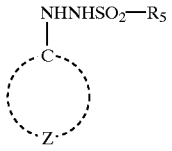

(3)

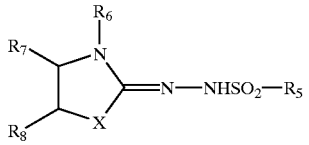

(4)

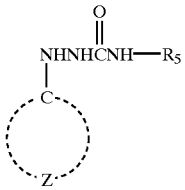

(5)

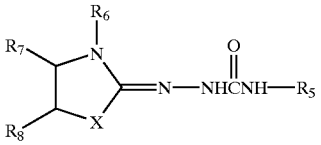

wherein each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group capable of forming an aromatic ring (including a heteroaromatic ring) together with the carbon atom, which aromatic ring may have a substituent other than —$NHNHSO_2$—$R_5$, provided that when the aromatic ring formed with Z is a benzene ring, the total of Hammett's constants (σ) of the substituents is 1 or more; $R_6$ represents a substituted or unsubstituted alkyl group; X represents an oxygen atom, a sulfur atom, a selenium atom or a tertiary nitrogen atom substituted with an alkyl group or aryl group; and $R_7$ and $R_8$ each represent a hydrogen atom or a substituent, provided that $R_7$ and $R_8$ may be bonded to each other to thereby form a double bond or a ring.

(III) The method according to item (I) above, wherein the developing agent is a paraphenylenediamine-type color developing agent.

(IV) The method according to item (I) above, wherein the precursor of developing agent is represented by the following general formula (6):

(6)

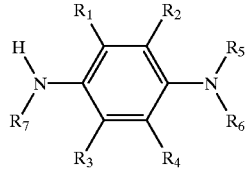

wherein each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N—$R_{18}$, each of $R_{16}$, $R_{17}$ and $R_{18}$ independently represents a hydrogen atom or an alkyl group, M represents a n-valence cation, and n is an integer of 1 to 5.

(V) The method according to any of items (I) to (IV) above, wherein the average number of development initiating points is 4.0 or more.

(VI) The method according to any of items (I) to (IV) above, wherein the average number of development initiating points is 5.0 or more.

(VII) The method according to any of items (I) to (IV) above, wherein the average number of development initiating points is 7.0 or more.

(VIII) The method according to any of items (I) to (VII) above, wherein the tabular silver halide grains have an average aspect ratio of 2 or more.

(IX) The method according to any of items (I) to (VII) above, wherein the tabular silver halide grains have an average aspect ratio of 8 or more.

(X) The method according to any of items (I) to (IX) above, wherein at least 50% (numerical ratio) of the tabular silver halide grains have at least 30 dislocation lines per grain, which dislocation lines are positioned at fringe portions of the tabular silver halide grains.

(XI) The method according to any of items (I) to (X) above, wherein the tabular silver halide grains contain a 6-cyano complex containing ruthenium as a central metal in an amount of $1\times10^{-6}$ to $5\times10^{-4}$ mol per mol of silver halide.

(XII) The method according to any of items (I) to (XI) above, wherein each of the tabular silver halide grains has surfaces onto which sensitizing dyes are adsorbed in multilayered form comprising a first layer and a second layer, the sensitizing dye in the second layer including both a cationic dye and an anionic dye, and the sensitizing dye in the first layer is different from the cationic dye and the anionic dye in the second layer.

(XIII) The method according to any of items (I) to (XII) above, wherein the silver halide color photographic lightsensitive material contains an organometallic salt.

(XIV) The method according to any of items (I) to (XIII) above, wherein the color development is performed at 60° C. or higher temperatures.

(XV) The method according to item (XIV) above, wherein the color development is performed for a period of 60 sec or less.

(XVI) The method according to item (XIV) above, wherein the color development is performed for a period of 45 sec or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

In the present invention, in the constitution of a lightsensitive material used to record an original scene and to reproduce the same as a color image, use can fundamentally be made of the color reproduction according to the subtractive color process. Specifically, a color information on original scene can be recorded by disposing at least three lightsensitive layers having lightsensitivity in blue, green and red regions and by incorporating, in the lightsensitive layers, color couplers capable of forming yellow, magenta and cyan dyes which are in complementary relationship to their own lightsensitive wavelength regions. Image for appreciation can be reproduced by subjecting a color photographic paper having a similar relationship between lightsensitive wavelength and colored hue to exposure through the thus obtained dye image. Also, it is practicable to read information on dye image obtained by photographing of an original scene by means of, for example, a scanner and to reproduce an image for appreciation on the basis of the read information. Reading image information immediately after the color development but prior to a desilvering step is preferred from the viewpoint of rapid processing.

It is further practicable to provide a relationship other than the above complementary one between lightsensitive wavelength region and colored hue. In that instance, the original color information can be reproduced by implementing an image processing such as hue conversion after the capturing of image information mentioned above.

Lightsensitive layers having lightsensitivity in three or more wavelength regions can be provided in the lightsensitive material for use in the method of the present invention.

In conventional color negative films for use in photographing, for attaining desired granularity, not only have improvements been effected with respect to the silver halide emulsion but also techniques such as the use of so-called DIR couplers which release a development inhibiting compound at a coupling reaction with a developing agent in an oxidized form have been incorporated. In the lightsensitive material to which the method of the present invention is applied, however, excellent granularity can be obtained even if no DIR couplers are employed.

The lightsensitive material of the present invention to which the method of the invention is applied (hereinafter also referred to as the lightsensitive material of the invention) will now be described in detail.

The lightsensitive material of the present invention comprises a support and, superimposed thereon, at least one lightsensitive silver halide emulsion layer containing a binder and lightsensitive silver halide grains in which tabular silver halide grains are contained. Further, the lightsensitive material contains a developing agent or a precursor thereof and a compound capable of forming a dye by a coupling reaction with the developing agent in an oxidized form. The lightsensitive material of the present invention, after exposure performed under conditions specified below, is such that the lightsensitive tabular silver halide grains can have an average number of development initiating points of 3.0 or more per grain at the time of completion of color development.

That is, in the processing method of the present invention, images must be formed at the time of exposure performed under conditions specified below so that the tabular silver halide grains contained in the emulsion constituting at least one emulsion layer of the color lightsensitive material have an average number of development initiating points of 3.0 or more per grain (at the time of completion of color development). In that instance, the method of development and development conditions (development time, development temperature, etc.) are arbitrary. That the average number of development initiating points per grain is less than 3.0 is unfavorable because it is difficult to realize the effect of the present invention. With respect to the tabular silver halide grains at the time of completion of color development, the average number of development initiating points per grain is preferably 4.0 or more, more preferably 5.0 or more, and most preferably 7.0 or more. Although there is no particular upper limit in the average number of development initiating points per grain with respect to the tabular silver halide grains, it is preferred that the average number do not exceed 30. When 30 is exceeded, a dispersion of latent image may occur in each grain to thereby invite a sensitivity lowering.

The exposure conditions are as follows:

light source: natural light of 2000 to 9000 K color temperature or artificial light corresponding thereto, exposure time: 1/10 to 1/1000 sec, and exposure amount: such that 80 to 90% (numerical ratio) of the lightsensitive silver halide grains contained in the lightsensitive silver halide emulsion layer have at least one development initiating point.

The terminology "development initiating points" used herein means sites where developed silver occurs on silver halide grains when observed upon the completion of color development.

The temperature at which the development is carried out is preferably 60° C. or higher, more preferably 90° C. or higher. The time during which the development is carried out is preferably in the range of 5 to 200 sec, more preferably 5 to 60 sec, and most preferably 5 to 45 sec.

In the present invention, there are suitable methods for increasing the number of development initiating points per grain with respect to the tabular silver halide grains, which include, for example, a method of increasing the aspect ratio of tabular silver halide grains to thereby increase the surface area (development start sites) per grain, a method of raising the development temperature, a method of internally providing a developing agent, a method of using a silver solvent, a method of enhancing the activity of developing agent, etc. These methods may be employed individually or in combination.

In the present invention, it is preferred that the development initiating points be localized at specified sites of tabular grain surfaces or in the vicinity thereof.

The position thereof is preferably apex portion or fringe portion of grains.

In the present invention, the proportion at which the development initiating points are localized at specified sites of the surfaces of tabular silver halide grains or in the vicinity thereof is preferably in the range of 60 to 100%, more preferably 80 to 100%, and most preferably 90 to 100%, based on the sum of development initiating points.

In the present invention, suitable methods are available for localizing the development initiating points at specified sites of the surfaces of tabular silver halide grains or in the vicinity thereof, which include, for example, a method of introducing dislocation lines at substantially limited specified sites of grains, a method of forming a silver salt epitaxy, a method of covering the sites of grains other than those specified where the development initiating points are to be formed with an adsorbable substance, etc. These methods may be employed individually or in combination.

The number and position of development initiating points formed on tabular grain surfaces can be studied by the following method.

That is, the study can be made by exposing a silver halide color photographic lightsensitive material under the aforementioned exposure conditions, developing the exposed lightsensitive material, and observing the thus formed developed silver through an electron microscope.

More specifically, the exposed silver halide color lightsensitive material is developed, dipped in an acetic acid solution to thereby terminate the development, and washed. The emulsion surface is dipped in a gelatin degradating enzyme solution, so that films are sequentially peeled from the top emulsion layer to the emulsion layer to be inspected. Carbon vapor deposition is performed on silver halide grains of the emulsion layer to be inspected which remains on the support. Intended inspection can be effected by observing reflected electrons through a scanning electron microscope (magnification: about 5,000 to 30,000).

The development initiating points are observed in whitish granular or filamentary form, like silver halide grains, on a monochromatic photograph taken using a scanning electron microscope in the above manner.

With respect to a color lightsensitive material of multilayer structure as well, silver halide grains of a specified emulsion layer can be observed by appropriately selecting the concentration and time at the step of dipping in a gelatin degradating enzyme solution.

In the present invention, for studying the number and position of development initiating points formed on tabular grain surfaces, it is preferred that the development initiating points be observed with respect to at least 100 grains. For more accurate study, 200 or more grains are observed.

The tabular grains for use in the present invention (hereinafter also referred to as "tabular grains of the present invention") are silver halide grains having two main planes arranged in opposite and parallel relationship to each other.

In the emulsion which can be used in the lightsensitive material of the present invention, 50% or more of the total projected area is occupied by tabular grains of silver iodobromide or silver iodochlorobromide having (111) faces as main planes. Herein, the expression "tabular silver halide grains" is a general term for silver halide grains having one twin face or two or more mutually parallel twin faces. The twin face refers to the (111) face on both sides of which the ions of all the lattice points are in the relationship of reflected images. The tabular grains, as viewed from a point perpendicular to the main plane of the tabular grains, have the shape of a triangle, a hexagon or a circle as obtained by rounding thereof. The triangular, hexagonal and circular tabular grains have mutually parallel main planes which are triangular, hexagonal and circular, respectively.

In the emulsion of the present invention, the projected area of the above tabular grains preferably occupies 100 to 80%, more preferably 100 to 90%, and most preferably 100 to 95%, of the total projected area of all the grains. When the projected area of the tabular grains is less than 80% of the total projected area of all the grains, unfavorably, the advantages (enhancement of ratio of speed/graininess and sharpness) of the tabular grains cannot be fully utilized.

In the emulsion of the present invention, it is preferred that hexagonal tabular grains whose neighboring side ratio (maximum side length/minimum side length) is in the range of 1.5 to 1 occupy 100 to 50% of the total projected area of all the grains of the emulsion. The above hexagonal tabular grains more preferably occupy 100 to 70%, most preferably 100 to 80%, of the total projected area. In the emulsion of the present invention, it is especially preferred that hexagonal tabular grains whose neighboring side ratio (maximum side length/minimum side length) is in the range of 1.2 to 1 occupy 100 to 50% of the total projected area of all the grains of the emulsion. The above hexagonal tabular grains more preferably occupy 100 to 70%, most preferably 100 to 80%, of the total projected area. The mixing of tabular grains other than these hexagonal tabular grains into the emulsion is not favorable from the viewpoint of intergranular homogeneity.

The distance between the twin planes of the tabular grain of the invention can be 0.012 $\mu$m or less, as disclosed in U.S. Pat. No. 5,219,720. Also, the ratio of the distance between (111) main planes/the distance between twin planes can be 15 or more, as disclosed in JP-A-5-249585. The distances can be selected depending on purposes.

An average grain thickness of the tabular grain of the invention is preferably 0.01 to 0.3 $\mu$m, more preferably 0.02 to 0.25 $\mu$m, much more preferably 0.03 to 0.15 $\mu$m.

The average grain thickness herein is an arithmetic mean of grain thinknesses of all the tabular grains. Grains having the average grain thickness of less than 0.01 $\mu$m are difficult to prepare. On the other hand, when the average grain thickness exceeds 0.3 $\mu$m, it is difficult to obtain the advantages of the invention, which is not preferable.

An average equivalent circle diameter of the tabular grains of the invention is preferably 0.3 to 5 $\mu$m, more preferably 0.5 to 4 $\mu$m, and much more preferably 0.7 to 3 $\mu$m.

The average equivalent circle diameter herein is an arithmetic mean of equivalent circle diameters of all the tabular grains contained in the emulsion.

When the average equivalent circle diameter is less than 0.3 μm, it is not easy to attain the advantages of the invention, which is not preferable. on the other hand, when the average equivalent circle diameter exceeds 5 μm, pressure property deteriorates, which is not preferable.

The ratio of equivalent circle diameter to thickness with respect to silver halide grain is referred to as "aspect ratio". That is, the aspect ratio is the quotient of the equivalent circle diameter of the projected area of each individual silver halide grain divided by the grain thickness.

One method of determining the aspect ratio comprises obtaining a transmission electron micrograph by the replica technique and measuring the diameter of a circle with the same area as the projected area of each individual grain (equivalent circle diameter) and the grain thickness.

This grain thickness is calculated from the length of replica shadow.

The emulsion of the invention has an average aspect ratio of preferably 2 to 100, more preferably 5 to 80, much more preferably 8 to 50, and especially preferably 12 to 50.

The average aspect ratio herein is an arithmetic mean of aspect ratios of all the tabular grains in the emulsion.

When the average aspect ratio is less than 2, the merit of the tabular grains cannot be fully utilized, which is not preferable. On the other hand, when the aspect ratio exceeds 100, pressure property deteriorates, which is not preferable.

It is preferred that the emulsion of the present invention be composed of monodisperse grains. In the present invention, the variation coefficient of grain size (equivalent sphere diameter) distribution of all silver halide grains is preferably in the range of 35 to 3%, more preferably 20 to 3%, and most preferably 15 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution of all tabular grains exceeds 35% is not favorable from the viewpoint of intergranular homogeneity. On the other hand, it is difficult to prepare an emulsion wherein the variation coefficient is below 3%.

The variation coefficient of equivalent circle diameter distribution of all grains contained in the emulsion of the present invention is preferably in the range of 40 to 3%, more preferably 25 to 3%, and most preferably 15 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all grains exceeds 40% is not favorable from the viewpoint of intergranular homogeneity. On the other hand, it is difficult to prepare an emulsion wherein the variation coefficient is below 3%.

The variation coefficient of grain thickness distribution of all tabular grains contained in the emulsion of the present invention is preferably in the range of 25 to 3%, more preferably 20 to 3%, and most preferably 15 to 3%. The terminology "variation coefficient of grain thickness distribution" used herein means the product obtained by dividing the dispersion (standard deviation) of grain thicknesses of individual tabular grains by the average grain thickness and multiplying the resultant quotient by 100. That the variation coefficient of grain thickness distribution of all tabular grains exceeds 25% is not favorable from the viewpoint of intergranular homogeneity. On the other hand, it is difficult to prepare an emulsion wherein the variation coefficient is below 3%.

The variation coefficient of distribution of distance between twin planes of all tabular grains contained in the emulsion of the present invention is preferably in the range of 25 to 3%, more preferably 20 to 3%, and most preferably 15 to 3%. The terminology "variation coefficient of distribution of distance between twin planes" used herein means the product obtained by dividing the dispersion (standard deviation) of distance between twin planes of individual tabular grains by the average distance between twin planes and multiplying the resultant quotient by 100. That the variation coefficient of distance between twin planes of all tabular grains exceeds 25% is not favorable from the viewpoint of intergranular homogeneity. On the other hand, it is difficult to prepare an emulsion wherein the variation coefficient is below 3%.

In the present invention, although the grain thickness, aspect ratio and monodispersity can be selected within the above ranges in conformity with the purpose of the use thereof, it is desirable to employ monodisperse tabular grains of small grain thickness and high aspect ratio.

In the present invention, various methods can be employed for the formation of tabular grains of high aspect ratio. For example, the grain forming methods described in U.S. Pat. Nos. 5,496,694 and 5,498,516, can be employed.

In the production of monodisperse tabular grains of high aspect ratio, it is important to form twinned crystal nuclei of small size within a short period of time. Thus, it is desirable to perform nucleation within a short period of time under low temperature, high pBr, low pH and small gelatin amount conditions. with respect to the type of gelatin, a gelatin of low molecular weight, a gelatin whose methionine content is low or a gelatin whose amino group is modified with, for example, phthalic acid, trimellitic acid or pyromellitic acid and the like are preferably employed.

After the nucleation, physical ripening is performed to thereby eliminate nuclei of regular crystals, single twinned crystals and nonparallel multiple twinned crystals while selectively causing nuclei of parallel double twinned crystals to remain. Further ripening among the remaining nuclei of parallel double twinned crystals is preferable from the viewpoint of enhancing the monodispersity.

Also, it is preferable to perform the physical ripening, for example, in the presence of PAO (polyalkylene oxide) as described in U.S. Pat. No. 5,147,771, from the viewpoint of enhancing the monodispersity.

Thereafter, supplemental gelatin is added, and soluble silver salts and soluble halides are added to thereby effect a grain growth. The above gelatin whose amino group is modified with, for example, phthalic acid, trimellitic acid or pyromellitic acid is preferably employed as the supplemental gelatin.

Further, the grain growth can preferably be performed by adding silver halide fine grains separately prepared in advance or simultaneously prepared in a separate reaction vessel to thereby feed silver and halide.

During the grain growth as well, it is important to control and optimize the temperature of reaction mixture, pH, amount of binder, pBr, feeding speeds of silver and halide ion, etc.

In the formation of silver halide emulsion grains for use in the present invention, it is preferable to employ silver iodobromide or silver chloroiodobromide. When there is a phase containing an iodide or a chloride, the phase may be uniformly distributed in each grain, or may be localized therein.

Furthermore, other silver salts, such as silver rhodanate, silver sulfide, silver selenide, silver carbonate, silver phosphate and an organic acid salt of silver, may be contained in the form of other separate grains or as parts of silver halide grains.

In the emulsion grains of the present invention, the silver bromide content is preferably 80 mol % or more, more preferably 90 mol % or more.

The silver iodide content of the emulsion of the present invention is preferably in the range of 1 to 20 mol %, more preferably 2 to 15 mol %, and most preferably 3 to 10 mol %. Silver iodide contents of less than 1 mol % are not suitable because it becomes difficult to realize the effects of enhancing dye adsorption, increasing of intrinsic photographic speed, etc. On the other hand, silver iodide contents of more than 20 mol % are not suitable because the development velocity is generally delayed.

The variation coefficient of intergranular silver iodide content distribution in the emulsion grains for use in the present invention is preferably 30% or less, more preferably 25 to 3%, and most preferably 20 to 3%. That the variation coefficient exceeds 30% is not favorable from the viewpoint of intergranular homogeneity. The terminology "variation coefficient of intergranular silver iodide content distribution" used herein means the product obtained by dividing the standard deviation of silver iodide contents of individual emulsion grains by the average silver iodide content and multiplying the resultant quotient by 100. The silver iodide contents of individual emulsion grains can be measured by analyzing the composition of each individual grain by means of an X-ray microanalyzer.

The measuring method is described in, for example, EP No. 147,868. In the determination of the distribution of silver iodide contents of individual grains contained in the emulsion of the present invention, the silver iodide contents are preferably measured with respect to at least 100 grains, more preferably at least 200 grains, and most preferably at least 300 grains.

The surface iodide content of the emulsion used in the invention is preferably 5 mol % or less, more preferable 4 mol % or less, much more preferably 3 mol % or less. When the surface iodide content exceeds 5 mol %, development inhibition and chemical sensitization inhibition occur, which are not preferable. Measurement of the surface iodide content can be conducted by ESCA method (also known as the XPS method, which is the method in which X-rays are irradiated to grains and photoelectrons emitted from the grain surface are spectralized).

Each of the emulsion grains of the invention mainly comprises (111) faces and (100) faces. A ratio of an area occupied by (111) faces to all the surface area of the emulsion grains is preferably at least 70%.

On the other hand, the portion where (100) faces appear in the emulsion grains of the invention is at side surfaces of the tabular grains. The ratio of an area occupied by (100) faces to the surface area of the emulsion grains, to an area occupied by (111) faces to the surface area of the emulsion grains is preferably at least 2%, more preferably 4% or more. The control of the (100) face ratio can be conducted by referring to the descriptions in JP-A's-2-298935 and 8-334850. The ratio of (100) face can be measured by a method that uses difference of adsorption dependency between (111) face and (100) face to a spectral sensitizing dye, for example, the method described in Tani, J. Imaging Sci., 29, 165(1985).

In the emulsion grains used in the invention, an area ratio of (100) faces in the side faces of the tabular grains is preferably 15% or more, and more preferably 25% or more. The area ratio of (100) faces in the side faces of the tabular grains can be obtained by the method described, for example, in JP-A-8-334850.

The tabular grains used in the invention preferably have a dislocation line.

The dislocation line is a linear lattice defect at the boundary between a region already slipped and a region not slipped yet on a slip plane of crystal.

Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope.

In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

JP-A-63-220238 describes a technique of introducing, under control, dislocation lines into silver halide grains.

It is mentioned that the tabular grains into which dislocation lines have been introduced are superior to the tabular grains having no dislocation lines in photographic characteristics such as sensitivity and reciprocity law.

Although the method of introducing dislocation lines is optional, the method described in U.S. Pat. Nos. 5,498,516 and 5,527,664 is preferred. In the described method, first, iodide ions are released from an iodide ion release agent to thereby realize an epitaxial growth of a phase of high silver iodide content on host grains. Thereafter, a silver halide shell is formed on the external part of host grains so as to effect introduction of dislocation lines.

With respect to the tabular grains, the position and number of dislocation lines in each grain, as viewed in a direction perpendicular to the main planes thereof, can be determined from a photograph of grains taken using an electron microscope in the above manner.

When the tabular grains of the present invention have dislocation lines, the position thereof is optional and can be selected from among, for example, localizing dislocation lines at apex and fringe portions of grains and introducing dislocation lines throughout the main planes. It is especially preferred that dislocation lines be localized at fringe portions.

The fringe portion mentioned in the present invention refers to the periphery of tabular grains. Specifically, the fringe portion refers to an outer region from a point where, in a distribution of silver iodide from the sides to center of tabular grains, the silver iodide content exceeds or becomes less than the average silver iodide content over the entire grain, as viewed from the grain sides.

In the present invention, it is preferred that the dislocation lines be introduced at a high density in the fringe portions of tabular grains. The tabular grains preferably have in the fringe portions thereof 10 or more dislocation lines, more preferably 20 or more dislocation lines, and most preferably 30 or more dislocation lines. When the dislocation lines are present densely or are observed as crossing each other, it may occur that the dislocation lines per grain cannot be accurately counted. However, in that instance, it is practicable to make approximate counting, such as about 10 dislocation lines, about 20 dislocation lines, about 30 dislocation lines, etc.

When the tabular grains of the present invention have dislocation lines, from the viewpoint of inter-granular homogeneity, it is preferred that an inter-granular dislocation line quantitative distribution be uniform. In the present invention, it is preferred to employ an emulsion wherein silver halide tabular grains having 10 or more dislocation lines per grain in the fringe portions thereof occupy at least 50%, more preferably at least 80% (numerical ratio of grains), based on all the tabular grains. Further, in the present invention, it is preferred to employ an emulsion wherein silver halide tabular grains having 30 or more dislocation lines per grain in the fringe portions thereof occupy at least 50%, more preferably at least 80% (numerical ratio of grains), based on all the tabular grains.

Moreover, when the tabular grains of the present invention have dislocation lines, it is preferred that intra-granular dislocation line introduction positions be homogeneous. In the present invention, it is preferred to employ an emulsion wherein silver halide tabular grains having dislocation lines localized in substantially the grain fringe portions only occupy at least 50%, more preferably at least 60%, and most preferably at least 80% (numerical ratio of grains), based on all the tabular grains.

The terminology "substantially the grain fringe portions only" used herein means that 5 or more dislocation lines are not contained in grain non-fringe portion, namely, grain central portion. The grain central portion refers to an inner region surrounded by fringe regions, as viewed in a direction perpendicular to the main plane of grain.

Also, when the tabular grains of the present invention have dislocation lines, it is preferred that the dislocation lines be present over a vast plurality of fringe regions. It is preferred that tabular grains having dislocation lines in fringe portions throughout 50% or more of the grain fringe region area occupy at least 50%, more preferably at least 60%, and most preferably at least 80% (numerical ratio of grains), based on all the tabular grains. Further, it is preferred that tabular grains having dislocation lines in fringe portions throughout 70% or more of the grain fringe region area occupy at least 50%, more preferably at least 60%, and most preferably at least 80% (numerical ratio of grains), based on all the tabular grains.

When the tabular grains of the present invention have dislocation lines in grain fringe portions, the thickness of fringe portion region (depth toward grain center) is preferably in the range of 0.05 to 0.25 $\mu$m, more preferably 0.10 to 0.20 $\mu$m.

In the present invention, when it is intended to determine the ratio of grains having dislocation lines and the number of dislocation lines, the determination is preferably accomplished by directly observing dislocation lines with respect to at least 100 grains, more preferably at least 200 grains, and most preferably 300 grains.

Moreover, when the tabular grains of the present invention have dislocation lines in grain fringe portions, 50% or more (numerical ratio of grains) of all the tabular grains are preferably occupied by tabular grains wherein the average silver iodide content of grain fringe portions is 2 mol % or more higher than that of grain central portions, more preferably by tabular grains wherein the average silver iodide content of grain fringe portions is 4 mol % or more higher than that of grain central portions, and most preferably by tabular grains wherein the average silver iodide content of grain fringe portions is 5 mol % or more higher than that of grain central portions.

The silver iodide content within tabular grains can be determined by, for example, the method of JP-A-7-219102 using an analytical electron microscope.

The tabular grains of the present invention may be epitaxial silver halide grains comprising host tabular grains and, superimposed on surfaces thereof, at least one sort of silver salt epitaxy.

In the present invention, the silver salt epitaxy may be formed on selected sites of host tabular grain surfaces, or may be localized on corners or edges (when tabular grains are viewed from a direction perpendicular to the main plane, grain side faces and site on each side) of host tabular grains.

When it is intended to form the silver salt epitaxy, it is preferred that the formation be effected on selected sites of host tabular grain surfaces with intra-granular and inter-granular homogeneity.

As the practical silver salt epitaxy site-directing method, there can be mentioned, for example, the method of loading host grains with silver iodide, and the method of causing host grains to adsorb a spectral sensitizing dye (for example, a cyanine dye) or an aminoazaindene (for example, adenine) before the formation of silver salt epitaxy as described in U.S. Pat. No. 4,435,501. These methods may be employed.

Further, before the formation of silver salt epitaxy, iodide ions may be added and deposited on host grains.

Of these site-directing methods, an appropriate one may be selected according to given occasion, or a plurality thereof may be used in combination.

When the silver salt epitaxy is formed, the ratio of silver salt epitaxy occupancy to the surface area of host tabular grains is preferably in the range of 1 to 50%, more preferably 2 to 40%, and most preferably 3 to 30%.

When the silver salt epitaxy is formed, the ratio of the silver quantity of silver salt epitaxy to the total silver quantity of silver halide tabular grains is preferably in the range of 0.3 to 50 mol %, more preferably 0.3 to 25 mol %, and most preferably 0.5 to 15 mol %.

The composition of silver salt epitaxy can be selected so as to conform to given occasion. Although use can be made of a silver halide containing any of chloride ion, bromide ion and iodide ion, it is preferred that the silver salt epitaxy be constituted of a silver halide containing at least chloride ion.

When the silver salt epitaxy is formed, a preferable silver halide epitaxy is an epitaxy containing silver chloride. An epitaxy formation from silver chloride is easy because silver chloride forms the same face-centered cubic lattice structure as constituted by silver bromide or silver iodobromide as a constituent of host tabular grains. However, there is a difference between lattice spacings formed by two types of silver halides, which difference leads to such an epitaxy joining as will contribute to an enhancement of photographic sensitivity.

The silver chloride content of silver halide epitaxy is preferably at least 10 mol %, more preferably at least 15 mol %, and most preferably at least 20 mol %, higher than that of host tabular grains.

When the difference between these silver chloride contents is less than 10 mol %, it is unfavorably difficult to attain the effect of the present invention.

Introducing iodide ions in the silver halide epitaxy is preferred for sensitivity enhancement.

When the silver halide epitaxy is formed, the ratio of the quantity of silver contained in the form of silver iodide in silver halide epitaxy to the total silver quantity of silver halide epitaxy is preferably at least 1 mol %, more preferably 1.5 mol % or more.

In the introduction of halide ions in the silver halide epitaxy, it is preferred that, for increasing the introduction amount thereof, halide ions be introduced in sequence conforming to the composition of epitaxy.

For example, when it is intended to form an epitaxy wherein silver chloride is much contained in an inner part, silver bromide in an intermediate part and silver iodide in an outer part, chloride ions, bromide ions and iodide ions are sequentially added in the form of halides, so that the solubility of silver halide containing added halide ions is rendered lower than that of other silver halides to thereby deposit that silver halide with the result that a layer enriched in that silver halide is formed.

Silver salts other than silver halides, such as silver rhodanate, silver sulfide, silver selenide, silver carbonate, silver phosphate and organic acid silver salts, may be contained in the silver salt epitaxy.

The formation of silver salt epitaxy can be accomplished by various methods, for example, the method of adding halide ions, the method of adding an aqueous solution of silver nitrate and an aqueous solution of halide according to the double jet technique and the method of adding silver halide fine grains. Of these methods, an appropriate one may be selected according to given occasion, or a plurality thereof may be used in combination.

In the formation of silver salt epitaxy, the temperature, pH and pAg of system, the type and concentration of protective colloid agent such as gelatin, the presence or absence, type and concentration of silver halide solvent, etc. can widely be varied.

Silver halide tabular grain emulsions having a silver salt epitaxy formed on host tabular grain surfaces are recently disclosed in, for example, EP Nos. 0699944A, 0701165A, 0701164A, 0699945A, 0699948A, 0699946A, 0699949A, 0699951A, 0699950A and 0699947A, U.S. Pat. Nos. 5,503,971, 5,503,970 and 5,494,789 and JP-A's 8-101476, 8-101475, 8-101473, 8-101472, 8-101474 and 8-69069. Grain forming methods described in these references can be employed in the present invention.

With respect to epitaxial silver halide grains, for the retention of the configuration of host tabular grains or for the site directing of silver salt epitaxy onto grain edge/corner portions, it is preferred that the silver iodide content of outer regions (portions where final deposition occurs, forming grain edge/corner portions) of host tabular grains be at least 1 mol % higher than that of central regions thereof.

In that instance, the silver iodide content of outer regions is preferably in the range of 1 to 20 mol %, more preferably 5 to 15 mol %. When the silver iodide content is less than 1 mol %, it is difficult to attain the above effect. On the other hand, when the silver iodide content exceeds 20 mol %, the development velocity is unfavorably retarded.

Further, in that instance, the ratio of the total silver quantity contained in outer regions containing silver iodide to the total silver quantity contained in host tabular grains is preferably in the range of 10 to 30%, more preferably 10 to 25%. When the ratio is less than 10% or exceeds 30%, it is unfavorably difficult to attain the above effect.

Still further, in that instance, the silver iodide content of central regions is preferably in the range of 0 to 10 mol %, more preferably 1 to 8 mol %, and most preferably 1 to 6 mol %. When the silver iodide content exceeds 10 mol %, the development velocity is unfavorably retarded.

With respect to the tabular grains of the present invention, it is preferred to intra-granularly dope the same with at least one photographically useful metal ion or complex (hereinafter referred to as "metal (complex) ion").

The metal ion doping within silver halide grains will be described below.

The photographically useful metal (complex) ion refers to a compound employed in intra-granular doping for the purpose of improving the photographic characteristics of lightsensitive silver halide emulsion. This compound functions as a transient or permanent trap for electrons or positive holes in silver halide crystals, and exerts such effects as high sensitivity, high contrast, improvement of reciprocity law characteristics and improvement of pressure characteristics.

As the metal for use in doping within emulsion grains in the present invention, there can preferably be employed the first to third transition metal elements such as iron, ruthenium, rhodium, palladium, cadmium, rhenium, osmium, iridium, platinum, chromium and vanadium and further amphoteric metal elements such as gallium, indium, thallium and lead. These metal ions are doped in the form of a complex salt or a single salt. With respect to the complex ion, a six-coordinate halogeno or cyano complex containing halide ion or cyanide (CN) ion as a ligand is preferably used.

Also, use can be made of a complex having a nitrosyl (NO) ligand, a thionitrosyl (NS) ligand, a carbonyl (CO) ligand, a thiocarbonyl (NCO) ligand, a thiocyanato (NCS) ligand, a selenocyanato (NCSe) ligand, a tellurocyanato (CNTe) ligand, a dinitrogen ($N_2$) ligand, an azido ($N_3$) ligand or an organic ligand such as a bipyridyl ligand, a cyclopentadienyl ligand, a 1,2-dithiolenyl ligand or an imidazolyl ligand. The following polydentate ligands may be used as the ligand. That is, use may be made of any of bidentate ligands such as a bipyridyl ligand, tridentate ligands such as diethylenetriamine, tetradentate ligands such as triethylenetetramine and hexadentate ligands such as ethylenediaminetetraacetic acid. The coordination number is preferably 6, but may be 4. With respect to the organic ligand, those described in U.S. Pat. Nos. 5,457,021, 5,360,712 and 5,462,849, the disclosures of which are incorporated herein by reference, can preferably be employed. Further, it is also preferred to incorporate the metal ion in the form of an oligomer.

Although, as apparent from the above, emulsion grains may internally be doped with various metal ions in the present invention, it is especially preferred to employ a hexacyano complex containing ruthenium as a central metal.

When the metal (complex) ion is incorporated in a silver halide, it is important whether the size of metal (complex) ion is suitable to the lattice spacing of silver halide. Further, that a compound with the silver or halide ion of the metal (complex) ion is co-precipitated together with the silver halide is essential for the doping of the silver halide with the metal (complex) ion. Accordingly, it is required that the pKsp (common logarithm of inverse number of solubility product) of the compound with the silver or halide ion of the metal (complex) ion be approximately equal to the pKsp (silver chloride 9.8, silver bromide 12.3, and silver iodide 16.1) of silver halide. Therefore, the pKsp of the compound with the silver or halide ion of the metal (complex) ion is preferably in the range of 8 to 20.

The amount of metal complex with which silver halide grains are doped is generally in the range of $10^{-9}$ to $10^{-2}$ mol per mol of silver halide. Specifically, the amount of metal complex which provides a transient shallow electron trap in the photo-stage is preferably in the range of $10^{-6}$ to $10^{-2}$ mol, more preferably $1\times10^{-6}$ to $5\times10^{-4}$ mol, per mol of silver halide. On the other hand, the metal complex which provides a deep electron trap in the photo-stage is preferably used in an amount of $10^{-9}$ to $10^{-5}$ mol, per mol of silver halide.

In particular, in the emulsion for use in the present invention, it is preferred to dope the silver halide with the above hexacyano complex containing ruthenium as a central metal in an amount of $10^{-6}$ to $5\times10^{-4}$ mol per mol of silver halide.

The content of metal (complex) ion in emulsion grains can be determined by the atomic absorption, polarized Zeeman spectroscopy and ICP analysis. The ligand of metal complex ion can be identified by the infrared absorption (especially, FT-IR).

The doping of silver halide grains with the above metal (complex) ion can be effected at any of a grain surface phase, an internal phase and a surface phase which is extremely shallow to such an extent that surface exposure of metal ions is inhibited (known as "subsurface") as described in U.S. Pat. Nos. 5,132,203 and 4,997,751. Selection may be made in conformity with the intended use. Further, a plurality of metal ions may be used in the doping. These may be used to dope a single phase, or phases which are different from each other. The method of adding such a compound may be one comprising mixing an intended metal salt solution with an aqueous solution of halide or an solution of water-soluble silver salt at the time of grain formation, or may be one comprising directly adding the intended metal salt solution. Also, the method may comprise adding silver halide emulsion fine grains doped with the intended metal ion. When the metal salt is dissolved in water or an appropriate solvent such as methanol or acetone, in order to stabilize the solution, it is preferred to employ a method wherein an aqueous solution of hydrogen halide (for example, HCl or HBr), thiocyanic acid or its salt, or an alkali halide (for example, KCl, NaCl, KBr or NaBr) is added. Further, adding an acid, an alkali or the like according to necessity is preferred from the same viewpoint.

When emulsion grains are doped with a metal ion of cyano complex, it may occur that the cyano complex reacts with gelatin to thereby generate cyan, which inhibits gold sensitization. In that instance, as described in, for example, JP-A-6-308653, it is preferred to add thereto a compound capable of inhibiting the reaction between gelatin and cyano complex. For example, it is preferred that the process after the doping with the metal ion of cyano complex be carried out in the presence of a metal ion capable of forming a coordinate bond with gelatin, such as zinc ion.

A lightsensitive silver halide emulsion comprising tabular silver halide grains having a sensitizing dye adsorbed thereon so that the spectral absorption maximum wavelength is less than 500 nm while the light absorption intensity is 60 or more or so that the spectral absorption maximum wavelength is 500 nm or more while the light absorption intensity is 100 or more, preferably employed in the present invention, will now be described.

In the present invention, the light absorption intensity refers to a light absorption area intensity per grain surface area realized by a sensitizing dye. It is defined as an integral value, over wave number ($cm^{-1}$), of optical density Log (Io/(Io-I)), wherein Io represents the quantity of light incident on each unit surface area of grains and I represents the quantity of light absorbed by the sensitizing dye on the surface. The range of integration is from 5000 $cm^{-1}$ to 35,000 $cm^{-1}$.

With respect to the silver halide photographic emulsion of the present invention, it is preferred that tabular silver halide grains of 60 or more light absorption intensity in the use of grains of less than 500 nm spectral absorption maximum wavelength, or tabular silver halide grains of 100 or more light absorption intensity in the use of grains of 500 nm or more spectral absorption maximum wavelength, occupy 50% or more of the total projected area of silver halide grains. With respect to the grains of 500 nm or more spectral absorption maximum wavelength, the light absorption intensity is preferably 150 or more, more preferably 170 or more, and most preferably 200 or more. With respect to the grains of less than 500 nm spectral absorption maximum wavelength, the light absorption intensity is preferably 90 or more, more preferably 100 or more, and most preferably 120 or more. In both instances, although there is no particular upper limit, the light absorption intensity is preferably up to 2000, more preferably up to 1000, and most preferably up to 500. With respect to the grains of less than 500 nm spectral absorption maximum wavelength, the spectral absorption maximum wavelength is preferably 350 nm or more.

As one method of measuring the light absorption intensity, there can be mentioned the method of using a microscopic spectrophotometer. The microscopic spectrophotometer is a device capable of measuring an absorption spectrum of minute area, whereby a transmission spectrum of each grain can be measured. With respect to the measurement of an absorption spectrum of each grain by the microscopic spectrophotometry, reference can be made to the report of Yamashita et al. (page 15 of Abstracts of Papers presented before the 1996 Annual Meeting of the Society of Photographic Science and Technology of Japan). The absorption intensity per grain can be determined from the absorption spectrum. Because the light transmitted through grains is absorbed by two surfaces, i.e., upper surface and lower surface, however, the absorption intensity per grain surface area can be determined as 1/2 of the absorption intensity per grain obtained in the above manner. At that time, although the interval for absorption spectrum integration is from 5000 $cm^{-1}$ to 35,000 $cm^{-1}$ in view of the definition of light absorption intensity, experimentally, it is satisfactory to integrate over an interval including about 500 $cm^{-1}$ after and before the interval of absorption by sensitizing dye.

Apart from the microscopic spectrophotometry, the method of arranging grains in such a manner that the grains are not piled one upon another and measuring a transmission spectrum is also practical.

The light absorption intensity is a value unequivocally determined from the oscillator strength and number of adsorbed molecules per area with respect to the sensitizing dye. If, with respect to the sensitizing dye, the oscillator strength, dye adsorption amount and grain surface area are measured, these can be converted into the light absorption intensity.

The oscillator strength of sensitizing dye can be experimentally determined as a value proportional to the absorption area intensity (optical density×$cm^{-1}$) of sensitizing dye solution, so that the light absorption intensity can be calculated within an error of about 10% by the formula:

$$[\text{light absorption intensity}]\approx 0.156\times A\times B/C$$

wherein A represents the absorption area intensity per M of dye (optical density×$cm^{-1}$), B represents the adsorption amount of sensitizing dye (mol/molAg) and C represents the grain surface area C ($m^2$/molAg).

Calculation of the light absorption intensity through this formula gives substantially the same value as the integral value, over wave number ($cm^{-1}$), of light absorption intensity (Log (Io/(Io-I))) measured in accordance with the aforementioned definition.

For increasing the light absorption intensity, there can be employed any of the method of adsorbing more than one layer of dye chromophore on grain surfaces, the method of increasing the molecular absorption coefficient of dye and the method of decreasing a dye-occupied area. Of these, the method of adsorbing more than one layer of dye chromophore on grain surfaces (multi-layer adsorption of sensitizing dye) is preferred.

The expression "adsorption of more than one layer of dye chromophore on grain surfaces" used herein means the presence of more than one layer of dye bound in the vicinity of silver halide grains. Thus, it is meant that dye present in a dispersion medium is not contained. Even if a dye chromophore is connected with a substance adsorbed on grain surfaces through a covalent bond, when the connecting group is so long that the dye chromophore is present in the dispersion medium, the effect of increasing the light absorption intensity is slight and hence it is not regarded as the more than one layer adsorption. Further, in the so-called multi-layer adsorption wherein more than one layer of dye chromophore is adsorbed on grain surfaces, it is required that a spectral sensitization be brought about by a dye not directly adsorbed on grain surfaces. For meeting this requirement, the transfer of excitation energy from the dye not directly adsorbed on silver halide to the dye directly adsorbed on grains is inevitable. Therefore, when the transfer of excitation energy must occur in more than 10 stages, the final transfer efficiency of excitation energy will unfavorably be low. As an example thereof, there can be mentioned such a case that, as experienced in the use of polymer dyes of, for example, JP-A-2-113239, most of dye chromophore is present in a dispersion medium, so that more than 10 stages are needed for the transfer of excitation energy. In the present invention, it is preferred that the number of excitation energy transfer stages per molecule range from 1 to 3.

The terminology "chromophore" used herein means an atomic group which is the main cause of molecular absorption bands as described on pages 985 and 986 of Physicochemical Dictionary (4th edition, published by Iwanami Shoten, Publishers in 1987), for example, any atomic group selected from among C═C, N═N and other atomic groups having unsaturated bonds.

Examples thereof include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an allylidene dye, an anthraquinone dye, a triphenylmethane dye, an azo dye, an azomethine dye, a spiro compound, a metallocene dye, a fluorenone dye, a fulgide dye, a perillene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperillene dye, a porphyrin dye, a chlorophyll dye, a phthalocyanine dye and a metal complex dye. Of these, there can preferably be employed polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. More preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimally employed.

Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds—Special topics in heterocyclic chemistry", chapter 18, section 14, pages 482 to 515, John Wiley & Sons, New York, London, 1977. With respect to the general formulae for the cyanine dye, merocyanine dye and rhodacyanine dye, those shown in U.S. Pat. No. 5,340,694, columns 21 to 22, (XI), (XII) and (XIII), are preferred. In the formulae, the numbers n12, n15, n17 and n18 are not limited as long as each of these is an integer of 0 or greater (preferably, 4 or less).

The adsorption of a dye chromophore on silver halide grains is preferably carried out in at least 1.5 layers, more preferably at least 1.7 layers, and most preferably at least 2 layers. Although there is no particular upper limit, the number of layers is preferably 10 or less, more preferably 5 or less.

The expression "adsorption of more than one layer of chromophore on silver halide grain surfaces" used herein means that the adsorption amount of dye chromophore per area is greater than a one-layer saturated coating amount, this one-layer saturated coating amount defined as the saturated adsorption amount per area attained by a dye which exhibits the smallest dye-occupied area on silver halide grain surfaces among the sensitizing dyes added to the emulsion. The number of adsorption layers means the adsorption amount evaluated on the basis of one-layer saturated coating amount. With respect to dyes having dye chromophores connected to each other by covalent bonds, the dye-occupied area of unconnected individual dyes can be employed as the basis.

The dye-occupied area can be determined from an adsorption isothermal line showing the relationship between free dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

The adsorption amount of a sensitizing dye onto emulsion grains can be determined by two methods. The one method comprises centrifuging an emulsion having undergone a dye adsorption to thereby separate the emulsion into emulsion grains and a supernatant aqueous solution of gelatin, determining an unadsorbed dye concentration from the measurement of spectral absorption of the supernatant, and subtracting the same from the added dye amount to thereby determine the adsorbed dye amount. The other method comprises depositing emulsion grains, drying the same, dissolving a given weight of thr deposit in a 1:1 mixture of an aqueous solution of sodium thiosulfate and methanol, and effecting a spectral absorption measurement thereof to thereby determine the adsorbed dye amount. When a plurality of sensitizing dyes are employed, the absorption amount of each dye can be determined by high-performance liquid chromatography or other techniques. With respect to the method of determining the dye absorption amount by measuring the dye amount in a supernatant, reference can be made to, for example, W. West et al., Journal of Physical Chemistry, vol. 56, page 1054 (1952). However, even unadsorbed dye may be deposited when the addition amount of dye is large, so that an accurate absorption amount may not always be obtained by the method of measuring the dye concentration of the supernatant. On the other hand, in the method in which the absorption amount of dye is determined by dissolving deposited silver halide grains, the deposition velocity of emulsion grains is overwhelmingly faster, so that grains and deposited dye can easily be separated from each other. Thus, only the amount of dye adsorbed on grains can accurately be determined. Therefore, this method is most reliable as a means for determining the dye absorption amount.

As one method of measuring the surface area of silver halide grains, there can be employed the method wherein a transmission electron micrograph is taken according to the replica method and wherein the configuration and size of each individual grain are measured and calculated. In this method, the thickness of tabular grains is calculated from the length of shadow of the replica. With respect to the method of taking a transmission electron micrograph, reference can be made to, for example, Denshi Kenbikyo Shiryo Gijutsu Shu (Electron Microscope Specimen Technique Collection) edited by the Kanto Branch of the Society of Electron Microscope of Japan and published by Seibundo Shinkosha in 1970 and P. B. Hirsch, "Electron Microscopy of Thin Crystals", Buttwrworths, London (1965).

When a multi-layer of dye chromophore is adsorbed on silver halide grains in the present invention, although the reduction potentials and oxidation potentials of the dye chromophore of the first layer, namely the layer directly adsorbed on silver halide grains, vs. the dye chromophore of the second et seq. layers are not particularly limited, it is preferred that the reduction potential of the dye chromophore of the first layer be noble to the remainder of the reduction potential of the dye chromophore of the second et seq. layers minus 0.2V.

Although the reduction potential and oxidation potential can be measured by various methods, the measurement is preferably carried out by the use of phase discrimination second harmonic a.c. polarography, whereby accurate values can be obtained. The method of measuring-potentials by the use of phase discrimination second harmonic a.c. polarography is described in Journal of Imaging Science, vol. 30, page 27 (1986).

The dye chromophore of the second et seq. layers preferably consists of a luminescent dye. With respect to the type of luminescent dye, those having the skeletal structure of dye for use in dye laser are preferred. These are edited in, for example, Mitsuo Maeda, Laser Kenkyu (Laser Research), vol. 8, pp. 694, 803 and 958 (1980) and ditto, vol. 9, page 85 (1981), and F. Sehaefer, "Dye Lasers", Springer (1973).

Moreover, the absorption maximum wavelength of dye chromophore of the first layer in the silver halide photographic lightsensitive material is preferably greater than that of dye chromophore of the second et seq. layers. Further, preferably, the light emission of dye chromophore of the second et seq. layers and the absorption of dye chromophore of the first layer overlap each other. Also, it is preferred that the dye chromophore of the first layer form a J-association product. Still further, for exhibiting absorption and spectral sensitivity within a desired wavelength range, it is preferred that the dye chromophore of the second et seq. layers also form a J-association product.

The meanings of terminologies employed in the present invention are set forth below.

Dye-occupied area: Area occupied by each molecule of dye, which can experimentally be determined from adsorption isothermal lines. With respect to dyes having dye chromophores connected to each other by covalent bonds, the dye-occupied area of unconnected individual dyes can be employed as the basis.

One-layer saturated coating amount: Dye adsorption amount per grain surface area at one-layer saturated coating, which is the inverse number of the smallest dye-occupied area exhibited by added dyes.

Multi-layer adsorption: In such a state that the adsorption amount of dye chromophore per grain surface area is greater than the one-layer saturated coating amount.

Number of adsorption layers: Adsorption amount of dye chromophore per grain surface area on the basis of one-layer saturated coating amount.

The first preferable method for realizing silver halide grains of less than 500 nm spectral absorption maximum wavelength and 60 or more light absorption intensity, or 500 nm or more spectral absorption maximum wavelength and 100 or more light absorption intensity, is any of those using the following specified dyes.

For example, there can preferably be employed the method of using a dye having an aromatic group, or using a cationic dye having an aromatic group and an anionic dye having an aromatic group in combination as described in JP-A's 10-239789, 8-269009, 10-123650 and 8-328189, the method of using a dye of polyvalent charge as described in JP-A-10-171058, the method of using a dye having a pyridinium group as described in JP-A-10-104774, the method of using a dye having a hydrophobic group as described in JP-A-10-186559, and the method of using a dye having a coordination bond group as described in JP-A-10-197980.

The method of using a dye having at least one aromatic group is most preferred. In particular, the method wherein a positively charged dye, or a dye having intra-molecularly offset charges, or a dye having no charges is used alone, and the method wherein positively and negatively charged dyes are used in combination, at least one thereof having at least one aromatic group as a substituent, are preferred.

The aromatic group will now be described in detail. The aromatic group may be a hydrocarbon aromatic group or a heteroaromatic group. Further, the aromatic group may be a group having the structure of a polycyclic condensed ring resulting from mutual condensation of hydrocarbon aromatic rings or mutual condensation of heteroaromatic rings, or a polycyclic condensed ring consisting of a combination of an aromatic hydrocarbon ring and an aromatic heterocycle. The aromatic group may have a substituent. Examples of preferred aromatic rings contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiin, phenothiazine and phenazine. The above hydrocarbon aromatic rings are more preferred. Benzene and naphthalene are most preferred. Benzene is optimal.

For example, any of those aforementioned as examples of dye chromophores can be used as the dye. The dyes aforementioned as examples of polymethine dye chromophores can preferably be employed.

More preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. Still more preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimal.

The following methods of using a dye (a) and (b) are preferred. Of them, the method (b) is more preferred.

(a) The method comprises using at least one of cationic, betaine and nonionic methine dyes.

(b) The method comprises using at least one cationic methine dye and at least one anionic methine dye in combination.

Although the cationic dye for use in the present invention is not particularly limited as long as the charges of dye exclusive of counter ions are cationic, it is preferred that the cationic dye be a dye having no anionic substituents. Further, although the anionic dye for use in the present invention is not particularly limited as long as the charges of dye exclusive of counter ions are anionic, it is preferred that the anionic dye be a dye having at least one anionic substituent. The betaine dye for use in the present invention is a dye which, al though having charges in its molecule, forms such an intra-molecular salt that the molecule as a whole has no charges. The nonionic dye for use in the present invention is a dye having no charges at all in its molecule.

The anionic substituent refers to a substituent having a negative charge, and can be, for example, a proton-dissociable acid group, at least 90% of which is dissociated at a pH of 5 to 8. Examples of suitable anionic substituents include a sulfo group, a carboxyl group, a sulfato group, a phosphoric acid group, a boric acid group, an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl). A sulfo group and a carboxyl group are preferably employed, and a sulfo group is more preferably employed. As the cationic substituent, there can be mentioned, for example, a substituted or unsubstituted ammonium group and pyridinium group.

Although silver halide grains of less than 500 nm spectral absorption maximum wavelength and 60 or more light absorption intensity, or 500 nm or more spectral absorption maximum wavelength and 100 or more light absorption intensity, can be realized by the above preferred method, the dye of the second layer is generally adsorbed in the form of a monomer, so that most often the absorption width and spectral sensitivity width are larger than those desired. Therefore, for realizing a high sensitivity within a desired wavelength region, it is requisite that the dye adsorbed into the second layer form a J-association product. Further, the J-association product is preferred from the viewpoint of transmitting light energy absorbed by the dye of the second layer to the dye of the first layer with a proximate light absorption wavelength by the energy transfer of the Föster type, because of the high fluorescent yield and slight Stokes shift exhibited thereby.

For forming the J-association product of the dye of the second layer from a cationic dye, a betaine dye, a nonionic dye or an anionic dye, it is preferred that the addition of dye adsorbed as the first layer be separated from the addition of dye adsorbed in the formation of the second et seq. layers, and it is more preferred that the structure of the dye of the first layer be different from that of the dye of the second et seq. layers. With respect to the dye of the second et seq. layers, it is preferred that a cationic dye, a betaine dye and a nonionic dye be added individually, or a cationic dye and an anionic dye be added in combination.

The dye of the first layer, although not particularly limited, preferably consists of a cationic dye, a betaine dye, a nonionic dye or an anionic dye, more preferably a cationic dye, a betaine dye or a nonionic dye. In the second layer, it is preferred that a cationic dye, a betaine dye or a nonionic dye be used alone. When a cationic dye and an anionic dye are used in combination, which is also a preferred use in the second layer, the ratio of cationic dye to anionic dye in the dye of the second layer is preferably in the range of 0.5 to 2, more preferably 0.75 to 1.33, and most preferably 0.9 to 1.11. It is preferred that the structure of the sensitizing dye of the second layer be different from that of the sensitizing dye of the first layer, and that the sensitizing dye of the second layer contain both a cationic dye and an anionic dye.

The second preferable method for realizing silver halide grains of less than 500 nm spectral absorption maximum wavelength and 60 or more light absorption intensity, or 500 nm or more spectral absorption maximum wavelength and 100 or more light absorption intensity, comprises utilizing a dye compound (linked dye) having two or more dye chromophore portions linked to each other by a covalent bond through a linking group.

The usable dye chromophore is not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Most preferred are a cyanine dye, a rhodacyanine dye and a merocyanine dye. A cyanine dye is optimal.

The linking group refers to a single bond or, preferably, a divalent substituent. This linking group preferably consists of an atom or atomic group including at least one member selected from among a carbon atom, a nitrogen atom, a sulfur atom and an oxygen atom. Also, the linking group preferably includes a divalent substituent having 0 to 100 carbon atoms, more preferably 1 to 20 carbon atoms, constituted of one member or a combination of at least two members selected from among an alkylene group (e.g., methylene, ethylene, propylene, butylene or pentylene), an arylene group (e.g., phenylene or naphthylene), an alkenylene group (e.g., ethenylene or propenylene), an alkynylene group (e.g., ethynylene or propynylene), an amido group, an ester group, a sulfoamido group, a sulfonic ester group, a ureido group, a sulfonyl group, a sulfinyl group, a thioether group, an ether group, a carbonyl group, —N(Va)— (Va represents a hydrogen atom or a monovalent substituent) and a heterocyclic divalent group (e.g., 6-chloro-1,3,5-triazine-2,4-diyl group, pyrimidine-2,4-diyl group or quinoxarine-2,3-diyl group). The linking group may further have a substituent, and may contain an aromatic ring or a nonaromatic hydrocarbon ring or heterocycle. As especially preferred linking groups, there can be mentioned alkylene groups each having 1 to 10 carbon atoms (e.g., methylene, ethylene, propylene and butylene), arylene groups each having 6 to 10 carbon atoms (e.g., phenylene and naphthylene), alkenylene groups each having 2 to 10 carbon atoms (e.g., ethenylene and propenylene), alkynylene groups each having 2 to 10 carbon atoms (e.g., ethynylene and propynylene), and divalent substituents each comprising one member or a combination of two or more members selected from among an ether group, an amido group, an ester group, a sulfoamido group and a sulfonic ester group and having 1 to 10 carbon atoms.

The linking group is preferably one capable of energy transfering or electron moving by through-bond interaction. The through-bond interaction includes, for example, tunnel interaction and super-exchange interaction. Especially, the through-bond interaction based on super-exchange interaction is preferred. The through-bond interaction and super-exchange interaction are as defined in Shammai Speiser, Chem. Rev., vol. 96, pp. 1960–1963, 1996. As the linking group capable of inducing an energy transfer or electron moving by such an interaction, there can preferably be employed those described in Shammai Speiser, Chem. Rev., vol. 96, pp. 1967–1969, 1996.

Preferred examples thereof include the method of using dyes linked to each other by methine chains as described in JP-A-9-265144, the method of using a dye comprising oxonol dyes linked to each other as described in JP-A-10-226758, the method of using linked dyes of specified structure as described in JP-A's 10-110107, 10-307358, 10-307359, 10-310715 and 10-204306, the method of using linked dyes of specified structure as described in JP-A's 2000-231174, 2000-231172 and 2000-231173, and the method of using a dye having a reactive group to thereby form a linked dye in the emulsion as described in JP-A-2000-81678.

Examples of especially preferably employed dyes will be listed below, to which, however, the present invention is in no way limited.

(I) Examples of cationic dyes and betaine dyes:

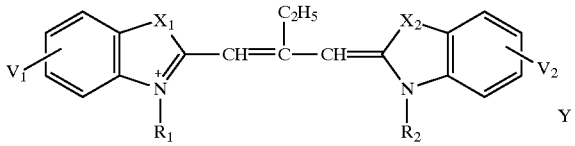
| | $X_1$ | $X_2$ | $V_1$ | $V_2$ | $R_1$ | $R_2$ | Y |
|---|---|---|---|---|---|---|---|
| D-1 | O | O | 5-Ph | 5'-Ph | 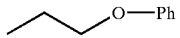 | 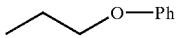 | 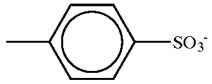 |
| D-2 | O | O | 5-Ph | 5'-Ph | 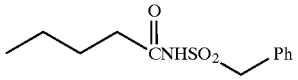 | 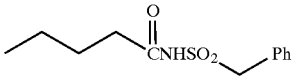 | $Br^-$ |
| D-3 | O | S | 5-Ph | 5'-Ph | 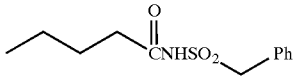 | 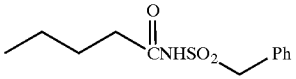 | 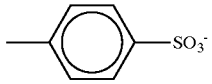 |
| D-4 | O | S | 5-Ph | 5'-Ph | 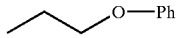 | 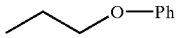 | $Br^-$ |
| D-5 | O | O | 4,5-Benzo | 4',5'-Benzo | 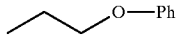 | 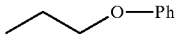 | 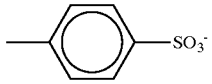 |
| D-6 | O | O | 5,6-Benzo | 5',6'-Benzo | 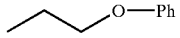 | 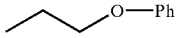 | 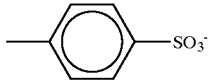 |
| D-7 | O | O | 5,6-Benzo | 5',6'-Benzo | 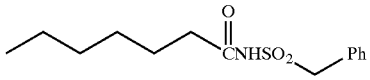 | 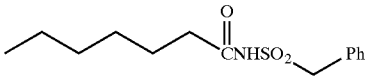 | 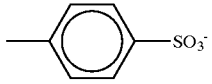 |
| D-8 | O | O | 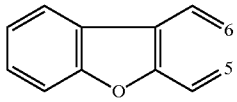 | 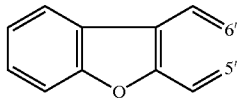 | 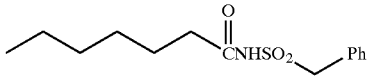 | 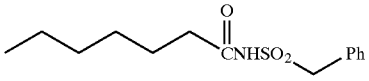 | 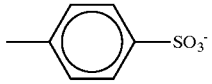 |

-continued
| | $X_1$ | $X_2$ | $V_1$ | $V_2$ | $R_1$ | $R_2$ | Y |
|---|---|---|---|---|---|---|---|
| D-9 | O | O | 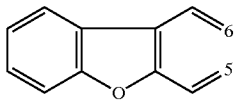 | 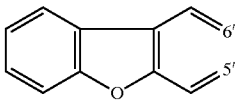 | 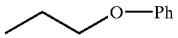 | 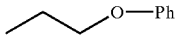 | 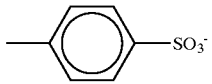 |
| D-10 | O | O | 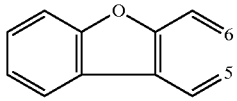 | 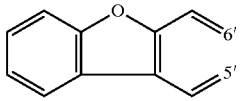 | 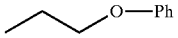 | 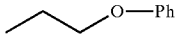 | 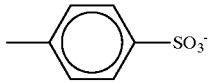 |
| D-11 | S | S | 5-Ph | 5'-Ph | 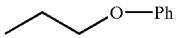 | 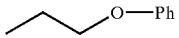 | 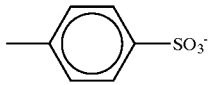 |
| D-12 | S | S | 5-Cl | 5'-Cl | 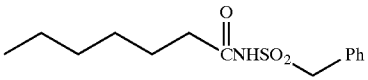 | 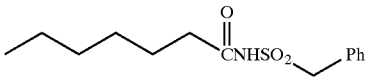 | 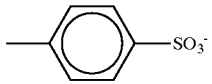 |
| D-13 | S | S | 5,6-Benzo | 5',6'-Benzo | 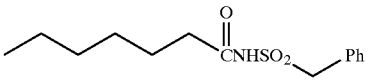 | 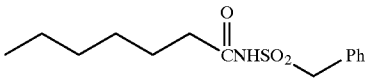 | 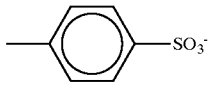 |
| | | | | | 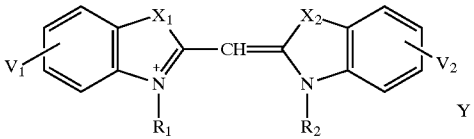 | | |
| D-14 | S | S | 5-Ph | 5'-Ph | 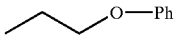 | 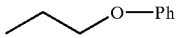 | 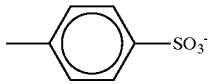 |
| D-15 | S | S | 5-Ph | 5'-Ph | 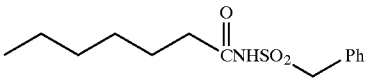 | 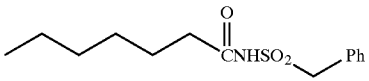 | 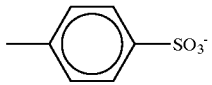 |

-continued
| | $X_1$ | $X_2$ | $V_1$ | $V_2$ | $R_1$ | $R_2$ | Y |
|---|---|---|---|---|---|---|---|
| D-16 | S | S | 5,6-benzo | 5',6'-Benzo | 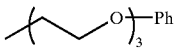 | 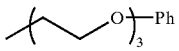 | 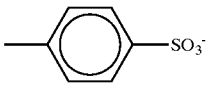 |
| D-17 | S | O | 5,6-Benzo | 5',6'-Benzo | 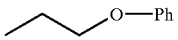 | 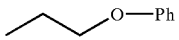 | 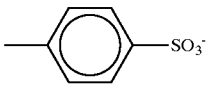 |
| D-18 | O | O | 5,6-Benzo | 5',6'-Benzo | 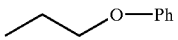 | 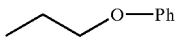 | 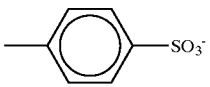 |
| D-19 | S | S | 5,6-Benzo | 5',6'-Benzo | 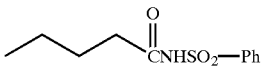 | 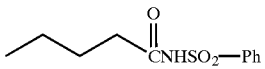 | 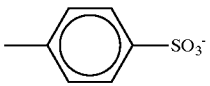 |
| D-20 | S | S | 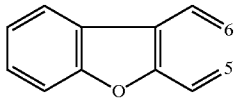 | 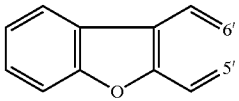 | 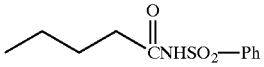 | 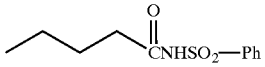 | 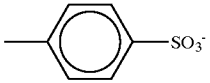 |

(II) Examples of anionic dyes:

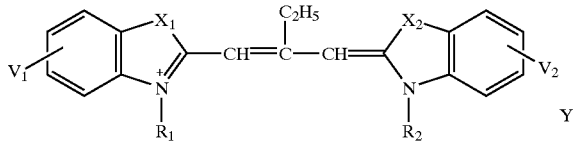

| | $X_1$ | $X_2$ | $V_1$ | $V_2$ | $R_1$ | $R_2$ | Y |
|---|---|---|---|---|---|---|---|
| D-21 | O | O | 5-Ph | 5'-Ph | $SO_3^-$ | $SO_3^-$ | $Na^+$ |
| D-22 | O | O | 5-Ph | 5'-Ph | Ph, $SO_3^-$ | Ph, $SO_3^-$ | $Na^+$ |
| D-23 | O | S | 5-Ph | 5'-Ph | Ph, $SO_3^-$ | Ph, $SO_3^-$ | $\overset{+}{H}N(C_2H_5)_3$ |
| D-24 | S | S | 5-Ph | 5'-Ph | Ph, $SO_3^-$ | Ph, $SO_3^-$ | $\overset{+}{H}N(C_2H_5)_3$ |
| D-25 | S | S | 5-Ph | 5'-Ph | $SO_3^-$ | $SO_3^-$ | $\overset{+}{H}N(C_2H_5)_3$ |
| D-26 | O | O | 5,6-Benzo | 5',6'-Benzo | $SO_3^-$ | $SO_3^-$ | $\overset{+}{H}N(C_2H_5)_3$ |
| D-27 | O | O | 4,5-Benzo | 5',6'-Benzo | $SO_3^-$ | $SO_3^-$ | $\overset{+}{H}N(C_2H_5)_3$ |
| D-28 | O | O | 5,6-Benzo | 5',6'-Benzo | Ph, $SO_3^-$ | Ph, $SO_3^-$ | $\overset{+}{H}N(C_2H_5)_3$ |
| D-29 | O | O | 6, 5, O | 6', 5', O | $SO_3^-$ | $SO_3^-$ | $\overset{+}{H}N(C_2H_5)_3$ |
| D-30 | S | S | 5-Cl | 5'-Cl | $SO_3^-$ | $SO_3^-$ | $\overset{+}{H}N(C_2H_5)_3$ |

-continued

| | $X_1$ | $X_2$ | $V_1$ | $V_2$ | $R_1$ | $R_2$ | Y |
|---|---|---|---|---|---|---|---|
| | | | | 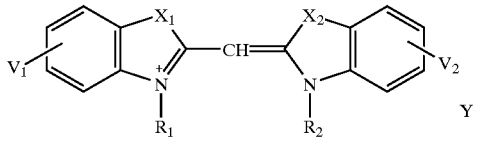 | | | |
| D-31 | S | S | 5-Ph | 5'-Ph | 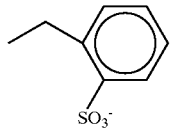 | 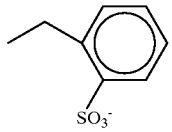 | $Na^+$ |
| D-32 | S | S | 5,6-Benzo | 5',6'-Benzo | 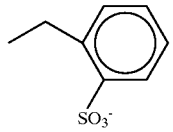 | 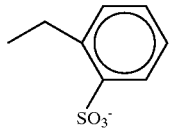 | $Na^+$ |
| D-33 | S | O | 5,6-Benzo | 5',6'-Benzo | 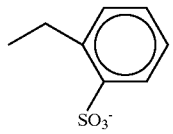 | 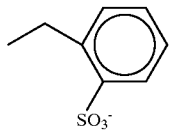 | $Na^+$ |
| D-34 | O | O | 5,6-Benzo | 5',6'-Benzo | 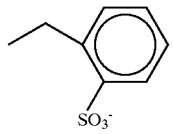 | 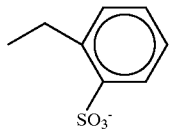 | $Na^+$ |
| D-35 | S | O | 5,6-Benzo | 5'-Ph | 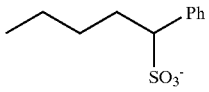 | 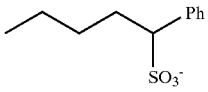 | $Na^+$ |

(III) Examples of linked dyes:

D-36

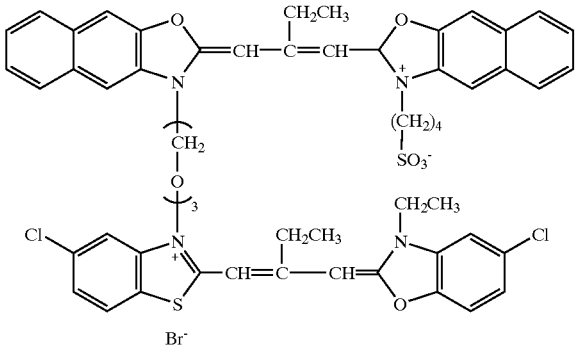

The dyes for use in the present invention can be synthesized by the methods described in, for example, F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, section 14, pages 482 to 515, John Wiley & Sons, New York, London, 1977, and Rodd's Chemistry of Carbon Compounds, 2nd. Ed. vol. IV, part B, 1977, chapter 15, pages 369 to 422, Elsevier Science Publishing Company Inc., New York.

The emulsion of the present invention and other photographic emulsions for use in combination therewith will be described below.

These can be selected from among silver halide emulsions prepared by the methods described in, e.g., U.S. Pat. No. 4,500,626, column 50; U.S. Pat. No. 4,628,021; Research Disclosure (to be abbreviated as RD hereafter) No. 17,029 (1978); RD No, 17,643 (December, 1978), pp. 22 and 23; RD No. 18,716 (November, 1979), page 648; RD No. 307,105 (November, 1989), pp. 863 to 865; JP-A's 62-253159, 64-13546, 2-236546 and 3-110555; P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

In the process of preparing the lightsensitive silver halide emulsion according to the present invention, it is preferred to effect removing of excess salts, known as desalting. As means therefor, use can be made of the noodle washing method to be performed after gelation of gelatin, or the precipitation method using an inorganic salt comprising a polyvalent anion (e.g., sodium sulfate), an anionic surfactant, an anionic polymer (e.g., sodium polystyrenesulfonate) or a gelatin derivative (e.g., aliphatic acylated gelatin, aromatic acylated gelatin or aromatic carbamoylated gelatin). The precipitation method is preferred.

The lightsensitive silver halide emulsion for use in the present invention may be loaded with any of heavy metals such as iridium, rhodium, platinum, cadmium, zinc, thallium, lead, iron and osmium for various purposes. These may be used individually or in combination. The loading amount, although depending on the intended use, is generally in the range of about $10^{-9}$ to $10^{-3}$ mol per mol of silver halide. In the loading, the grains may be uniformly loaded with such metals, or the metals may be localized at internal regions or surfaces of the grains. For example, the emulsions described in JP-A's 2-236542, 1-116637 and 5-181246 can preferably be employed.

In the stage of grain formation with respect to the lightsensitive silver halide emulsion of the present invention, for example, a rhodanate, ammonia, a tetra-substituted thiourea compound, an organic thioether derivative described in Jpn. Pat. Appln. KOKOKU Publication No. (hereinafter referred to as JP-B-) 47-11386 or a sulfur-containing compound described in JP-A-53-144319 can be used as a silver halide solvent.

With respect to other conditions, reference can be made to descriptions of, for example, the aforementioned P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. Specifically, use can be made of any of the acid method, the neutral method and the ammonia method. The reaction of a soluble silver salt with a soluble halide can be accomplished by any of the one-side mixing method, the simultaneous mixing method and a combination thereof. The simultaneous mixing method is preferably employed for obtaining a monodisperse emulsion.

The reverse mixing method wherein grains are formed in excess silver ions can also be employed. The method wherein the pAg of liquid phase in which a silver halide is formed is held constant, known as the controlled double jet method, can be employed as one mode of simultaneous mixing method.

In order to accelerate the grain growth, the addition concentration, addition amount and addition rate of a silver salt and a halide to be added may be increased (see, for example, JP-A's 55-142329 and 55-158124 and U.S. Pat. No. 3,650,757).

Any of known agitation methods can be employed in the agitation of the reaction mixture. Although the temperature and pH of reaction mixture during the formation of silver halide grains may be freely selected in conformity with the purpose, the pH is preferably in the range of 2.2 to 7.0, more preferably 2.5 to 6.0.

The lightsensitive silver halide emulsion generally consists of a chemically sensitized silver halide emulsion. In the chemical sensitization of lightsensitive silver halide emulsion according to the present invention, use can be made of the chalcogen sensitization methods such as sulfur sensitization, selenium sensitization and tellurium sensitization methods, which are common for conventional lightsensitive material emulsions, the noble metal sensitization method using gold, platinum, palladium or the like and the reduction sensitization method individually or in combination (see, for example, JP-A's 3-110555 and 5-241267). These chemical sensitizations can be performed in the presence of a nitrogen-containg heterocyclic compound (see JP-A-62-253159). Further, antifoggants listed later can be added after the completion of chemical sensitization. For example, use can be made of t he methods of JP-A's 5-45833 and 62-40446.

During the chemical sensitization, the pH is preferably in the range of 5.3 to 10.5, more preferably 5.5 to 8.5. The pAg is preferably in the range of 6.0 to 10.5, more preferably 6.8 to 9.0.

The coating amount of lightsensitive silver halide for use in the present invention is in the range of 1 $mg/m^2$ to 10 $g/m^2$ in terms of silver.

In order to provide the lightsensitive silver halide for use in the present invention with color sensitivity, such as green sensitivity or red sensitivity, spectral sensitization of the lightsensitive silver halide emulsion is effected by a methine dye or the like. According to necessity, spectral sensitization in the blue region may be effected for a blue-sensitive emulsion.

Useful dyes include a cyanine dye, a merocyanine dye, a complex cyanine dye, a complex merocyanine dye, a holopolar cyanine dye, a hemicyanine dye, a styryl dye and a hemioxonol dye.

For example, use can be made of sensitizing dyes described in U.S. Pat. No. 4,617,257 and JP-A's 59-180550, 64-13546, 5-45828 and 5-45834.

These sensitizing dyes may be used individually or in combination. The use of sensitizing dyes in combination is often employed for the purpose of attaining supersensitization or wavelength regulation of spectral sensitization.

The emulsion of the present invention may be loaded with a dye which itself exerts no spectral sensitizing effect or a compound which absorbs substantially none of visible radiation and exhibits supersensitization, together with the above sensitizing dye (for example, those described in U.S. Pat. No. 3,615,641 and JP-A-63-23145).

With respect to the timing of loading the emulsion with the above sensitizing dye, the loading may be effected during chemical ripening, or before or after the same. Also, the loading may be performed before or after nucleation of silver halide grains as described in U.S. Pat. Nos. 4,183,756 and 4,225,666. The sensitizing dye and supersensitizing agent can be added in the form of a solution in an organic solvent such as methanol, a dispersion in gelatin or the like, or a solution containing a surfactant. The loading amount thereof is generally in the range-of about $10^{-8}$ to $10^{-2}$ mol per mol of silver halide.

The additives useful in the above process and known photographic additives for use in the present invention are described in the aforementioned RD Nos. 17643, 18716 and 307105. The locations where they are described will be listed below.

| | Types of additives | RD17643 | RD18716 | RD307105 |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super-sensitizers | pages 23–24 | page 648, right column to page 649, right column | pages 866–868 |
| 4. | Brighteners | page 24 | page 648, right column | page 868 |
| 5. | Antifoggants, stabilizers | pages 24–25 | page 649 right column | pages 868–870 |
| 6. | Light absorbents, filter dyes, ultraviolet absorbents | pages 25–26 | page 649, right column to page 650, left column | page 873 |
| 7. | Dye image stabilizers | page 25 | page 650, left column | page 872 |

-continued

| | Types of additives | RD17643 | RD18716 | RD307105 |
|---|---|---|---|---|
| 8. | Film hardeners | page 26 | page 651, left column | pages 874–875 |
| 9. | Binders | page 26 | page 651, left column | pages 873–874 |
| 10. | Plasticizers, lubricants | page 27 | page 650, right column | page 876 |
| 11. | Coating aids, surfactants | pages 26–27 | page 650, right column | pages 875–876 |
| 12. | Antistatic agents | page 27 | page 650, right column | pages 876–877 |
| 13. | Matting agents | | | pages 878–879. |

In the present invention, it is preferred that an organometallic salt be used as an oxidizer in combination with the lightsensitive silver halide emulsion. Among organometallic salts, an organosilver salt is especially preferably employed.

As the organic compound which can be used for preparing the above organosilver salt oxidizer, there can be mentioned such benzotriazoles, fatty acids and other compounds as described in, for example, U.S. Pat. No. 4,500,626, columns 52 to 53, the disclosue of which is incorporated herein by reference. Further, silver acetylide described in U.S. Pat. No. 4,775,613, the disclosue of which is incorporated herein by reference, is useful. Two or more organosilver salts may be used in combination.

Preferred particular examples of organosilver salts for use in the present invention are set forth in JP-A-1-100177, which are silver salts obtained by reacting at least one member selected from among the compounds of the following general formulae (I), (II) and (III) with a silver ion supplier such as silver nitrate.

(I)

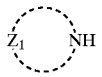

(II)

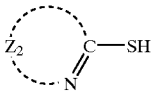

(III)

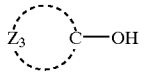

In the formulae, each of $Z_1$, $Z_2$ and $Z_3$ independently represents an atomic group required for forming a 5 to 9-membered heterocycle, which heterocycle includes a monocycle and a condenced polycycle. Herein, the heterocycle comprehends a product of condensation with a benzene ring or naphthalene ring.

The compound for use in the production of the organosilver salt in the present invention will be described in detail below. In the general formula (I), $Z_1$ represents an atomic group required for forming a 5 to 9-membered (especially, 5-, 6- or 9-membered) heterocycle. As the heterocycle completed by $Z_1$ of the general formula (I), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_1$ may have a substituent. As the substitiuents those generally known as a substituent capable of substituting to a heterocycle or a benzen ring may be enumerated.

Examples of such compounds include benzotriazoles, benzotriazoles described in, for example, JP-A-58-118638 and JP-A-58-118639, benzimidazoles, pyrazoloazoles described in JP-A-62–96940 {for example, 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles}, triazoles, 1H-tetrazoles, carbazoles, saccharins, imidazoles and 6-aminopurines.

Among the compounds of the general formula (I), the compounds of the following general formula (I-1) are preferred.

(I-1)

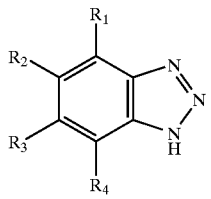

In the formula, each of $R_1$, $R_2$, $R_3$ and $R_4$ independently represents a hydrogen atom, a halogen atom, an alkyl group, an aralkyl group, an alkenyl group, an alkoxy group, an aryl group, a hydroxy group, a sulfo group or a salt thereof (for example, sodium salt, potassium salt or ammonium salt), a carboxy group or a salt thereof (for example, sodium salt, potassium salt or ammonium salt), —CN, —$NO_2$, —NRR', —COOR, —CONRR', —$NHSO_2R$ or —$SO_2NRR'$ (provided that each of R and R' represents a hydrogen atom, an alkyl group, an aryl group or an aralkyl group).

Examples of the compounds of the general formula (I) include benzotriazole, 4-hydroxybenzotriazole, 5-hydroxybenzotriazole, 4-sulfobenzotriazole, 5-sulfobenzotriazole, sodium benzotriazole-4-sulfonate, sodium benzotriazole-5-sulfonate, potassium benzotriazole-4-sulfonate, potassium benzotriazole-5-sulfonate, ammonium benzotriazole-4-sulfonate, ammonium benzotriazole-5-sulfonate, 4-carboxybenzotriazole, 5-carboxybenzotriazole, 4-sulfo-5-benzenesulfonamidobenzotriazole, 4-sulfo-5-hydroxycarbonylmethoxybenzotriazole, 4-sulfo-5-ethoxycarbonylmethoxybenzotriazole, 4-hydroxy-5-carboxybenzotriazole, 4-sulfo-5-carboxymethylbenzotriazole, 4-sulfo-5-ethoxycarbonylmethylbenzotriazole, 4-sulfo-5-phenylbenzotriazole, 4-sulfo-5-(p-nitrophenyl)benzotriazole, 4-sulfo-5-(p-sulfophenyl)benzotriazole, 4-sulfo-5-methoxy-6-chlorobenzotriazole, 4-sulfo-5-chloro-6-carboxybenzotriazole, 4-carboxy-5-chlorobenzotriazole, 4-carboxy-5-methylbenzotriazole, 4-carboxy-5-nitrobenzotriazole, 4-carboxy-5-aminobenzotriazole, 4-carboxy-5-methoxybenzotriazole, 4-hydroxy-5-aminobenzotriazole, 4-hydroxy-5-acetamidobenzotriazole, 4-hydroxy-5-benzenesulfonamidobenzotriazole, 4-hydroxy-5-hydroxycarbonylmethoxybenzotriazole, 4-hydroxy-5-ethoxycarbonylmethoxybenzotriazole, 4-hydroxy-5-carboxymethylbenzotriazole, 4-hydroxy-5-ethoxycarbonylmethylbenzotriazole, 4-hydroxy-5-phenylbenzotriazole, 4-hydroxy-5-(p-nitrophenyl)benzotriazole, 4-hydroxy-5-(p-sulfophenyl )benzotriazole, 4-sulfo-5-chlorobenzotriazole, 4-sulfo-5-methylbenzotriazole, 4-sulfo-5-methoxybenzotriazole, 4-sulfo-5-cyanobenzotriazole, 4-sulfo-5-aminobenzotriazole, 4-sulfo-5-acetoamidobenzotriazole, sodium benzotriazole-4-caroboxylate, sodium benzotriazole-5-caroboxylate, potassium benzotriazole-4-caroboxylate, potassium benzotriazole-5-caroboxylate, ammonium benzotriazole-4-caroboxylate, ammonium benzotriazole-5-caroboxylate, 5-carbamoylbenzotriazole, 4-sulfamoylbenzotriazole, 5-carboxy-6-hydroxybenzotriazole, 5-carboxy-7-sulfobenzotriazole, 4-hydroxy-5-sulfobenzotriazole, 4-hydroxy-7-sulfobenzotriazole, 5,6-dicarboxybenzotriazole, 4,6-dihydroxybenzotriazole, 4-hydroxy-5-chlorobenzotriazole, 4-hydroxy-5-methylbenzotriazole, 4-hydroxy-5-methoxybenzotriazole, 4-hydroxy-5-nitrobenzotriazole, 4-hydroxy-5-cyanobenzotriazole, 4-carboxy-5-acetamidobenzotriazole, 4-carboxy-5-ethoxycarbonylmethoxybenzotriazole, 4-carboxy-5-carboxymethylbenzotriazole, 4-carboxy-5-phenylbenzotriazole, 4-carboxy-5-(p-nitrophenyl)benzotriazole, 4-carboxy-5-methyl-7-sulfobenzotriazole, imidazole, benzimidazole, pyrazole, urazole, 6-aminopurine,

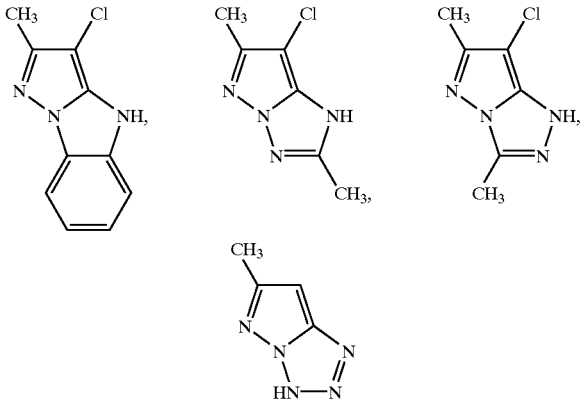

These may be used in combination.

The compounds represented by the general formula (II) will now be described. In the general formula (II), $Z_2$ represents an atomic group required for forming a 5 to 9-membered (especially, 5-, 6- or 9-membered) heterocycle, which heterocycle includes a monocycle and a condenced polyheterocycle. As the heterocycle completed by $Z_2$ of the above general formula (including C and N of the formula), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_2$ may have a substituent. As the substitiuents those generally known as a substituent capable of substituting to a heterocycle or a benzen ring may be enumerated.

Examples of such compounds include 2-mercaptobenzothiazoles, 2-mercaptobenzimidazoles, 2-mercaptothiadiazoles and 5-mercaptotetrazoles.

Particular examples of the compounds represented by the above general formula (II) include the following compounds, to which, however, the present invention is in no way limited.

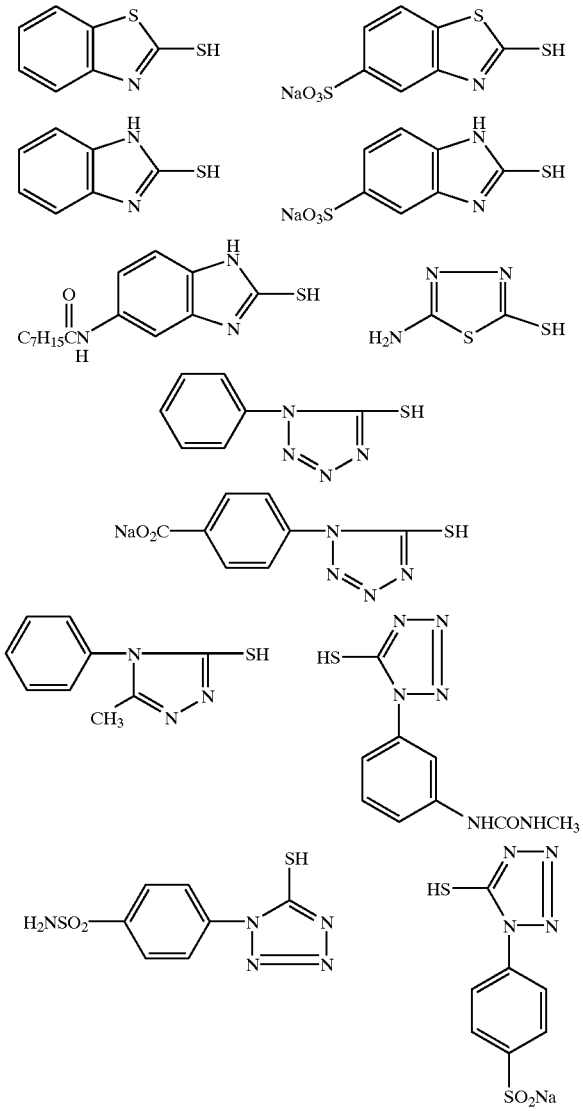

The compounds represented by the general formula (III) will be described below. In the general formula (III), $Z_3$ represents an atomic group required for forming a 5 to 9-membered (especially, 5-, 6- or 9-membered) heterocycle. As the heterocycle completed by $Z_3$ of the above general formula, a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring, or naphthalene ring, or nitrogen-containing heterocycle having various substituents.

Examples of such compounds include hydroxytetrazaindenes, hydroxypyrimidines, hydroxypyridazines an hydroxypyrazines.

Particular examples of the compounds represented by the above general formula (III) include the following compounds, to which, however, the present invention is in no way limited.

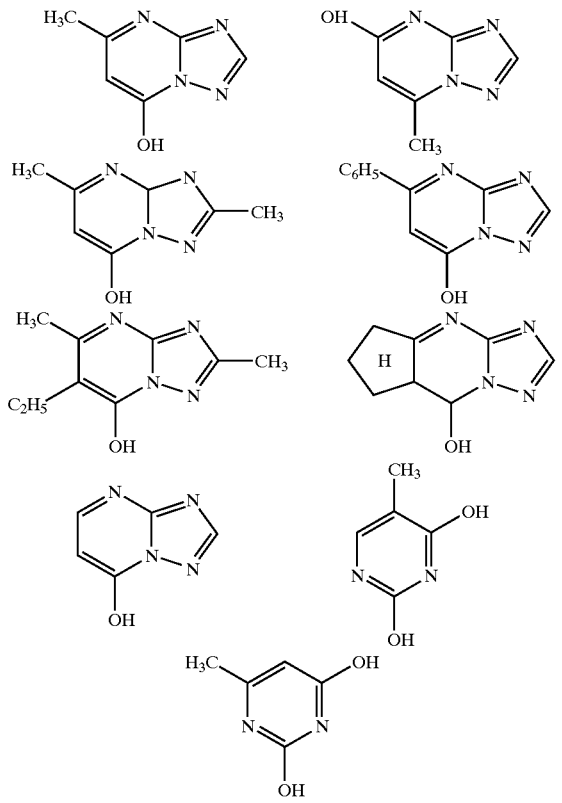

Among the compounds represented by the gereral formula (I), (II) and (III), the compounds represented by formula (I) is preferable In the present invention, any of the compounds of the general formulae (I), (II) and (III) is mixed with silver nitrate in an appropriate reaction medium to thereby form a silver salt of the compound (hereinafter referred to as "organosilver salt"). Part of the silver nitrate can be replaced by another silver ion supplier (for example, silver chloride or silver acetate).

The method of adding such reactants is arbitrary. A compound of the general formula (I) to (III) may first be placed in a reaction vessel and thereafter loaded with silver nitrate. Alternatively, silver nitrate may first be placed in a reaction vessel and thereafter loaded with a compound of the general formula (I) to (III). Still alternatively, part of a compound of the general formula (I) to (III) may first be placed in a reaction vessel, subsequently loaded with part of silver nitrate, and thereafter sequentially loaded with the remainders of compound of the general formula (I) to (III) and silver nitrate. Still alternatively, silver nitrate and a compound of the general formula (I) to (III) may be simultaneously placed in a reaction vessel. During the reaction, it is preferred to effect agitation.

Although the compound of the general formula (I) to (III) is generally mixed with silver nitrate at a proportion of 0.8 to 100 mol per mol of silver, the reactants can be used outside this proportion, depending on the type of the compound. The addition rates of silver nitrate and the compound may be regulated so as to control the silver ion concentration during the reaction.

The layer to be loaded with the organosilver salt is not limited, and the organosilver salt may be incorporated in one layer or a plurality of layers. Incorporating the organosilver salt in a layer containing no lightsensitive silver halide emulsion in the hydrophilic colloid layers provided on the side having silver halide emulsion layers, such as a protective layer, an interlayer or a so-called substratum disposed between a support and an emulsion layer, is preferred from the viewpoint of storage life improvement.

This organosilver salt can be jointly used in an amount of 0.01 to 10 mol, preferably 0.05 to 1 mol, per mol of lightsensitive silver halide that is contained in the layer to which the organosilver salt is added. It is appropriate for the coating amount total of lightsensitive silver halide and organosilver salt to be in the range of 0.01 to 10 $g/m^2$, preferably 0.1 to 4 $g/m^2$, in terms of silver. In the present invention, an organometallic salt can be used as an oxidizer in combination with the lightsensitive silver halide. Among organometallic salts, the organosilver salt is especially preferably employed.

As the organic compound which can be used for preparing the above organosilver salt oxidizer, there can be mentioned such benzotriazoles, fatty acids and other compounds as described in, for example, U.S. Pat. No. 4,500,626, columns 52 to 53. Further, silver acetylide described in U.S. Pat. No. 4,775,613 is useful. Two or more organosilver salts may be used in combination.

Hydrophilic binders are preferably employed in the lightsensitive material and constituent layers thereof. Examples of such hydrophilic binders include those described in the aforementioned RDs and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3M$ (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binder mentioned above is preferred. The gelatin can be selected from among lime-processed gelatin, acid-processed gelatin and delimed gelatin which is one having a content of calcium and the like reduced in conformity with variable purposes. These can be used in combination.

Polymer latex is also preferably employed as the binder in the present invention. The polymer latex is a dispersion of a water-insoluble hydrophobic polymer, as fine particles, in a water-soluble dispersion medium. The state of dispersion is not limited, and the polymer latex may be any of a latex comprising a polymer emulsified in a dispersion medium, a product of emulsion polymerization, a micelle dispersion, and a molecular dispersion of molecular chains per se due to the presence of partial hydrophilic structure in polymer molecule. With respect to the polymer latex for use in the present invention, reference can be made to, for example, Gosei Jushi Emulsion (Synthetic Resin Emulsion) edited by Taira Okuda and Hiroshi Inagaki and published by Polymer Publishing Association (1978), Gosei Latex no Oyo (Application of Synthetic Latex) edited by Takaaki Sugimura, Yasuo Kataoka, Soichi Suzuki and Keiji Kasahara and published by Polymer Publishing Association (1993), and Gosei Latex no Kagaku (Chemistry of Synthetic Latex) edited by Soichi Muroi and published by Polymer Publishing Association (1970).

The average particle diameter of dispersed particles is preferably in the range of about 1 to 50,000 nm, more preferably 5 to 1000 nm. The particle diameter distribution of dispersed particles is not particularly limited. The polymer species for use in the polymer latex are, for example, an acrylic resin, a vinyl acetate resin, a polyester resin, a polyurethane resin, a rubber resin, a vinyl chloride resin, a vinylidene chloride resin and a polyolefin resin.

The polymer may be linear, or branched, or crosslinked. The polymer may be a product of polymerization of a single monomer, known as a homopolymer, or a copolymer obtained by polymerization of a plurality of monomers. The copolymer may be a random copolymer, or a block copolymer.

The molecular weight of the polymer is preferably in the range of about 0.5 to 1000 thousand, more preferably 1 to 500 thousand, in terms of number average molecular weight Mn. When the molecular weight is extremely small, the mechanical strength of the lightsensitive layer is unsatisfactory. On the other hand, when the molecular weight is extremely large, the film forming properties are unfavorably deteriorated.

With respect to the polymer of the polymer latex for use in the present invention, the equilibrium water content at 25° C. 60% RH is preferably 2 wt % or less, more preferably 1 wt % or less. The lower limit of the equilibrium water content, although not particularly limited, is preferably 0.01 wt %, more preferably 0.03 wt %. With respect to the definition and measuring method of the equilibrium water content, reference can be made to, for example, "Kobunshi Kogaku Koza 14, Kobunshi Zairyo Shiken Hou (Polymer Engineering Course 14, Polymer Material Testing Method)" edited by the Society of Polymer Science of Japan and published by Chijin Shokan Co., Ltd. Specifically, the equilibrium water content at 25° C. 60% RH can be expressed by the following formula including the mass $W_1$ of polymer humidity-controlled and equilibrated in an atmosphere of 25° C. 60% RH and the mass $W_0$ of polymer absolutely dried at 25° C.:

$$\text{"Equilibrium water content at 25° C. 60% RH"} = \{(W_1 - W_0)/W_0\} \times 100 \text{ (wt \%)}.$$

These polymers are commercially available, and the following polymers can be used in the form of polymer latexes. Examples of acrylic resins include Cevian A-4635, 46583 and 4601 (produced by Daicel Chemical Industries, Ltd.) and Nipol Lx811, 814, 821, 820 and 857 (produced by Nippon Zeon Co., Ltd.). Examples of polyester resins include Finetex ES650, 611, 675 and 850 (produced by Dainippon Ink & Chemicals, Inc.). and WD-size, WMS (produced by Eastman Chemical). Examples of polyurethane resins include Hydran AP10, 20, 30 and 40 (produced by Dainippon Ink & Chemicals, Inc.). Examples of rubber resins include Lacstar 7310K, 3307B, 4700H, 7132C and DS206 (produced by Dainippon Ink & Chemicals, Inc.) and Nipol Lx416, 433, 410, 438C and 2507 (produced by Nippon Zeon Co., Ltd.). Examples of vinyl chloride resins include G351 and G576 (produced by Nippon Zeon Co., Ltd.). Examples of vinylidene chloride resins include L502 and L513 (produced by Asahi Chemical Industry Co., Ltd.). Examples of olefin resins include Chemipearl S120 and SA100 (produced by Mitsui Chemicals, Inc.). These polymers may be used individually in the form of polymer latexes, or a plurality thereof may be blended together before use according to necessity.

It is especially preferred that the polymer latex for use in the present invention consist of a latex of styrene/butadiene copolymer. In the styrene/butadiene copolymer, the weight ratio of styrene monomer units to butadiene monomer units is preferably in the range of 50:50 to 95:5. The ratio of styrene monomer units and butadiene monomer units to the whole copolymer is preferably in the range of 50 to 99% by weight. The preferred range of molecular weight thereof is as aforementioned.

As the latex of styrene/butadiene copolymer preferably employed in the present invention, there can be mentioned, for example, commercially available Lacstar 3307B, 7132C and DS206 and Nipol Lx416 and Lx 433.

In the present invention, it is appropriate for the coating amount of binder to be in the range of 1 to 20 g/m$^2$, preferably 2 to 15 g/m$^2$, and more preferably 3 to 12 g/m$^2$. In the binder, the gelatin content is in the range of 50 to 100%, preferably 70 to 100%.

As the color developing agent, although p-phenylenediamines and p-aminophenols can be used, it is preferred to employ the compounds of the aforementioned general formulae (1) to (5).

The compounds of the general formula (1) are those generally termed "sulfonamidophenols".

In the general formula (1), each of $R_1$ to $R_4$ independently represents a hydrogen atom, a halogen atom (e.g., chloro or bromo), an alkyl group (e.g., methyl, ethyl, isopropyl, n-butyl or t-butyl), an aryl group (e.g., phenyl, tolyl or xylyl), an alkylcarbonamido group (e.g., acetylamino, propionylamino or butyroylamino), an arylcarbonamido group (e.g., benzoylamino), an alkylsulfonamido group (e.g., methanesulfonylamino or ethanesulfonylamino), an arylsulfonamido group (e.g., benzenesulfonylamino or toluenesulfonylamino), an alkoxy group (e.g., methoxy, ethoxy or butoxy), an aryloxy group (e.g., phenoxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl or morpholinylcarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), an arylcarbonyl group (e.g., benzoyl or alkylbenzoyl), or an acyloxy group (e.g., acetyloxy, propionyloxy or butyroyloxy). Among $R_1$ to $R_4$, each of $R_2$ and $R_4$ preferably represents a hydrogen atom, a halogen atom, an alkyl group, an aryl group, an alkylcarbonamido group, an arylcarbonamido group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group or an acyl group. $R_1$ to $R_4$ are preferably such electron attractive substituents that the total of Hammett's constant σp values thereof is 0 or greater. The upper limit of the Hammett's constant σp values thereof is not particularly limited, but 1 or less is preferable.

$R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_5$ has preferably 6 or more carbon atoms, more preferably 15 or more carbon atoms. The upper limit of the number of carbon atoms of $R_5$ is preferably 40.

The compounds of the general formula (2) are those generally termed "sulfonylhydrazines". The compounds of the general formula (4) are those generally termed "carbamoylhydrazines".

In the general formulae (2) and (4), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). Z represents an atomic group forming an aromatic ring, preferably a 5- to 6-membered aromatic ring. When the aromatic ring is a heterocyclic aromatic ring, a heterocycle or a benzen ring may be condenced thereto. The aromatic ring formed by Z must have satisfactory electron withdrawing properties for providing the above compounds with a silver development activity. Accordingly, a nitrogen-containing aromatic ring, or an aromatic ring such as one comprising a benzene ring having electron attractive groups introduced therein, is preferred. As such an aromatic ring, there can be preferably employed, for example, a pyridine ring, a pyrazine ring, a pyrimidine ring, a quinoline ring or a quinoxaline ring.

When Z is a benzene ring, as substituents thereof, there can be mentioned, for example, an alkylsulfonyl group (e.g., methanesulfonyl or ethanesulfonyl), a halogen atom (e.g., chloro or bromo), an alkylcarbamoyl group (e.g., methylcarbamoyl, dimethylcarbamoyl, ethylcarbamoyl, diethylcarbamoyl, dibutylcarbamoyl, piperidylcarbamoyl or morpholynocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), and an arylcarbonyl group (e.g., benzoyl or alkylbenzoyl). These substituents are preferably such electron attractive substituents that the total of Hammett's constant σp values thereof is 0 or greater. The upper limit of the Hammett's constant σp values is not particularly limited, but is preferably 3.8.

The compounds of the general formula (3) are those generally termed "sulfonylhydrazones". The compounds of the general formula (5) are those generally termed "carbamoylhydrazones".

In the general formulae (3) and (5), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_6$ represents a substituted or unsubstituted alkyl group (e.g., methyl or ethyl). X represents any of an oxygen atom, a sulfur atom, a selenium atom and an alkyl-substituted or aryl-substituted tertiary nitrogen atom. Of these, an alkyl-substituted tertiary nitrogen atom is preferred. $R_7$ and $R_8$ each represent a hydrogen atom or a substituent, provided that $R_7$ and $R_8$ may be bonded to each other to thereby form a double bond or a ring. The substituent represented by $R_7$ and $R_8$ are the same as mentioned above for $R_1$ to $R_4$.

Particular examples of the compounds represented by the general formulae (1) to (5) will be set forth below, to which, however, the compounds of the present invention are not limited.

D-1

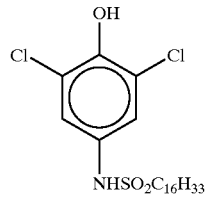

D-2

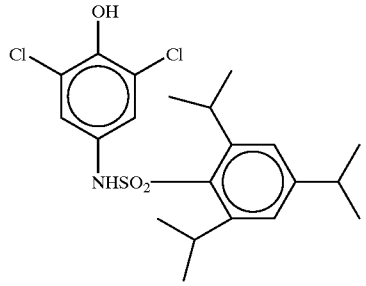

D-3

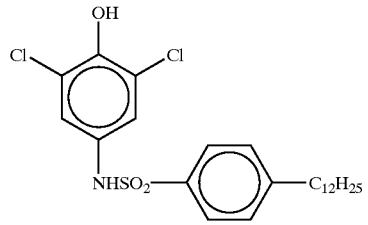

D-4

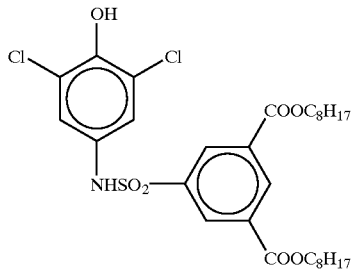

-continued
D-5
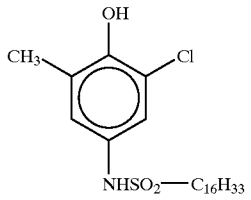
D-6
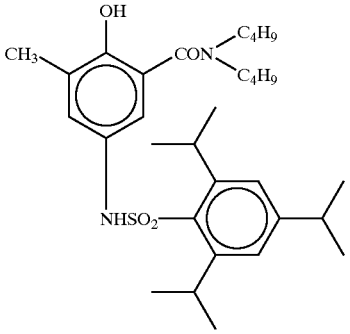
D-7
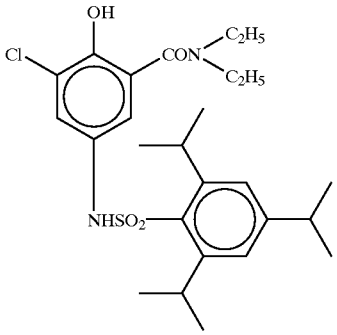
D-8
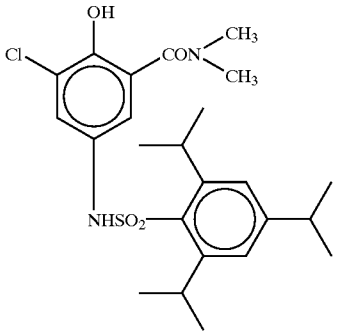
D-9
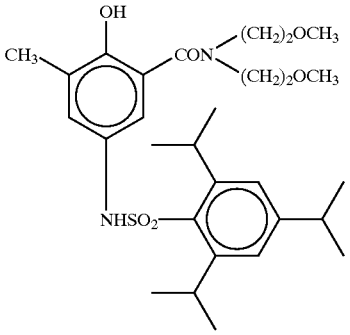
-continued
D-10
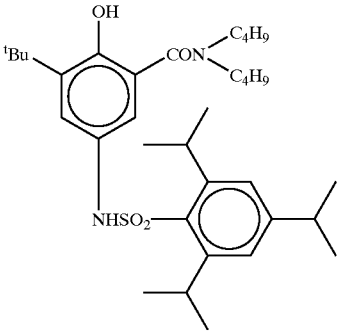
D-11
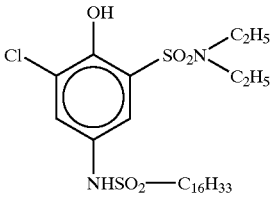
D-12
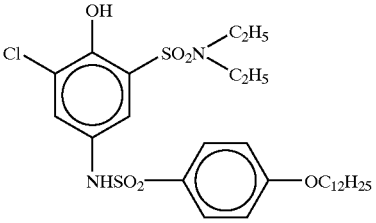
D-13
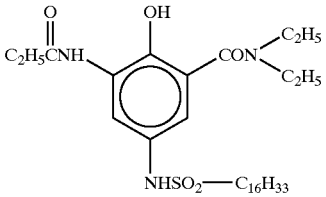
D-14
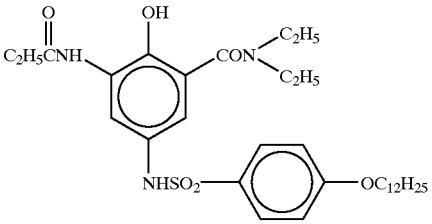
D-15
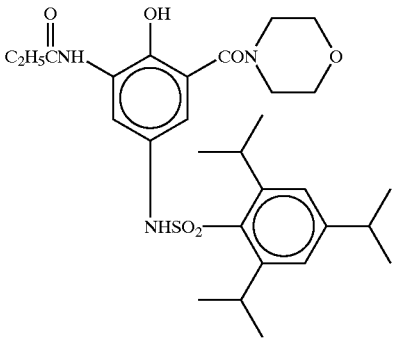

-continued
D-16
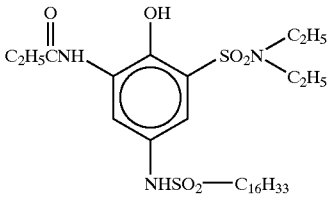
D-17
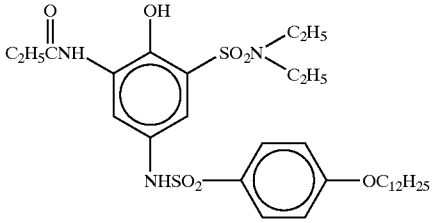
D-18
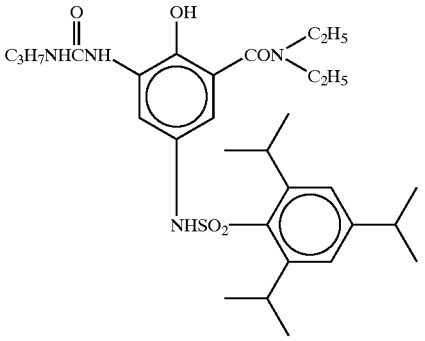
D-19
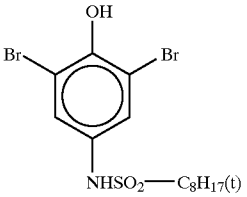
D-20
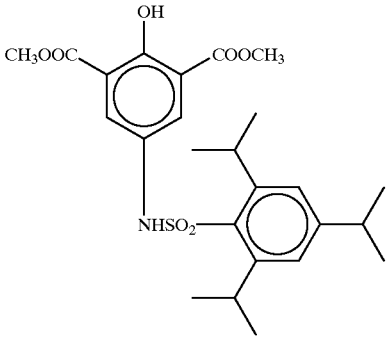
D-21
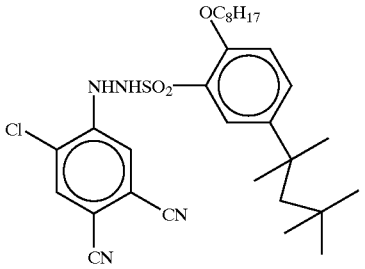
-continued
D-22
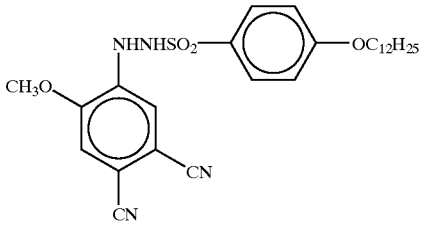
D-23
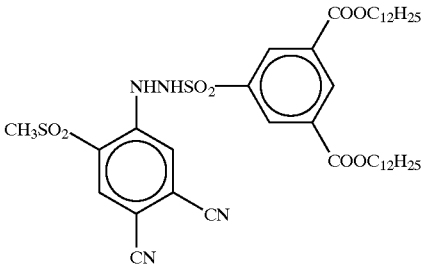
D-24
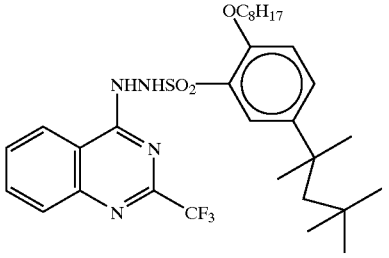
D-25
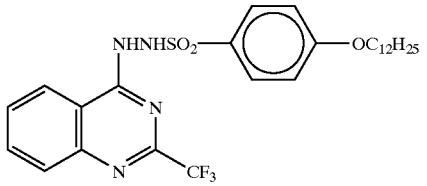
D-26
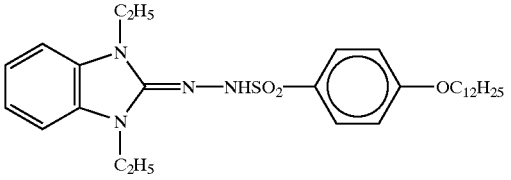
D-27
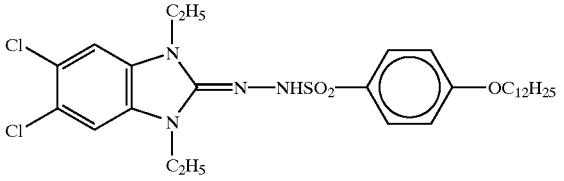

-continued
D-28
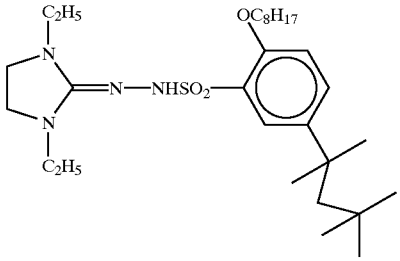
D-29
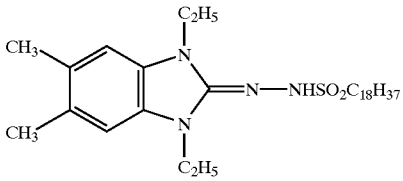
D-30
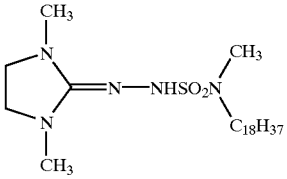
D-31
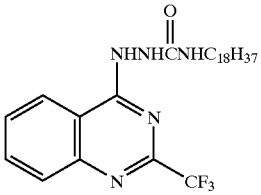
D-32
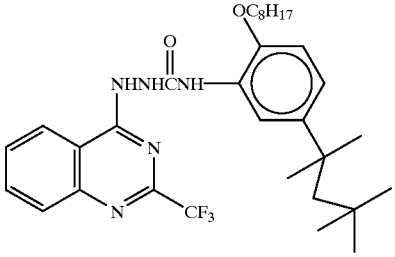
D-33
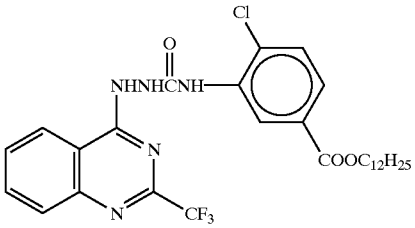
-continued
D-34
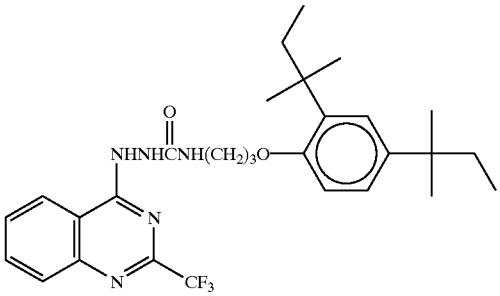
D-35
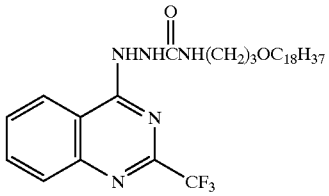
D-36
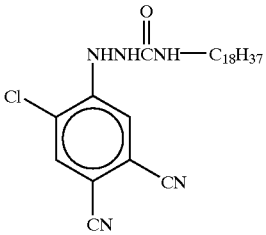
D-37
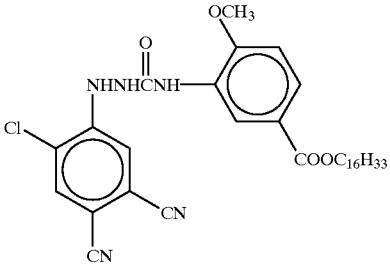
D-38
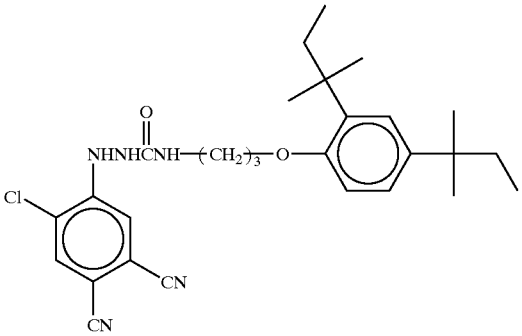

-continued
D-39
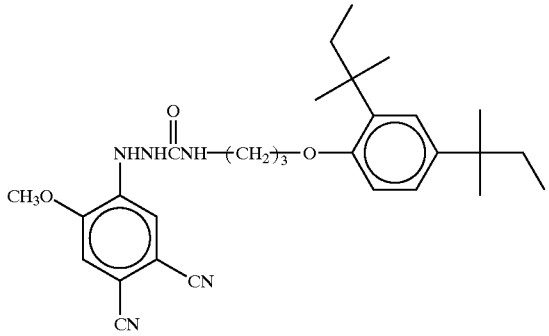
D-40
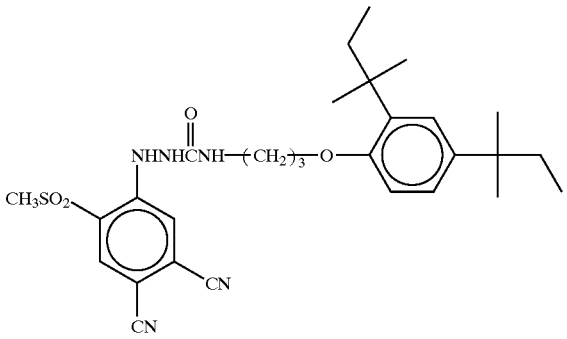
D-41
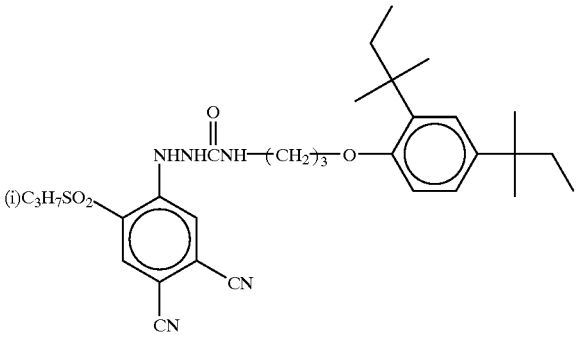
D-42
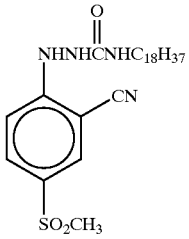
-continued
D-43
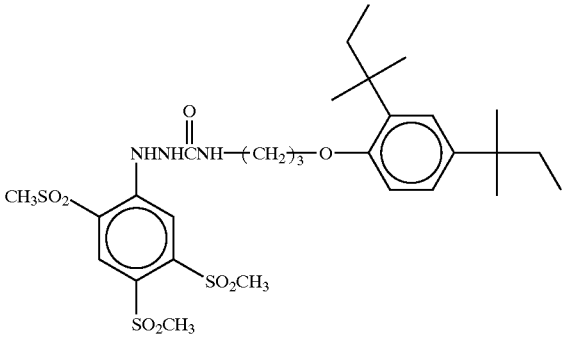
D-44
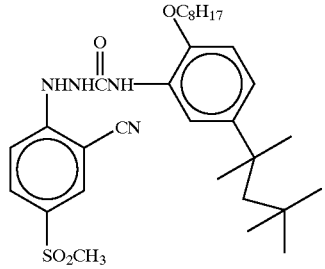
D-45
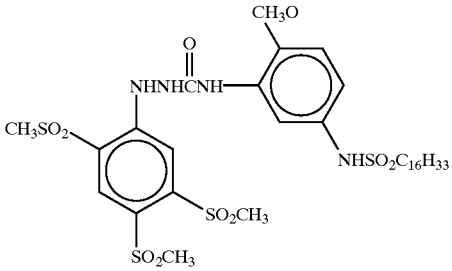
D-46
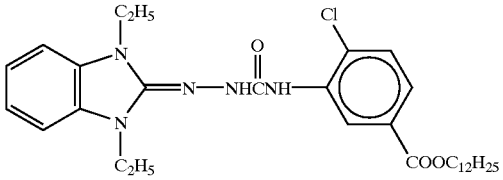
D-47
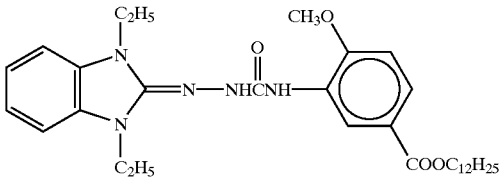
D-48
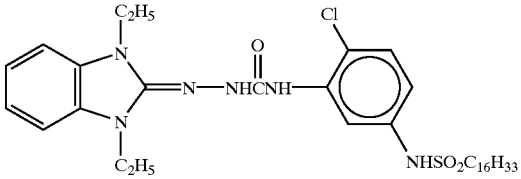

-continued

D-49

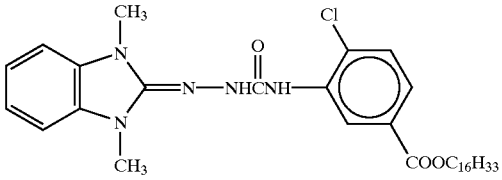

D-50

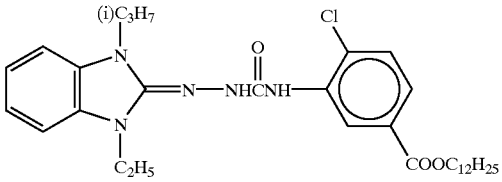

D-51

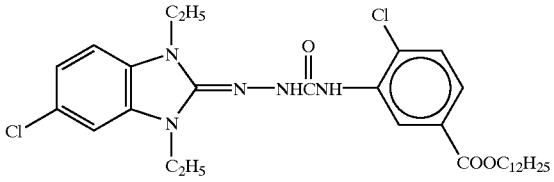

D-52

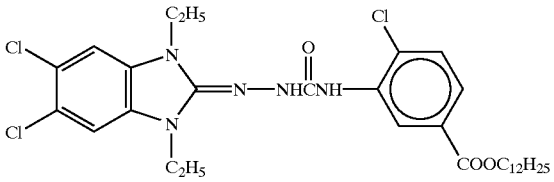

D-53

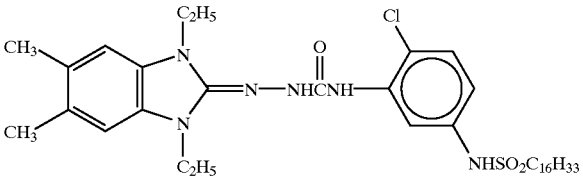

D-54

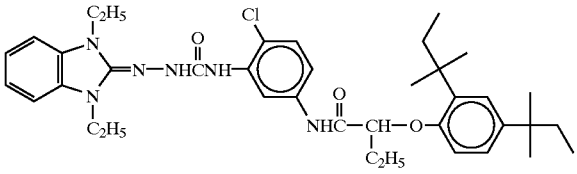

D-55

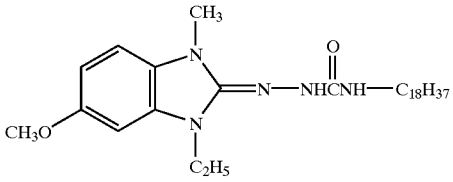

D-56

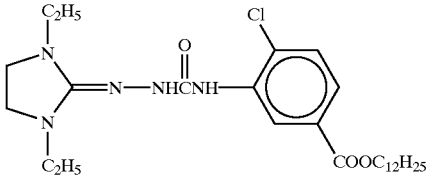

-continued

D-57

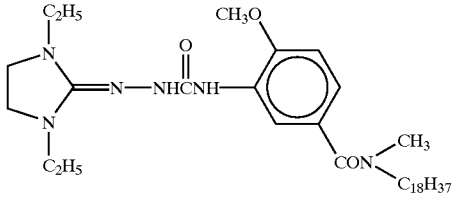

D-58

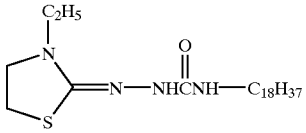

D-59

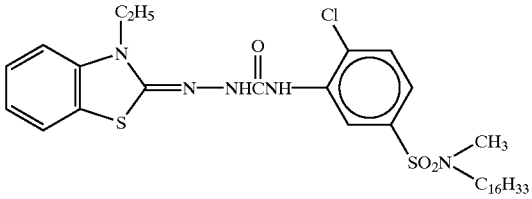

D-60

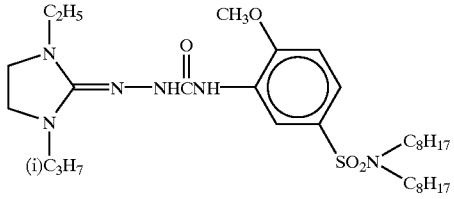

Now, the compounds represented by the general formula (6) of the present invention will be described in detail.

Each of $R_1$, $R_2$, $R_3$ and $R_4$ independently represents a hydrogen atom or a substituent. The substituent represented by $R_1$, $R_2$, $R_3$ or $R_4$ can be a halogen atom, an alkyl group (including a cycloalkyl and a bicycloalkyl), an alkenyl group (including a cycloalkenyl and a bicycloalkenyl), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, or a silyl group.

More specifically, the substituent represented by $R_1$, $R_2$, $R_3$ or $R_4$ can be a halogen atom (e.g., a chlorine atom, a bromine atom or an iodine atom); an alkyl group [representing a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, the alkyl of alkylthio group) also means the alkyl group of this concept]; an alkenyl group [representing a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; an alkynyl group (preferably a substituted or unsubstituted alkynyl group having 2 to 30 carbon atoms, such as ethynyl, propargyl or trimethylsilylethynyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a monovalent group corresponding to a 5- or 6-membered substituted or unsubstituted aromatic or nonaromatic heterocyclic compound from which one hydrogen atom is removed, and to which an aromatic hydrocarbon ring such as benzen ring may be condences, more preferably a 5- or 6-membered aromatic heterocyclic group having 3 to 30 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 30 carbon atoms, such as 1-phenyltetrazol-5-oxy or 2-tetrahydropyranyloxy); an acyloxy group (preferably a formyloxy group, a substituted or unsubstituted alkylcarbonyloxy group having 2 to 30 carbon atoms or a substituted or unsubstituted arylcarbonyloxy group having 6 to 30 carbon atoms, such as formyloxy, acetyloxy, pivaloyloxy, stearoyloxy, benzoyloxy or p-methoxyphenylcarbonyloxy); a carbamoyloxy group (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (preferably an amino group, a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably an formylamino group, a substituted or unsubstituted alkylcarbonylamino group having 2 to 30 carbon atoms or a substituted or unsubstituted arylcarbonylamino group having 7 to 30 carbon atoms, such as formylamino, acetylamino, pivaloylamino, lauroylamino, benzoylamino or 3,4,5-tri-n-octyloxyphenylcarbonylamino); an aminocarbonylamino group (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methylmethoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); a sulfamoylamino group (preferably a substituted or unsubstituted sulfamoylamino group having 0 to 30 carbon atoms, such as sulfamoylamino, N,N-dimethylaminosulfonylamino or N-n-octylaminosulfonylamino); an alkyl- or arylsulfonylamino group (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, p-chlorophenylthio or m-methoxyphenylthio); a heterocyclic thio group (preferably a substituted or unsubstituted heterocyclic thio group having 2 to 30 carbon atoms, such as 2-benzothiazolylthio or 1-phenyltetrazol-5-ylthio); a sulfamoyl group (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; an alkyl- or arylsulfinyl group (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); an alkyl- or arylsulfonyl group (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); an acyl group (preferably a formyl group, a substituted or unsubstituted alkylcarbonyl group having 2 to 30 carbon atoms or a substituted or unsubstituted arylcarbonyl group having 7 to 30 carbon atoms, such as acetyl, pivaloyl, 2-chloroacetyl, stearoyl, benzoyl or p-n-octyloxyphenylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); an aryl- or heterocyclic azo group (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); an imido group (preferably N-succinimido or N-phthalimido); a phosphino group (preferably a substituted or unsubstituted phosphino group having 2 to 30 carbon atoms, such as dimethylphosphino, diphenylphosphino or methylphenoxyphosphino); a phosphinyl group (preferably a substituted or unsubstituted phosphinyl group having 0 to 30 carbon atoms, such as phosphinyl, dioctyloxyphosphinyl or diethoxyphosphinyl); a phosphinyloxy group (preferably a substituted or unsubstituted phosphinyloxy group having 2 to 30 carbon atoms, such as diphenoxyphosphinyloxy or dioctyloxyphosphinyloxy); a phosphinylamino group (preferably a substituted or unsubstituted phosphinylamino group having 2 to 30 carbon atoms, such as dimethoxyphosphinylamino or dimethylaminophosphinylamino); or a silyl group (preferably a substituted or unsubstituted silyl group having 0 to 30 carbon atoms, such as trimethylsilyl, t-butyldimethylsilyl or phenyldimethylsilyl).

When the groups represented by $R_1$ to $R_4$ are further substitutable groups, the groups represented by $R_1$ to $R_4$ may further have substituents. Preferred substituents are the same as the substituents described with respect to $R_1$ to $R_4$. When the substitution is effected by two or more substituents, the substituents may be identical with or different from each other.

Each of $R_5$ and $R_6$ independently represents an alkyl group, an aryl group, a heterocyclic group, an acyl group, an alkylsulfonyl group or an arylsulfonyl group. With respect to the preferred scope of the alkyl group, aryl group, heterocyclic group, acyl group, alkylsulfonyl group and arylsulfonyl group, these are the same as the alkyl group, aryl group, heterocyclic group, acyl group, alkylsulfonyl group and arylsulfonyl group described above in connection with the substituents represented by $R_1$ to $R_4$. When the groups represented by $R_5$ and $R_6$ are further substitutable groups, the groups represented by $R_5$ and $R_6$ may further have substituents. Preferred substituents are the same as the substituents described with respect to $R_1$ to $R_4$. When the substitution is effected by two or more substituents, the substituents may be identical with or different from each other.

$R_1$ and $R_2$, $R_3$ and $R_4$, $R_5$ and $R_6$, $R_2$ and $R_{51}$ and/or $R_4$ and $R_6$ may be bonded to each other to thereby form a 5-membered, 6-membered or 7-membered ring.

In the general formula (6), $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ represents an alkyl group, an aryl group or a heterocyclic group, $R_{15}$ represents a hydrogen atom or a block group, W represents an oxygen atom, a sulfur atom or >N—$R_{18}$, and each of $R_{16}$, $R_{17}$ and $R_{18}$ represents a hydrogen atom, an alkyl group or $(M)_{1/n}OSO_2$—. The alkyl group, aryl group and heterocyclic group represented by $R_{11}$, $R_{12}$, $R_{13}$ and $R_{14}$ are the same as the alkyl group, aryl group and heterocyclic group described above in connection with the substituents represented by $R_1$ to $R_4$. M represents a n-valence cation, such as, for example, $Na^+$ and $K^+$. n represents a natural number, preferably a natural number of 1 to 3. When the groups represented by $R_{11}$, $R_{12}$, $R_{13}$ and $R_{14}$ are further substitutable groups, the groups represented by $R_{11}$, $R_{12}$, $R_{13}$ and $R_{14}$ may further have substituents. Preferred substituents are the same as the substituents described with respect to $R_1$ to $R_4$. When the substitution is effected by two or more substituents, the substituents may be identical with or different from each other. When $R_{16}$, $R_{17}$ and $R_{18}$ represent alkyl groups, these are the same as the alkyl group described above in connection with the substituents represented by $R_1$ to $R_4$. When $R_{15}$ represents a block group, it is the same as the block group represented by BLK described later.

The compounds of the general formula (6) will now be described with respect to the preferred scope thereof.

Each of $R_1$ to $R_4$ preferably represents a hydrogen atom, a halogen atom, an alkyl group, an aryl group, an acylamino group, an alkyl- or arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxyl group, a carboxyl group, a sulfo group, a nitro group, a sulfamoyl group, an alkylsulfonyl group, an arylsulfonyl group or an acyloxy group. Each of $R_1$ to $R_4$ more preferably represents a hydrogen atom, a halogen atom, an alkyl group, an acylamino group, an alkyl- or arylsulfonylamino group, an alkoxy group, an alkylthio group, an arylthio group, an alkoxycarbonyl group, a carbamoyl group, a cyano group, a hydroxyl group, a carboxyl group, a sulfo group, a nitro group, a sulfamoyl group, an alkylsulfonyl group or an arylsulfonyl group. It is especially preferred that, among $R_1$ to $R_4$, either of $R_1$ and $R_3$ be a hydrogen atom.

Each of $R_5$ and $R_6$ preferably represents an alkyl group, an aryl group or a heterocyclic group, most preferably an alkyl group.

With respect to the compounds of the general formula (6), it is preferred that the formula weight of moiety excluding $R_7$ be 300 or more. Further, it is preferred that the oxidation potential in pH 10 water of p-phenylenediamine derivative, i.e., compound of the general formula (6) wherein $R_7$ is a hydrogen atom do not exceed 5 mV (vs. SCE).

$R_7$ preferably represents $R_{11}$—O—CO—, $R_{14}$—$SO_2$— or $R_{15}$—W—C($R_{16}$)($R_{17}$)—, most preferably $R_{11}$—O—CO—.

$R_{11}$ preferably represents an alkyl group, or a group containing a timing group capable of inducing a cleavage reaction with the use of electron transfer reaction as described in U.S. Pat. Nos. 4,409,323 and 4,421,845, or a group of the following formula (T-1) having a timing group whose terminal capable of inducing an electron transfer reaction is blocked.

BLK—W—(X=Y)j-C($R_{21}$)$R_{22}$—** Formula (T-1)

wherein BLK represents a block group; ** represents a position for bonding with —O—CO—; W represents an oxygen atom, a sulfur atom or >N—$R_{23}$; each of X and Y represents a methine or a nitrogen atom; j is 0, 1 or 2; and each of $R_{21}$, $R_{22}$ and $R_{23}$ represents a hydrogen atom or any of the same groups as the substituents described with respect to $R_1$ to $R_4$. When X and Y represent substituted methines, the substituents and any two of the substituents of $R_{21}$, $R_{22}$ and $R_{23}$ may be connected to each other to thereby form a cyclic structure (e.g., a benzene ring or a pyrazole ring). It is also possible to avoid such a cyclic structure formation.

As the block group represented by BLK, there can be employed known block groups, which include block groups such as acyl and sulfonyl groups as described in, for example, JP-B-48-9968, JP-A's 52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's 59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's 57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's 59-121328 and 59-218439 and JP-A-63-318555 (EP No. 0295729); block groups utilizing a cleavage reaction of 5- or 6-membered ring as described in, for example, JP-A-57-76541 (U.S. Pat. No. 4,335,200), JP-A-57-135949 (U.S. Pat. No. 4,350,752), JP-A's 57-179842, 59-137945, 59-140445, 59-219741 and 59-202459, JP-A-60-41034 (U.S. Pat. No. 4,618,563), JP-A-62-59945 (U.S. Pat. No.4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-leaving reaction as described in, for example, JP-A's 59-93442, 61-32839 and 62-163051 and JP-B-5-37299; block groups utilizing a nucleophilic substitution reaction of diarylmethane as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's 62-80646, 62-144163 and 62-147457; block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816; and block groups of JP-A's 3-236047 and 3-238445, all the contents of which disclosing the block groups are incorporated herein by reference. Of these block groups, block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816 are especially preferred.

Particular examples of the timing group moieties, corresponding to the group of formula (T-1) from which BLK is removed, include the following. In the following, * represents a position for bonding with BLK, and ** represents a position for bonding with —O—CO—.

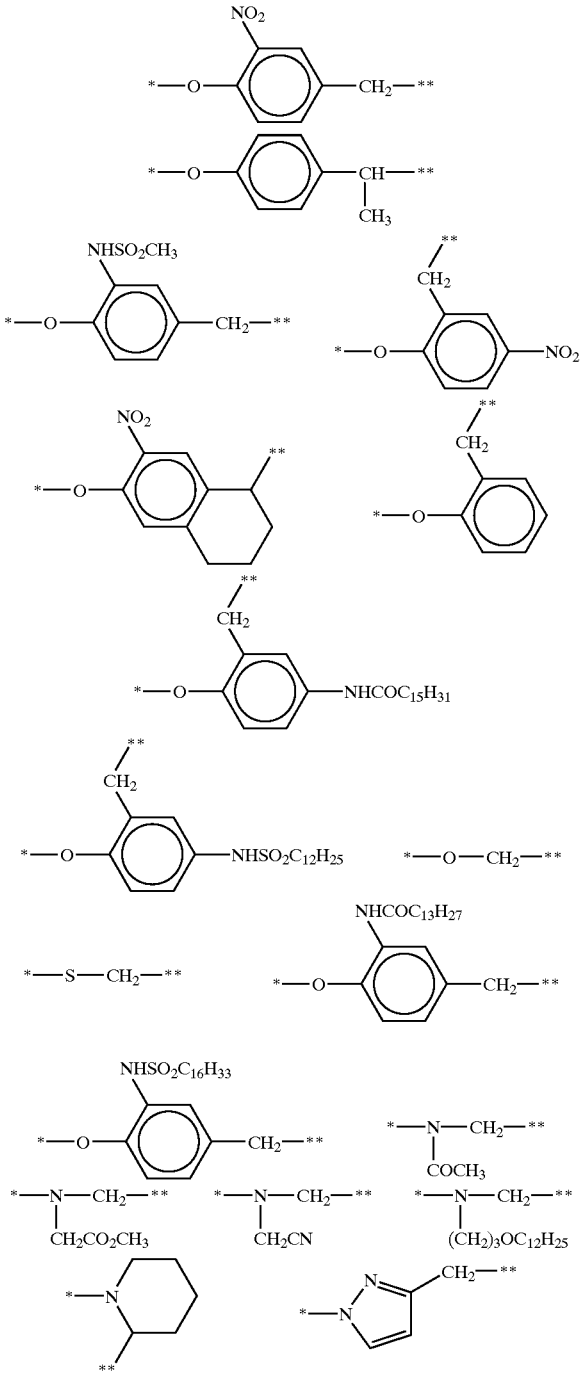

-continued

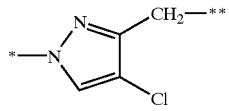

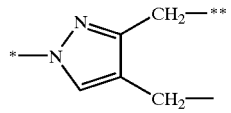

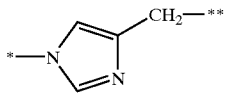

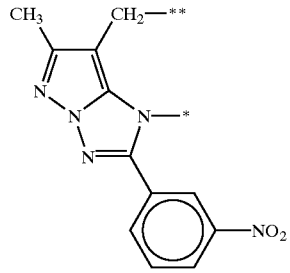

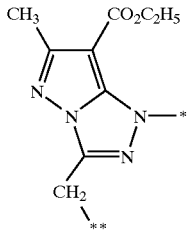

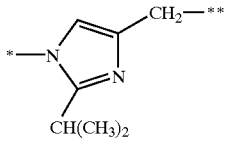

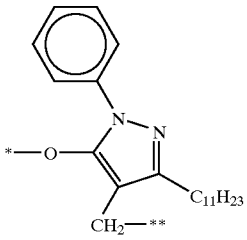

It is preferred that each of $R_{12}$ and $R_{13}$ be an alkyl or aryl group, and that $R_{14}$ be an aryl group. $R_{15}$ is preferably a block group, which is preferably the same as the preferred BLK contained in the group of the formula (T-1). Each of $R_{16}$, $R_{17}$ and $R_{18}$ preferably represents a hydrogen atom.

Particular examples of the compounds represented by the general formula (6) of the present invention will be set forth below, to which, however, the present invention is in no way limited.

DEVP-1

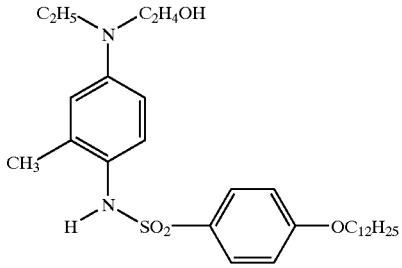

-continued

DEVP-2

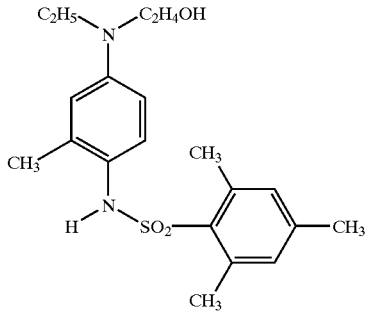

EVP-3

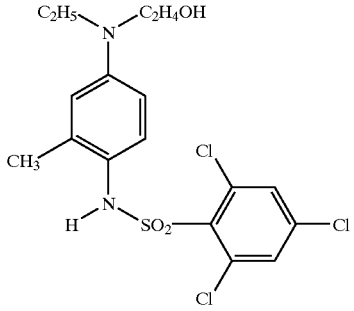

DEVP-4

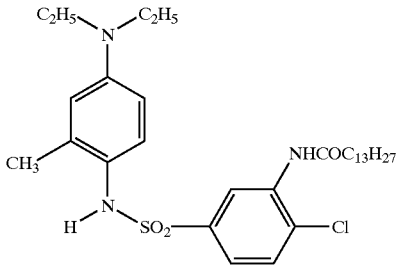

EVP-5

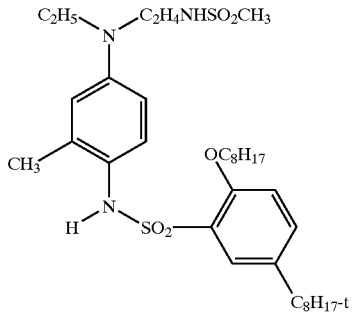

DEVP-6

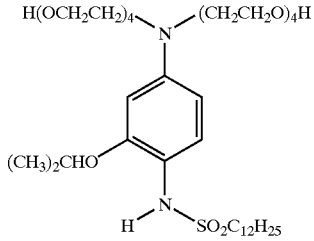

-continued
DEVP-7
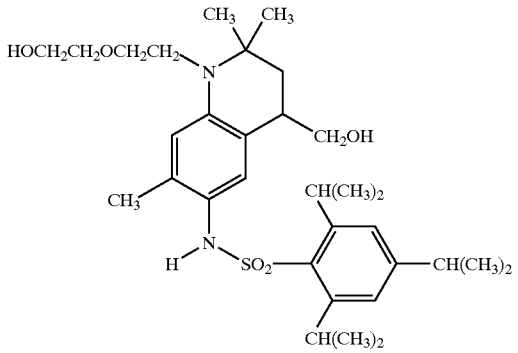
DEVP-8
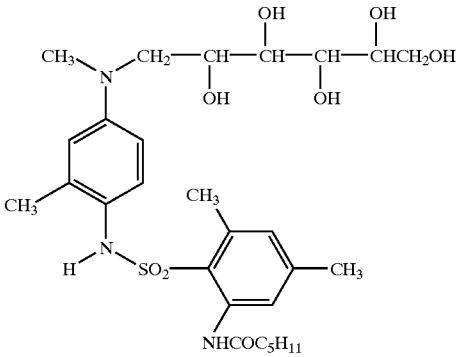
DEVP-9
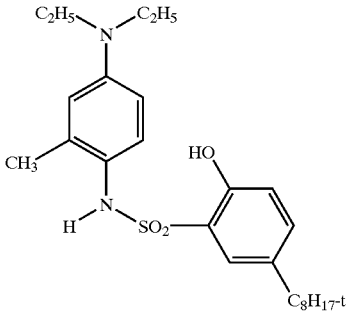
DEVP-10
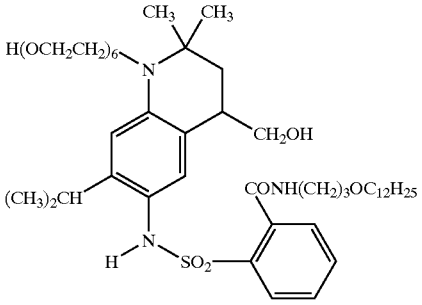
DEVP-11
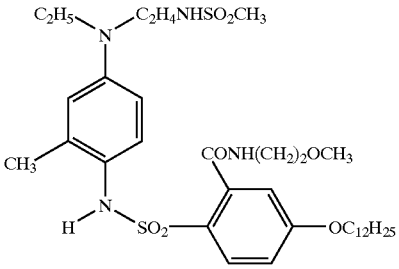
-continued
DEVP-12
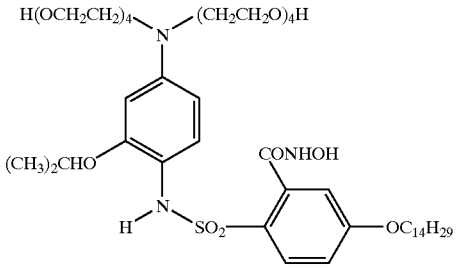
DEVP-13
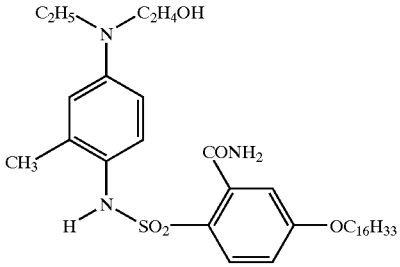
DEVP-14
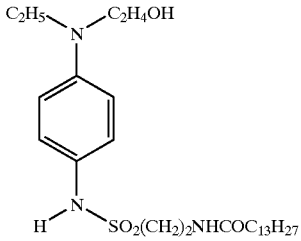
DEVP-15
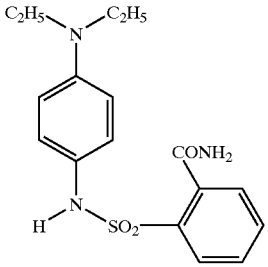
DEVP-16
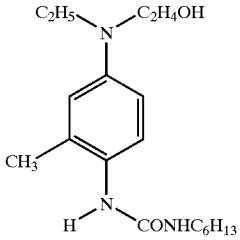
DEVP-17
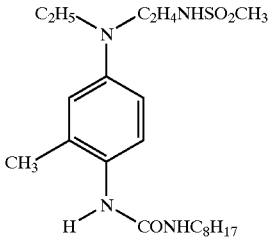

-continued
EVP-18
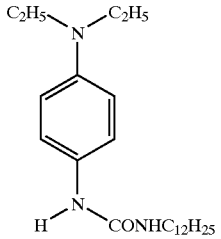
DEVP-19
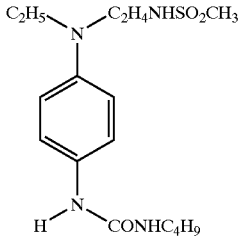
EVP-20
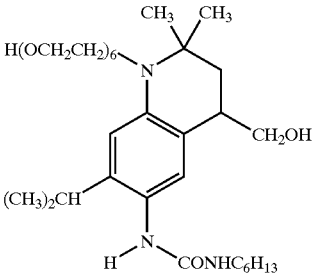
DEVP-21
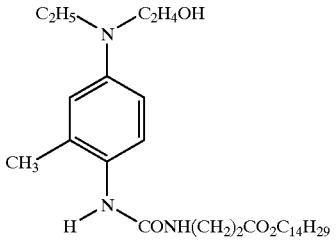
EVP-22
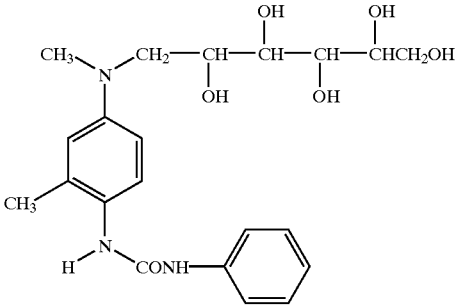
DEVP-23
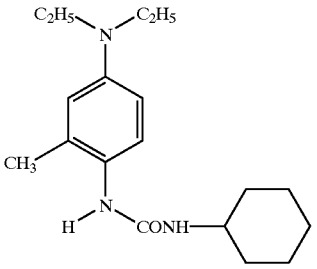
-continued
DEVP-24
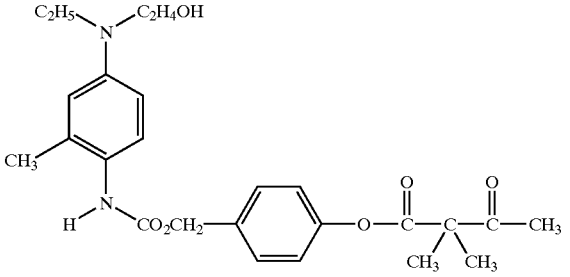
DEVP-25
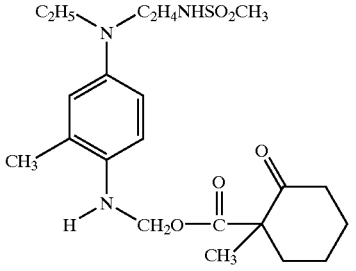
EVP-26
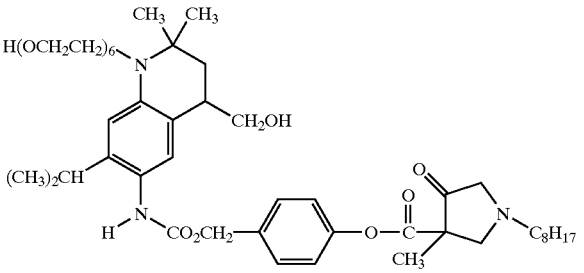
DEVP-27
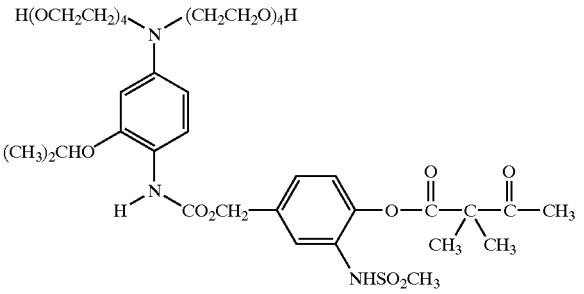
DEVP-28
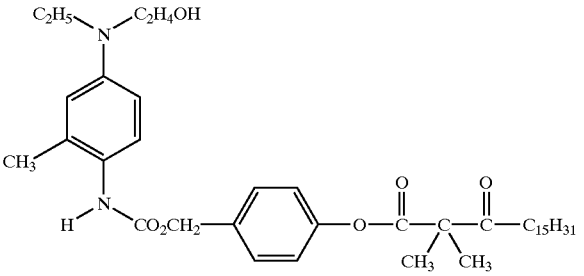

-continued
DEVP-29
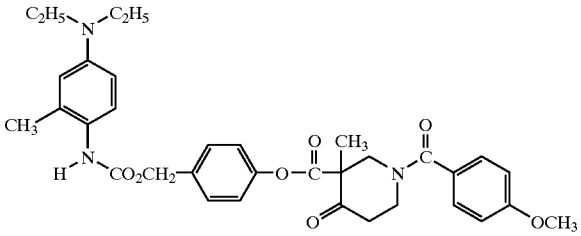
DEVP-30
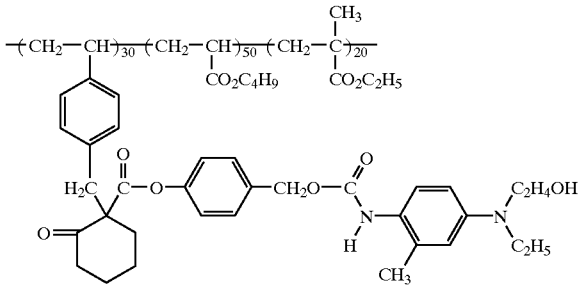
DEVP-31
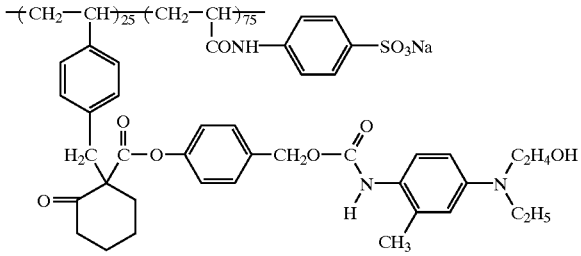
DEVP-32
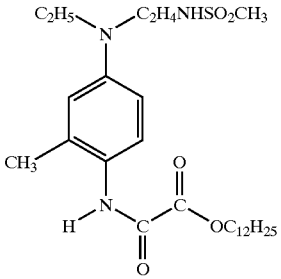
DEVP-33
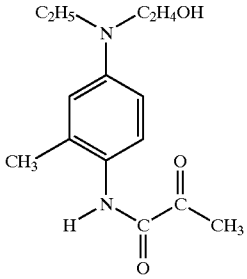
-continued
EVP-34
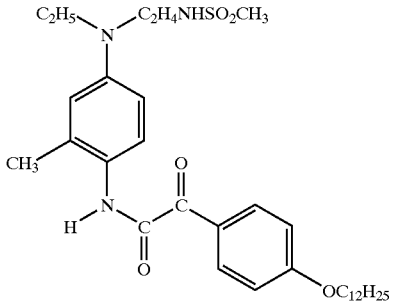
DEVP-35
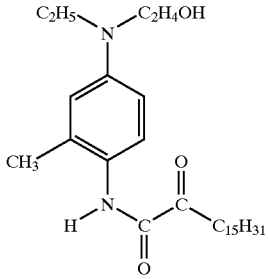
EVP-36
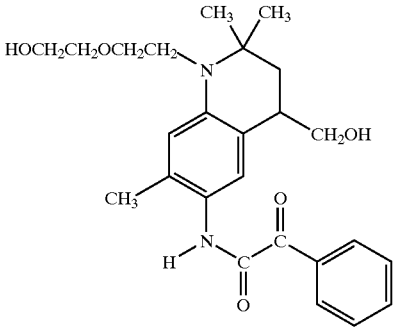
DEVP-37
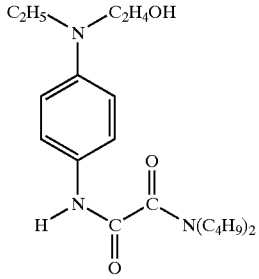
EVP-38
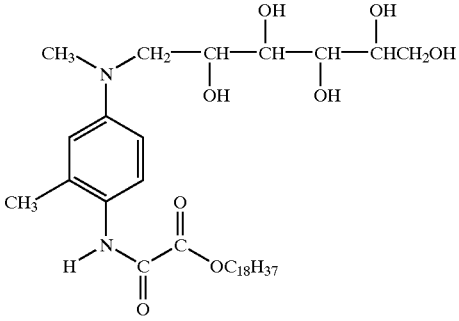

-continued

DEVP-39

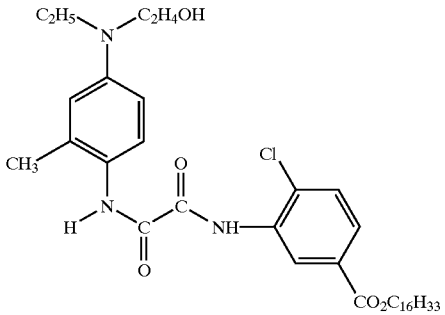

DEVP-40

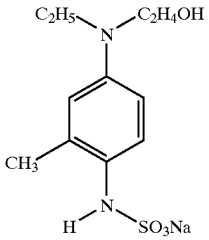

DEVP-41

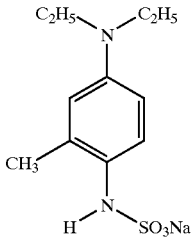

EVP-42

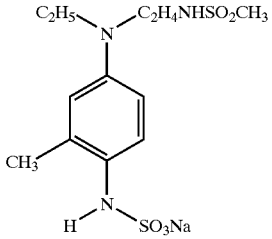

DEVP-43

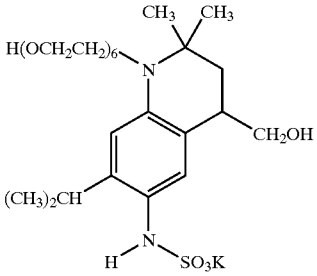

EVP-44

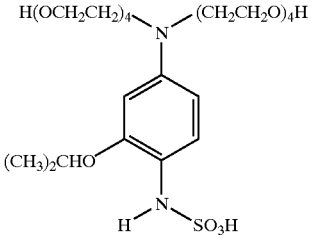

-continued

DEVP-45

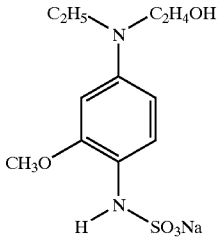

EVP-46

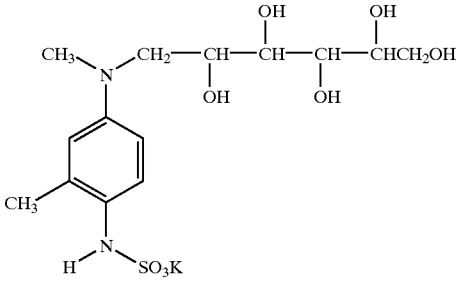

DEVP-47

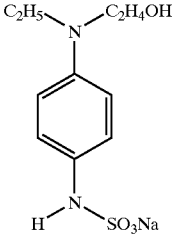

Compounds of U.S. Pat. Nos. 5,242,783 and 4,426,441 and JP-A's 62-227141, 5-257225, 5-249602, 6-43607 and 7-333780, the disclosures of which are incorporated herein by reference, are also preferably employed as the compound of the general formula (6) for use in the present invention.

Any of the compounds of the general formulae (1) to (6), although the addition amount thereof can be varied widely, is preferably used in a molar amount of 0.01 to 100 times, more preferably 0.1 to 10 times, that of a compound capable of performing a coupling reaction with a developing agent in an oxidized form to thereby form a dye (hereinafter referred to as "coupler"), which is used in combination with the compounds represented by formulae (1) to (6).

Of the compounds represented by formulae (1) to (6), compounds represented by formulae (1), (4) and (6) are preferable.

The compounds of the general formulae (1) to (6) can be added to a coating liquid in the form of any of, for example, a solution, powder, a solid fine grain dispersion, an emulsion and an oil protection dispersion. The solid particulate dispersion is obtained by the use of known atomizing means (for example, ball mill, vibration ball mill, sand mill, colloid mill, jet mill or roll mill). In the preparation of the solid particulate dispersion, use may be made of a dispersion auxiliary.

The above compounds are used individually or in combination as the color developing agent or precursor thereof. A different developing agent may be used in each layer. The total use amount of developing agent is in the range of 0.05 to 20 mmol/$m^2$, preferably 0.1 to 10 mmol/$m^2$.

The coupler will now be described. The coupler used in the present invention refers to a compound capable of performing a coupling reaction with an oxidation product of developing agent described above to thereby form a dye.

The couplers preferably used in the present invention are compounds generally termed "active methylenes, 5-pyrazolones, pyrazoloazoles, phenols, naphthols or pyrrolotriazoles". Compounds cited in RD No. 38957 (September 1996), pages 616 to 624, "x. Dye image formers and modifiers", can preferably be used as the above couplers.

The above couplers can be classified into so-termed 2-equivalent couplers and 4-equivalent couplers.

As the group which acts as an anionic split-off group of 2-equivalent couplers, there can be mentioned, for example, a halogen atom (e.g., chloro or bromo), an alkoxy group (e.g., methoxy or ethoxy), an aryloxy group (e.g., phenoxy, 4-cyanophenoxy or 4-alkoxycarbonylphenyloxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl), a heterocycliccarbamoyl (e.g., piperidylcarbamoyl or morpholinocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholinosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkylcarbonyloxy group (e.g., acetyloxy, propionyloxy or butyroyloxy), an arylcarbonyloxy group (e.g., benzoyloxy, toluyloxy or anisyloxy), and a nitrogen-containing heterocycle (e.g., imidazolyl or benzotriazolyl).

As the group which acts as a cationic split-off group of 4-equivalent couplers, there can be mentioned, for example, a hydrogen atom, a formyl group, a carbamoyl group, a substituted methylene group (the substituent is, for example, an aryl group, a sulfamoyl group, a carbamoyl group, an alkoxy group, an amino group or a hydroxyl group), an acyl group, and a sulfonyl group.

Besides the above compounds described in RD No. 38957, the following couplers can also preferably be employed.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826.

As pyrazoloazole couplers, there can preferably be employed imidazo[1,2-b]pyrazoles described in U.S. Pat. No. 4,500,630; pyrazolo[1,5-b][1,2,4]triazoles described in U.S. Pat. No. 4,540,654; and pyrazolo[5, 1-c][1,2,4]triazoles described in U.S. Pat. No. 3,725,067. Of these, pyrazolo[1, 5-b][1,2,4]triazoles are most preferred from the viewpoint of light fastness.

Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido balast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427, 767.

As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300.

Moreover, use can be made of couplers with the condensed ring phenol, imidazole, pyrrole, 3-hydroxypyridine, active methine, 5,5-condensed heterocycle and 5,6-condensed heterocycle structures.

As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347.

As pyrrole couplers, there can be employed those described in, for example, JP-A's 4-188137 and 4-190347.

As 3-hydroxypyridine couplers, there can be employed those described in, for example, JP-A-1-315736.

As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429.

As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE Nos. 3,819,051A and 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386, 930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

These couplers are used in an amount of 0.05 to 10 mmol/$m^2$, preferably 0.1 to 5 mmol/$m^2$, for each color.

Furthermore, the following functional couplers may be contained.

As couplers for forming a colored dye with appropriate diffusibility, there can preferably be employed those described in U.S. Pat. No. 4,366,237, GB No. 2,125,570, EP No. 96,873B and DE No. 3,234,533.

As couplers for correcting any unneeded absorption of a colored dye, there can be mentioned yellow colored cyan couplers described in EP No. 456,257A1; yellow colored magenta couplers described in the same EP; magenta colored cyan couplers described in U.S. Pat. No. 4,833,069; colorless masking couplers represented by the formula (2) of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I) to (IV) of page 11 of EP No. 378,236A1, compounds represented by the formula (I) of page 7 of EP No. 436,938A2, compounds represented by the formula (1) of EP No. 568,037A, and compounds represented by the formulae (I), (II) and (III) of pages 5–6 of EP No. 440,195A2;

Bleaching accelerator-releasing compounds: compounds represented by the formulae (I) and (I') of page 5 of EP No. 310,125A2 and compounds represented by the formula (I) of claim 1 of JP-A-6-59411;

Ligand-releasing compounds: compounds represented by LIG-X described in claim 1 of U.S. Pat. No. 4,555,478;

Leuco dye-releasing compounds: compounds 1 to 6 of columns 3 to 8 of U.S. Pat. No. 4,749,641;

Fluorescent dye-releasing compounds: compounds represented by COUP-DYE of claim 1 of U.S. Pat. No. 4,774,181;

Development accelerator or fogging agent-releasing compounds: compounds represented by the formulae (1), (2) and (3) of column 3 of U.S. Pat. No. 4,656,123 and ExZK-2 of page 75, lines 36 to 38, of EP No. 450, 637A2; and Compounds which release a group becoming a dye only after splitting off: compounds represented by the formula (I) of claim 1 of U.S. Pat. No. 4,857,447, compounds represented by the formula (1) of JP-A-5-307248, compounds represented by the formulae (I), (II) and (III) of pages 5–6 of EP No. 440,195A2, compounds-ligand-releasing compounds represented by the formula (I) of claim 1 of JP-A-6-59411, and compounds represented by LIG-X described in claim 1 of U.S. Pat. No. 4,555,478.

These functional couplers are preferably used in a molar amount of 0.05 to 10 times, more preferably 0.1 to 5 times, that of the aforementioned couplers which contribute to coloring.

Hydrophobic additives such as couplers and color developing agents can be introduced in layers of lightsensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C. With respect to dye donating couplers, high-boiling organic solvents, etc., a plurality thereof can be used in combination.

The amount of high-boiling organic solvents is 10 g or less, preferably 5 g or less, and more preferably in the range of 1 to 0.1 g, per g of introduced hydrophobic additive. The amount of high-boiling organic solvents is appropriately 1 milliliter (hereinafter also referred to as "mL") or less, more appropriately 0.5 mL or less, and most appropriately 0.3 mL or less, per g of binder.

Also, use can be made of the method of effecting a dispersion by polymer as described in JP-B-51-39853 and JP-A-51-59943, and the method of adding in the form of a particulate dispersion as described in, for example, JP-A-62-30242.

With respect to compounds which are substantially insoluble in water, besides the above methods, the compounds can be atomized and dispersed in binders.

When hydrophobic compounds are dispersed in hydrophilic colloids, various surfactants can be employed. For example, use can be made of those described as surfactants in JP-A-59-157636, pages 37 and 38, and the above cited RDs. Further, use can be made of phosphoric ester surfactants described in JP-A's 7-56267 and 7-228589 and DE No. 1,932,299A.

In the lightsensitive material of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color. Various non lightsensitive layers such as an intermediate layer can be formed between the silver halide lightsensitive layers and as the uppermost layer and the lowermost layer. These intermediate layers may contain, e.g., couplers described above, developing agents, DIR compounds, color-mixing inhibitors and dyes. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL) /high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve color reproduction, an inter layer effect-donating layer (CL), whose spectral sensitivity distribution is different from those of the main light-sensitive layers of BL, GL and RL, can be arranged adjacent to the main light-sensitive layer or near the main light-sensitive layer, as described in U.S. Pat. Nos. 4,663,271, 4,705,744 and 4,707,436, and JP-A's-62-160448 and 63-89850.

In the present invention, the silver halide color photographic lightsensitive material comprising at least one light-sensitive silver halide emulsion layer containing a binder and lightsensitive tabular silver halide grains, on a support, contains a developing agent or a precursor thereof and a compound capable of forming a dye by a coupling reaction with a developing agent in an oxidized form. The silver halide grains, the compound capable of forming a dye by a coupling reaction with a developing agent in an oxidized form, and the color developing agent or precursor thereof, although may be contained in a single layer (preferably a lightsensitive silver halide emulsion layer), can be divided and incorporated in separate layers as long as a reaction can be effected therebetween. For example, when the layer containing a color developing agent is separate from the layer containing silver halide, the raw shelf life of lightsensitive material can be prolonged. For example, the color developing agent or precursor thereof and/or the compound capable of forming a dye by a coupling reaction with a developing agent in an oxidized form can be contained in a layer adjacent to the emulsion layer containing lightsensitive tabular silver halide grains.

Although the relationship between spectral sensitivity and coupler hue of each layer is arbitrary, the use of cyan coupler in a red-sensitive layer, magenta coupler in a green-sensitive layer and yellow coupler in a blue-sensitive layer enables direct projection exposure on conventional color paper or the like.

In the lightsensitive material, various nonlightsensitive layers such as a protective layer, a substratum, an interlayer, a yellow filter layer and an antihalation layer may be provided between aforementioned silver halide emulsion layers, or as an uppermost layer or a lowermost layer. The opposite side of the support can be furnished with various auxiliary layers such as a back layer. For example, the lightsensitive material can be provided with a layer arrangement as described in the above patents; a substratum as described in U.S. Pat. No. 5,051,335; an interlayer containing a solid pigment as described in JP-A's 1-167838 and 61-20943; an interlayer containing a reducing agent and a DIR compound as described in JP-A's 1-120553, 5-34884 and 2-64634; an interlayer containing an electron transfer agent as described in U.S. Pat. Nos. 5,017,454 and 5,139,919 and JP-A-2-235044; a protective layer containing a reducing agent as described in JP-A-4-249245; or a combination of these layers.

The dye which can be used in a yellow filter layer and an antihalation layer is preferably one decolorized or removed at the time of development and hence not contributing to density after processing.

The expression "dye of a yellow filter layer and an antihalation layer is decolorized or removed at the time of development" used herein means that the amount of dye remaining after processing is reduced to ⅓ or less, preferably 1/10 or less, of that just before coating. Dye components may be transferred from the lightsensitive material to the processing material at the time of development. Alternatively, at the time of development, the dye may react so as to convert itself to a colorless compound.

For example, there can be mentioned dyes described in EP No. 549,489A and ExF2 to 6 dyes described in JP-A-7-152129. Also, use can ba made of solid-dispersed dyes as described in JP-A-8-101487.

The dye can be mordanted in advance with the use of a mordanting agent and a binder. As the mordanting agent and dye, there can be employed those known in the art of photography. For example, use can be made of mordanting agents described in U.S. Pat. No. 4,500,626 columns 58–59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP No. 220,746A2, JIII Journal of Technical Disclosure No. 87-6119 and JP-A-8-101487 paragraph nos. 0080 to 0081.

A decolorizable leuco dye or the like can also be employed. For example, JP-A-1-150132 discloses a silver halide lightsensitive material containing a leuco dye which has been colored in advance by the use of a developer of a metal salt of organic acid. The complex of leuco dye and developer is decolorized by heating or reaction with an alkali agent.

Known leuco dyes can be used, which are described in, for example, Moriga and Yoshida, "Senryo to Yakuhin (Dyestuff and Chemical)" 9, page 84 (Kaseihin Kogyo Kyokai (Japan Dyestuff & Chemical Industry Association)); "Shinpan Senryo Binran (New Edition Dyestuff Manual)", page 242 (Maruzen Co., Ltd., 1970); R. Garner "Reports on the Progress of Appl. Chem." 56, page 199 (1971); "Senryo to Yakuhin (Dyestuff and Chemical)" 19, page 230 (Kaseihin Kogyo Kyokai (Japan Dyestuff & Chemical Industry Association), 1974); "Shikizai (Color Material)" 62, 288 (1989); and "Senshoku Kogyo (Dyeing Industry)" 32, 208.

As the developer, there can preferably be employed acid clay developers, phenol formaldehyde resin and metal salts of organic acid. Examples of suitable metal salts of organic acid include metal salts of salicylic acids, metal salts of phenol-salicylic acid-formaldehyde resins, and metal salts of rhodanate and xanthate. Zinc is especially preferably used as the metal. With respect to oil-soluble zinc salicylate among the above developers, use can be made of those described in, for example, U.S. Pat. Nos. 3,864,146 and 4,046,941 and JP-B-52-1327.

The coating layers of the lightsensitive material of the present invention are preferably hardened by film hardeners.

Examples of film hardeners include those described in, for example, U.S. Pat. Nos. 4,678,739 column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and boric acid, metaboric acid or polymer film hardeners (compounds described in, for example, JP-A-62-234157).

These film hardeners are used in an amount of 0.001 to 1 g, preferably 0.005 to 0.5 g, per g of hydrophilic binder.

In the lightsensitive material, use can be made of various antifoggants, photographic stabilizers and precursors thereof. Examples thereof include compounds described in, for example, the aforementioned RDS, U.S. Pat. Nos. 5,089,378, 4,500,627 and 4,614,702, JP-A-64-13564 pages 7–9, 57–71 and 81–97, U.S. Pat. Nos. 4,775,610, 4,626,500 and 4,983,494, JP-A's 62-174747, 62-239148, 1-150135, 2-110557 and 2-178650, and RD No. 17643 (1978) pages 24–25.

These compounds are preferably used in an amount of $5\times10^{-6}$ to $1\times10^{-1}$ mol, more preferably $1\times10^{-5}$ to $1\times10^{-2}$ mol, per mol of silver.

In the lightsensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457.

An organic fluorocompound may be incorporated in the lightsensitive material for the purpose of sliding prevention, static electricity prevention, frilling amelioration, etc. As representative examples of organic fluorocompounds, there can be mentioned fluorinated surfactants described in, for example, JP-B-57-9053 columns 8 to 17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of lightsensitive material.

It is preferred that the lightsensitive material have sliding properties. A layer containing a sliding agent is preferably provided on both the lightsensitive layer side and the back side. Preferred sliding properties range from 0.25 to 0.01 in terms of kinematic friction coefficient.

By the measurement, there can be obtained the value at 60 cm/min carriage on a stainless steel ball of 5 mm diameter (25° C., 60%RH). Even if the evaluation is made with the opposite material replaced by a lightsensitive layer surface, the value of substantially the same level can be obtained.

Examples of suitable sliding agents include polyorganosiloxanes, higher fatty acid amides, higher fatty acid metal salts and esters of higher fatty acids and higher alcohols. As the polyorganosiloxanes, there can be employed, for example, polydimethylsiloxane, polydiethylsiloxane, polystyrylmethylsiloxane and polymethylphenylsiloxane. The layer to be loaded with the sliding agent is preferably an outermost one of emulsion layers or a back layer. Polydimethylsiloxane and an ester having a long-chain alkyl group are especially preferred. For preventing silver halide pressure marks and desensitization, silicone oil and chlorinated paraffin are preferably used.

In the present invention, further, an antistatic agent is preferably used. As the antistatic agent, there can be mentioned a polymer containing a carboxylic acid and a carboxylic acid salt or sulfonic acid salt, a cationic polymer and an ionic surfactant compound.

Most preferable antistatic agent consists of fine particles of a crystalline metal oxide of $10^7$ Ω·cm or less, preferably $10^5$ Ω·cm or less, volume resistivity with a particle size of 0.001 to 1.0 μm, constituted of at least one member selected from among ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si or C), or fine particles of such a metal oxide or composite oxide thereof in sol form. The content of antistatic agent in the lightsensitive material is preferably in the range of 5 to 500 mg/m$^2$, more preferably 10 to 350 mg/m$^2$. The quantitative ratio of conductive crystalline oxide or composite oxide thereof to binder is preferably in the range of 1/300 to 100/1, more preferably 1/100 to 100/5. The back of the support of the lightsensitive material is preferably coated with a water resistant polymer described in JP-A-8-292514.

The lightsensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

In the lightsensitive material of the present invention, a matting agent is preferably contained. The matting agent, although can be contained in the emulsion side or the back side, is most preferably incorporated in an outermost layer of the emulsion side. The matting agent may be soluble, or insoluble, in processing solutions. It is preferred that soluble and insoluble matting agents be used in combination. For example, polymethyl methacrylate, polymethyl methacrylate/methacrylic acid (9/1 or 5/5 in molar ratio) and polystyrene particles are preferred. The particle diameter is preferably in the range of 0.8 to 10 μm, and a narrow particle diameter distribution is preferred. It is preferred that 90% or more of all the particles have diameters which fall within 0.9 to 1.1 times the average particle diameter. For enhancing matting properties, it is also preferred to simultaneously add fine particles of up to 0.8 μm. As such fine particles, there can be mentioned, for example, polymethyl methacrylate (0.2 μm), polymethyl methacrylate/methacrylic acid (9/1 in molar ratio, 0.3 μm), polystyrene particles (0.25 μm) and colloidal silica (0.03 μm).

Specific examples are described in JP-A-61-88256, page 29. In addition, use can be made of compounds described in JP-A's 63-274944 and 63-274952, such as benzoguanamine resin beads, polycarbonate resin beads and AS resin beads. Also, use can be made of compounds described in the aforementioned RDs.

These matting agents, according to necessity, can be dispersed in various binders, as described in the above paragraphs relating to binder, and applied in the form of a dispersion. In particular, the dispersion in various gelatins, for example, acid-processed gelatin, enables easily preparing stable coating liquids. In the preparation, according to necessity, it is preferred to optimize the pH, ionic strength and binder concentration.

Further, the following compounds can be employed:

Dispersion mediums for oil-soluble organic compounds: P-3, 5, 16, 19, 25, 30, 42, 49, 54, 55, 66, 81, 85, 86 and 93 (pages 140–144) of JP-A-62-215272, latexes for impregnation of oil-soluble organic compounds, and latexes described in U.S. Pat. No. 4,199,363;

Scavengers for developing agent in an oxidized form: compounds of the formula (I) of column 2, lines 54–62, of U.S. Pat. No. 4,978,606 (especially, I-(1), (2), (6) and (12) (columns 4–5)), and formula of column 2, lines 5–10, of U.S. Pat. No. 4,923,787 (especially, compound 1 (column 3));

Antistaining agents: formulae (I) to (III) of page 4, lines 30–33, of EP No. 298321A, especially I-47 and 72 and III-1 and 27 (pages 24–48);

Discoloration preventives: A-6, 7, 20, 21, 23, 24, 25, 26, 30, 37, 40, 42, 48, 63, 90, 92, 94 and 164 (pages 69–118) of EP No. 298321A, II-1 to III-23 of columns 25–38 of U.S. Pat. No. 5,122,444, especially III-10, I-1 to III-4 of pages 8–12 of EP No. 471347A, especially II-2, and A-1 to -48 of columns 32 to 40 of U.S. Pat. No. 5,139,931, especially A-39 and -42; 1

Materials for reducing the use amount of color enhancer and color mixing inhibitor: I-1 to II-15 of pages 5 to 24 of EP No. 411324A, especially I-46;

Formalin scavengers: SCV-1 to -28 of pages 24 to 29 of EP No. 477932A, especially SCV-8;

Film hardeners: H-1, 4, 6, 8 and 14 of page 17 of JP-A-1-214845, compounds (H-1 to -54) of formulae (VII) to (XII) of columns 13 to 23 of U.S. Pat. No. 4,618,573, compounds (H-1 to -76) of the formula (6) of page 8, right lower column, of JP-A-2-214852, especially H-14, and compounds of claim 1 of U.S. Pat. No. 3,325,287;

Development inhibitor precursors: P-24, 37 and 39 (pages 6–7) of JP-A-62-168139, and compounds of claim 1 of U.S. Pat. No. 5,019,492, especially 28 and 29 of column 7;

Antiseptics and mildewproofing agents: I-1 to III-43 of columns 3 to 15 of U.S. Pat. No. 4,923,790, especially II-1, 9, 10 and 18 and III-25;

Stabilizers and antifoggants: I-1 to (14) of columns 6 to 16 of U.S. Pat. No. 4,923,793, especially I-1, 60, (2) and (13), and compounds 1 to 65 of columns 25 to 32 of U.S. Pat. No. 4,952,483, especially 36;

Chemical sensitizers: triphenylphosphine selenides, and compound 50 of JP-A-5-40324;

Dyes: a-1 to b-20, especially a-1, 12, 18, 27, 35, 36 and b-5, of pages 15 to 18, and V-1 to 23, especially V-1, of pages 27 to 29 of JP-A-3-156450, F-I-1 to F-II-43, especially F-I-11 and F-II-8, of pages 33 to 55 of EP No. 445627A, III-1 to 36, especially III-1 and 3, of pages 17 to 28 of EP No. 457153A, microcrystalline dispersions of dye-1 to 124 of pages 8 to 26 of WO 88/04794, compounds 1 to 22, especially compound 1, of pages 6 to 11 of EP No. 319999A, compounds D-1 to 87 (pages 3 to 28) of formulae (1) to (3) of EP No. 519306A, compounds 1 to 22 (columns 3 to 10) of formula (I) of U.S. Pat. No. 4,268,622, and compounds 1 to 31 (columns 2 to 9) of formula (I) of U.S. Pat. No. 4,923,788; and UV absorbents: compounds (18b) to (18r) and 101 to 427 (pages 6 to 9) of formula (1) of JP-A-46-3335, compounds (3) to (66) of formula (I) (pages 10 to 44) and compounds HBT-1 to 10 of formula (III) (page 14) of EP No. 520938A, and compounds (1) to (31) of formula (1) (columns 2 to 9) of EP No. 521823A.

The above various additives such as film hardeners, antifoggants, surfactants, sliding agents, antistatic agents, latexes and matting agents can be incorporated in the processing material, or both the lightsensitive material and the processing material, according to necessity.

In the present invention, as the support of the lightsensitive material, there can be employed a transparent one capable of resisting processing temperatures. Generally, use can be made of photographic supports of paper, synthetic polymers (films), etc. as described in pages 223 to 240 of "Shashinkogaku no Kiso-Gin-en Shashin Hen-(Fundamental of Photographic Technology-Silver Salt Photography-)" edited by The Society of Photographic Science and Technologh of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose).

Also, use can be made of supports described in, for example, JP-A's 62-253159 pages 29 to 31, 1-161236 pages 14 to 17, 63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment.

When requirements on heat resistance and curling properties are especially strict, supports described in JP-A's 6-41281, 6-43581, 6-51426, 6-51437, 6-51442, 6-82961, 6-82960, 6-123937, 6-82959, 6-67346, 6-118561, 6-266050, 6-202277, 6-175282, 6-118561, 7-219129 and 7-219144 can preferably be employed as the support of the lightsensitive material.

Moreover, a support of a styrene polymer of mainly syndiotactic structure can preferably be employed. The thickness of the supports is preferably in the range of 5 to 200 $\mu$m, more preferably 40 to 120 $\mu$m.

Surface treatment is preferably performed for adhering the support and the lightsensitive material constituting layers to each other. Examples thereof include chemical, mechanical, corona discharge, flaming, ultraviolet irradiation, high-frequency, glow discharge, active plasma, laser, mixed acid, ozonization and other surface activating treatments. Of these surface treatments, ultraviolet irradiation, flaming, corona discharge and glow discharge treatments are preferred.

Now, the substratum will be described below:

The substratum may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and modified polymere of these polymers. Resorcin or p-chlorophenol is used as a support-swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-s-triazine), an epichlorohydrin resin or an active vinyl sulfone compound can be used in the substratum. Also, SiO2, $TiO_2$, inorganic fine grains or polymethyl methacrylate copolymer fine grains (0.01 to 10 μm) may be incorporated therein as a matting agent.

Further, it is preferable to record photographed information and etc. using, as a support, the support is having a magnetic recording layer as described in JP-A's 4-124645, 5-40321, 6-35092 and 6-317875.

The magnetic recording layer herein is the one obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of SBET. The saturation magnetization (as) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material.

Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million.

For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259 and 5,215,874 and EP No. 466,130.

The polyester support preferably used in the present invention will be described below. Particulars thereof together with the below mentioned light-sensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

The film patrone employed in the present invention will be described below.

The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}\Omega$ or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

In addition, a patrone capable of feeding a film out by rotating a spool may be used. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613.

The foregoing lightsensitive material of the present invention can preferably be used in a lens-equipped film unit as described in JP-B-2-32615 and Jpn. Utility Model Appln. KOKOKU Publication No. 3-39784.

The lens-equipped film unit refers to a unit comprising a packaging unit frame fitted in advance with a photographing lens and a shutter and, accommodated therein directly or after being packed in a container, an unexposed color lightsensitive material in sheeted or rolled form, which unit is light-tightly sealed and furnished with an outer packaging.

The packaging case frame is further fitted with a finder, means for lightsensitive material frame feeding, means for holding and ejecting an exposed color lightsensitive material, etc. The finder can be fitted with a parallax compensation support, and the photographing mechanism can be fitted with auxiliary lighting means as described in, for example, Jpn. Utility Model Appln. KOKAI Publication Nos. 1-93723, 1-57738 and 1-57740 and JP-A's 1-93723 and 1-152437.

Because the lightsensitive material used in the invention is accommodated in the packaging unit frame, the humidity within the packaging unit frame is preferably conditioned so that the relative humidity at 25° C. is in the range of 40 to 70%, more preferably 50 to 65%. It is preferred that the outer packaging be constituted of a moisture impermeable material, for example, nonwater-absorbent material of 0.1% or less absorptivity as measured in accordance with ASTM testing method D-570. It is especially preferred to employ an aluminum foil laminated sheet or an aluminum foil.

As the container for accommodating the exposed lightsensitive material, provided in the packaging unit frame, there can be employed cartridges for outer packaging unit, or common patrones, for example, any of containers described in JP-A's 54-111822 and 63-194255, U.S. Pat. Nos. 4,832,275 and 4,834,306, and JP-A's 2-124564, 3-155544 and 2-264248. The employed film of lightsensitive material can be of the 110-size, 135-size, half size thereof, or 126-size.

The plastic material employed for constituting the packaging unit can be produced by various methods, such as addition polymerization of an olefin having a carbon to carbon double bond, ring-opening polymerization of a few-member cyclic compound, polycondensation (condensation polymerization) or polyaddition of a plurality of polyfunctional compounds, and addition condensation of a phenol derivative, a urea derivative or a melamine derivative and an aldehyde compound.

As the silver halide solvent, there can be employed known compounds. For example, there can preferably be employed thiosulfates, sulfites, thiocyanates, thioether compounds described in JP-B-47-11386, compounds having a 5- or 6-membered imide group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halide as described in JP-A-8-69097 can be used as the silver halide solvent.

These silver halide solvents may be used individually. Also, preferably, a plurality thereof can be used in combination.

The silver halide solvents may be added to the coating liquid in the form of a solution in a solvent such as water, methanol, ethanol, acetone, dimethylformamide or methylpropylglycol, or an alkali or acid aqueous solution, or a solid particulate dispersion.

An organosilver salt which can be employed in the present invention is one that is relatively stable when exposed to light but forms a silver image when heated at 80° C. or higher in the presence of exposed photo-catalyst (for example, latent image of lightsensitive silver halide) and a reducing agent. The organosilver salt may be any organic substance containing a source capable of reducing silver ions. A silver salt of organic acid, especially a silver salt of long-chain aliphatic carboxylic acid (having 10 to 30, preferably 15 to 28, carbon atoms), is preferred. A complex of organic or inorganic silver salt containing a ligand having a complex stability constant of 4.0 to 10.0 is also preferred. A silver supply material can preferably constitute about 5 to 30% by weight of each image forming layer.

Preferred organosilver salts include silver salts of organic compounds having a carboxyl group. Examples thereof include silver salts of aliphatic carboxylic acids and silver salts of aromatic carboxylic acids, to which however the present invention is in no way limited. Preferred examples of aliphatic carboxylic acid silver salts include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Also, use can be made of silver salts of compounds containing a mercapto or thione group or derivatives thereof. Preferred examples of these compounds include silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido) benzothiazole, thioglycolic acid silver salts such as silver salt of s-alkylthioglycolic acid (wherein the alkyl group has 12 to 22 carbon atoms), dithiocarboxylic acid silver salts such as silver salt of dithioacetic acid, thioamide silver salt, silver salt of 5-carboxyl-1-methyl-2-phenyl-4-thiopyridine, mercaptotriazine silver salt, silver salt of 2-mercaptobenzoxazole, silver salts of U.S. Pat. No. 4,123,274 including silver salts of 1,2,4-mercaptothiazole derivatives such as silver salt of 3-amino-5-benzylthio-1,2,4-thiazole, and thione compound silver salts such as silver salt of 3-(3-carboxyethyl)-4-methyl-4-thiazoline-2-thione described in U.S. Pat. No. 3,301,678. Further, use can be made of compounds containing an imino group. Preferred examples of these compounds include benzotriazole silver salts and derivatives thereof, for example, benzotriazole silver salts such as silver salt of methylbenzotriazole and silver salts of halogenated benzotriazoles such as silver salt of 5-chlorobenzotriazole, silver salts of 1,2,4-triazole or 1-H-tetrazole described in U.S. Pat. No. 4,220,709, and silver salts of imidazole and imidazole derivatives. Still further, use can be made of various silver acetylide compounds as described in, for example, U.S. Pat. Nos. 4,761,361 and 4,775,613. These organosilver salts may be used in combination.

The silver halide emulsion and/or organosilver salt of the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

As the antifoggant which can preferably be employed in the present invention, there can be mentioned organic halides, examples of which include compounds disclosed in, for example, JP-A's 50-119624, 50-120328, 51-121332, 54-58022, 56-70543, 56-99335, 59-90842, 61-129642, 62-129845, 6-208191, 7-5621, 7-2781 and 8-15809, and U.S. Pat. Nos. 5,340,712, 5,369,000 and 5,464,737.

The antifoggant for use in the present invention may be added to a coating liquid in the form of any of, for example, a solution, powder and a solid particulate dispersion. The solid particulate dispersion is obtained by the use of known atomizing means (for example, ball mill, vibration ball mill, sand mill, colloid mill, jet mill or roller mill). In the preparation of the solid particulate dispersion, use may be made of a dispersion auxiliary.

The lightsensitive material of the present invention may contain benzoic acids for attaining sensitivity enhancement and fogging prevention. Although the benzoic acids for use in the present invention may be any of benzoic acid derivatives, compounds described in, for example, U.S. Pat. Nos. 4,784,939 and 4,152,160 can be mentioned as providing preferable forms of structures thereof.

The benzoic acids of the present invention, although may be added to any portion of the lightsensitive material, is preferably added to a layer of the lightsensitive layer side, more preferably to a layer containing an organosilver salt. The timing of addition of benzoic acids of the present invention may be any stage of the process for preparing the coating liquid. In the addition to a layer containing an organosilver salt, the addition, although may be effected at any stage between preparation of the organosilver salt to preparation of the coating liquid, is preferably carried out between preparation of the organosilver salt and just before coating operation. With respect to the method of adding the benzoic acids of the present invention, the addition may be effected in the form of, for example, any of powder, a solution and a particulate dispersion. Also, the addition may be effected in the form of a solution wherein the benzoic acid is mixed with other additives such as a sensitizing dye and a reducing agent. The addition amount of benzoic acids of the present invention, although not limited, is preferably in the range of $1\times10^{-6}$ to 2 mol, more preferably $1\times10^{-3}$ to 0.5 mol, per mol of silver.

The lightsensitive material of the present invention can be loaded with a mercapto compound, a disulfide compound and a thione compound in order to control development through development inhibition or acceleration, to enhance spectral sensitization efficiency and to prolong storage life before and after development.

When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, oxygen, selenium or tellurium atom. Preferably, the heteroaromatic ring includes benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heteroaromatic ring may have a substituent, for example, selected from the group consisting of halogens (e.g., Br and Cl), hydroxy, amino, carboxy, alkyls (e.g., alkyls having 1 or more carbon atoms, preferably 1 to 4 carbon atoms) and alkoxies (e.g., alkoxies having 1 or more carbon atoms, preferably 1 to 4 carbon atoms). As mercapto-substituted heteroaromatic compounds, there can be mentioned, for example, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-mercapto-4-phenyloxazole. The present invention is however in no way limited to these.

The addition amount of these mercapto compounds is preferably in the range of 0.001 to 1.0 mol, more preferably 0.01 to 0.3 mol, per mol of silver in an emulsion layer.

In the lightsensitive material of the present invention. there can preferably be employed a silver halide solvent. For example, there can preferably be employed thiosulfates, sulfites, thiocyanates, thioether compounds described in JP-B-47-11386, compounds having a 5- or 6-membered imido group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halides as described in JP-A-8-69097 can be used as the silver halide solvent.

The amount of silver halide solvent contained in the lightsensitive material is in the range of 0.01 to 100 mmol/$m^2$, preferably 0.1 to 50 mmol/$m^2$, and more preferably 10 to 50 mmol/$m^2$. The molar ratio of silver halide solvent to coating silver of the lightsensitive material is in the range of 1/20 to 20, preferably 1/10 to 10, and more preferably 1/3 to 3. The silver halide solvent may be added to a solvent such as water, methanol, ethanol, acetone, dimethylformamide or methylpropylglycol, or an alkali or acid aqueous solution, or may be dispersed so as to form a solid particulate dispersion, before the addition to the coating liquid. The silver halide solvents may be used individually. Also, preferably, a plurality thereof can be used in combination.

In the present invention, after the formation of an image on the lightsensitive material, a color image can be reproduced on another recording material on the basis of information on the image. Although this can be accomplished by customary projection exposure with the use of a lightsensitive material such as color paper, it is preferred to employ a system comprising photoelectrically reading image information through density measurement of transmitted light, converting it to digital signals, effecting image processing, and thereafter outputting, on the basis of the signals, an image on another recording material. The material on which the outputting is effected may be a sublimation-type heat-sensitive recording material, a full color direct heat-sensitive recording material, an ink jet material or an electrophotographic material, as well as the lightsensitive material based on silver halides.

EXAMPLE

Examples of the present invention will be described below, which, however, in no way limit the scope of the present invention.

Example 1

Silver halide emulsions Em-A to Em-O were prepared by the following processes.

(Preparation of Em-A)

1200 milliliters (hereinafter referred to as "mL") of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of succinated gelatin was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 10 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mv. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

Compound 1

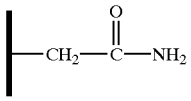

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 μm (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. Under the preparative conditions specified in Table 1, inorganic salts were dissolved in ion-exchanged water, and each of the sensitizing dyes was added. Each sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of the sensitizing dyes was determined by separating the mixture into a solid layer and a liquid layer (supernatant) by centrifugal precipitation and measuring the difference between the amount of initially added sensitizing dyes and the amount of sensitizing dyes present in the supernatant to thereby calculate the amount of adsorbed sensitizing dyes. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

TABLE 1

| Sensitizing dye | Amount of sensitizing dye | $NaNO_3$/ $Na_2SO_4$ | Water | Dispersing time | Dispersing temperature |
|---|---|---|---|---|---|
| 1 | 3 parts by weight | 0.8 parts by weight/ 3.2 parts by weight | 43 parts by weight | 20 min | 60° C. |
| 2/3 | 4 parts by weight/ 0.12 parts by weight | 0.6 parts by weight/ 2.4 parts by weight | 42.8 parts by weight | 20 min | 60° C. |

Sensitizing dye 1

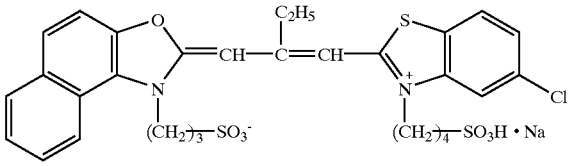

Sensitizing dye 2

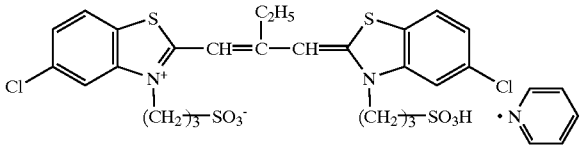

Sensitizing dye 3

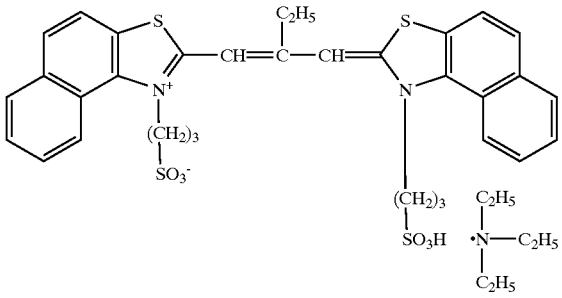

-continued

Compound 2

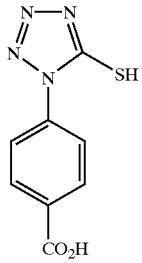

Compound 3

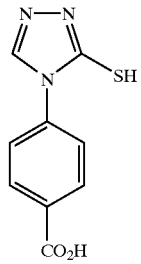

Compound 4

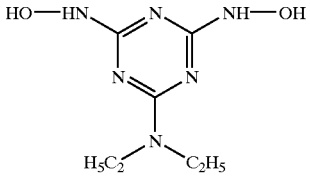

(Preparation of Em-B)

Emulsion Em-B was prepared in the same manner as the emulsion Em-A, except that the amount of KBr added after nucleation was changed to 5 g, that the succinated gelatin was changed to a trimellitated gelatin whose trimellitation ratio was 98%, the gelatin containing methionine in an amount of 35 μmol per g and having a molecular weight of 100,000, that the compound 1 was changed to the following compound 5 whose addition amount in terms of KI was 8.0 g, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

Compound 5

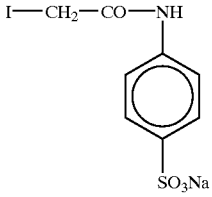

(Preparation of Em-C)

Emulsion Em-C was prepared in the same manner as the emulsion Em-A, except that the amount of KBr added after nucleation was changed to 1.5 g, that the succinated gelatin was changed to a phthalated gelatin whose phthalation ratio was 97%, the gelatin containing methionine in an amount of 35 μmol per g and having a molecular weight of 100,000, that the compound 1 was changed to the following compound 6 whose addition amount in terms of KI was 7.1 g, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

Compound 6

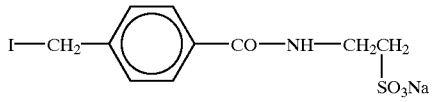

(Preparation of Em-E)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 15 g of succinated gelatin and 20 g of the above trimellitated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mv.

Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. KBr was added so that the potential became −60 mV. Thereafter, 1 mg of sodium benzenethiosulfonate was added, and, further, 13 g of lime-processed gelatin having a calcium concentration of 1 ppm was added. After the completion of the addition, while continuously adding 8.0 g, in terms of KI, of AgI fine grain emulsion of 0.008 μm grain size (equivalent sphere diameter) (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570), an aqueous solution of KBr and 250 mL of an aqueous solution containing 70 g of $AgNO_3$ were added over a period of 20 min with the potential maintained at −60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-A, except that the sensitizing dyes 1, 2 and 3 were changed to the following sensitizing dyes 4, 5 and 6, respectively, whose addition amounts $7.73\times10^{-4}$ mol, $1.65\times10^{-4}$ mol and $6.20\times10^{-5}$ mol, respectively. Thus, Emulsion Em-E was obtained.

Sensitizing dye 4

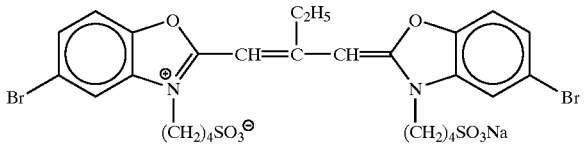

Sensitizing dye 5

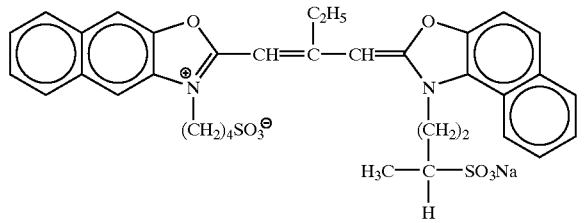

Sensitizing dye 6

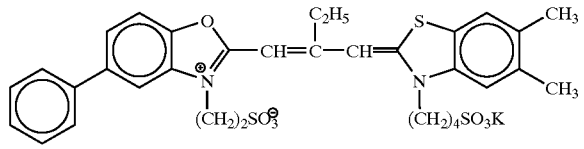

(Preparation of Em-F)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5 g of KBr was added and heated to 75° C., and the mixture was ripened. After the completion of ripening, 20 g of succinated gelatin and 15 g of phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mv against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mv.

Still further, an aqueous solution of KBr and 132 mL of an aqueous solution containing 35 g of $AgNO_3$ were added by the double jet method over a period of 7 min. An aqueous solution of KBr was added so as to regulate the potential to −60 mV. Thereafter, 9.2 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-B, except that the sensitizing dyes 1, 2 and 3 were changed to the sensitizing dyes 4, 5 and 6, respectively, whose addition amounts were $8.50\times10^{-4}$ mol, $1.82\times10^{-4}$ mol and $6.82\times10^{-5}$ mol, respectively. Thus, Emulsion Em-F was obtained.

(Preparation of Em-G)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 1.5 g of KBr was added and heated to 75° C., and the mixture was ripened. After the completion of ripening, 15 g of the above trimellitated gelatin and 20 g of the above phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mv.

Still further, an aqueous solution of KBr and 132 mL of an aqueous solution containing 35 g of $AgNO_3$ were added by the double jet method over a period of 7 min. The addition of the aqueous solution of KBr was regulated so that the potential became −60 mV. Thereafter, 7.1 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate of potash was added in an amount of $1.0\times10^{5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-C, except that the sensitizing dyes 1, 2 and 3 were changed to the sensitizing dyes 4, 5 and 6, respectively, whose addition amounts were $1.00\times10^{-3}$ mol, $2.15\times10^{-4}$ mol and $8.06\times10^{-5}$ mol, respectively. Thus, Emulsion Em-G was obtained.

(Preparation of Em-J)

Emulsion Em-J was prepared in the same manner as the emulsion Em-B, except that the sensitizing dyes added prior to the chemical sensitization were changed to the following sensitizing dyes 7 and 8 whose addition amounts were $7.65\times10^{-4}$ mol and $2.74\times10^{-4}$ mol, respectively.

Sensitizing dye 7

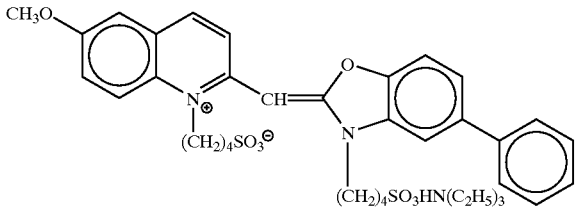

Sensitizing dye 8

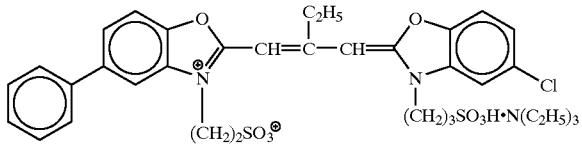

(Preparation of Em-L)

(Preparation of Silver Bromide Seed Crystal Emulsion)

A silver bromide tabular emulsion having an average equivalent sphere diameter of 0.6 μm and an aspect ratio of 9.0 and containing 1.16 mol of silver and 66 g of gelatin per kg of emulsion was prepared.

(Growth Step 1)

0.3 g of a modified silicone oil was added to 1250 g of an aqueous solution containing 1.2 g of potassium bromide and a succinated gelatin whose succination ratio was 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above 0.037 μm silver iodide fine grains were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, the above 0.037 μm silver iodide fine grains were added in an amount of 7.0 mol % per silver that is added during the double jet addition mentioned above. The amount of potassium bromide added by double jet was regulated so that the pAg was 8.1. After the completion of the addition, 2 mg of sodium benzenethiosulfonate was added.

(Growth Step 3)

An aqueous solution containing 19.5 g of silver nitrate and an aqueous solution of potassium bromide were added by double jet over a period of 16 min. During this period, the amount of the aqueous solution of potassium bromide was regulated so that the pAg was 7.9.

(Addition of Sparingly Soluble Silver Halide Emulsion 4)

The above host grains were adjusted to 9.3 in pAg with the use of an aqueous solution of potassium bromide. Thereafter, 25 g of the above 0.037 $\mu$m silver iodide fine grain emulsion was rapidly added within a period of 20 sec.

(Formation of Outermost Shell Layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 $\mu$m, wherein the average silver iodide content was 5.5 mol %.

(Chemical Sensitization)

The emulsion was washed, and a succinated gelatin whose succination ratio was 98% and calcium nitrate were added. At 40° C., the pH and pAg were adjusted to 5.8 and 8.7, respectively. The temperature was raised to 60° C., and $5\times10^{-3}$ mol of 0.07 $\mu$m silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 7 was added at the completion of the chemical sensitization. The terminology "optimum chemical sensitization" used herein means that the sensitizing dyes and compounds are added in an amount selected from among the range of $10^{-1}$ to $10^{-8}$ mol per mol of silver halide so that the speed exhibited when exposure is conducted at 1/100 becomes the maximum.

Sensitizing dye 9

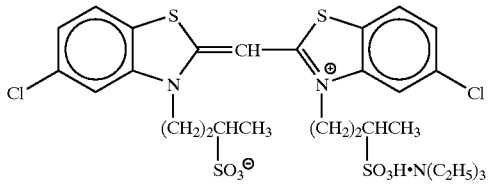

Sensitizing dye 10

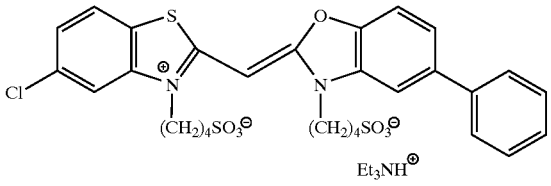

-continued

Sensitizing dye 11

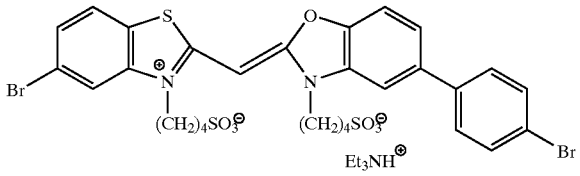

Compound 7

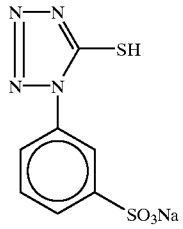

(Preparation of Em-O)

An aqueous solution of gelatin (1250 mL of distilled water, 48 g of deionized gelatin and 0.75 g of KBr) was placed in a reaction vessel equipped with an agitator. The temperature of the aqueous solution was maintained at 70° C. 276 mL of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 mL of thiourea dioxide (0.05% by weight) was added.

Subsequently, 592.9 mL of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 mL of thiosulfonic acid (0.1% by weight) was added 5 min before the completion of the addition.

The obtained grains consisted of cubic grains having an equivalent sphere diameter of 0.19 $\mu$m and an average silver iodide content of 1.8 mol %.

The obtained emulsion Em-O was desalted and washed by the conventional flocculation method, and re-dispersed. At 40° C., the pH and pAg were adjusted to 6.2 and 7.6, respectively.

The resultant emulsion Em-O was subjected to the following spectral and chemical sensitization.

Based on silver, $3.37\times10^{-4}$ mol/mol of each of sensitizing dye 10, sensitizing dye 11 and sensitizing dye 12, $8.82\times10^{-4}$ mol/mol of KBr, $8.83\times10^{-5}$ mol/mol of sodium thiosulfate, $5.95\times10^{-4}$ mol/mol of potassium thiocyanate and $3.07\times10^{-5}$ mol/mol of potassium chloroaurate were added. Ripening thereof was performed at 68° C. for a period, which period was regulated so that the speed exhibited when exposure was conducted at 1/100 became the maximum.

Sensitizing dye 12

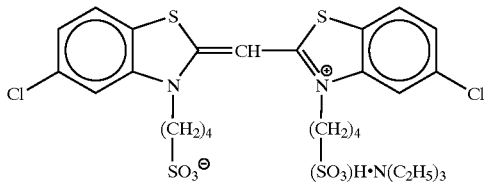

(Preparation of Em-A')

Em-A' was prepared in the same manner as Em-A, except for the following changes.

Nonmodified gelatin (conventional alkali-terated ossein gelatin) was used in place of sucinated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-B')

Em-B' was prepared in the same manner as Em-A, except for the following changes.

The amount of KBr added after nucleation was changed to 5 g.

Nonmodified gelatin was used in place of succinated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-C')

Em-C' was prepared in the same manner as Em-C, except for the following changes.

Nonmodified gelatin was used in place of the replacement of succinated gelatin by phthalated gelatin.

Not only were the amounts of sensitizing dyes changed in conformity with the surface area of grains to thereby attain the optimum spectral sensitization but also the amounts of chemical sensitizers were optimally regulated.

(Preparation of Em-E')

Em-E' was prepared in the same manner as Em-E, except for the following changes.

35 g of nonmodified gelatin was used in place of the succinated gelatin and trimellitated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-F')

Em-F' was prepared in the same manner as Em-F, except for the following changes.

35 g of nonmodified gelatin was used in place of the succinated gelatin and trimellitated gelatin. The potential at the second-stage and third-stage $AgNO_3$ additions was maintained at 0 mV in place of −25 mV.

Not only were the amounts of sensitizing dyes changed in conformity with the surface area of grains to thereby attain the optimum spectral sensitization but also the amounts of chemical sensitizers were optimally regulated.

(Preparation of Em-G')

Em-G' was prepared in the same manner as Em-G, except for the following changes.

35 g of nonmodified gelatin was used in place of the succinated gelatin and trimellitated gelatin.

Not only were the amounts of sensitizing dyes changed in conformity with the surface area of grains to thereby attain the optimum spectral sensitization but also the amounts of chemical sensitizers were optimally regulated.

(Preparation of Em-J')

Em-J' was prepared in the same manner as Em-J, except for the following changes.

Sensitizing dyes 7, 8 were added before the chemical sensitization in place of the sensitizing dyes 1, 2, and 3.

Not only were the amounts of sensitizing dyes changed in conformity with the surface area of grains to thereby attain the optimum spectral sensitization but also the amounts of chemical sensitizers were optimally regulated.

(Preparation of Em-L')

Em-L' was prepared in the same manner as Em-L, except for the following changes.

In the preparation of the silver bromide seed crystal emulsion mentioned above, a silver bromide tabular emulsion of 6.0 aspect ratio was prepared in place of the silver bromide tabular emulsion of 9.0 aspect ratio.

Further, in the growth step 1, in place of the succinated gelatin, an equal amount of nonmodified gelatin was used.

Not only were the amounts of sensitizing dyes changed in conformity with the surface area of grains to thereby attain the optimum spectral sensitization but also the amounts of chemical sensitizers were optimally regulated.

(Em-D, H, I, K, M, N, and N')

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 2 and sodium thiocyanate in conformity with Examples of JP-A-3-237450. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of JP-A-2-191938.

TABLE 2

| Emulsion | Sensitizing dye | Addition amount (mol/mol Ag) |
|---|---|---|
| Em-D | Sensitizing dye 1 | $7.07 \times 10^{-4}$ |
| | Sensitizing dye 2 | $3.06 \times 10^{-4}$ |
| | Sensitizing dye 3 | $9.44 \times 10^{-6}$ |
| Em-H | Sensitizing dye 8 | $7.82 \times 10^{-4}$ |
| | Sensitizing dye 13 | $1.62 \times 10^{-4}$ |
| | Sensitizing dye 6 | $2.98 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |

TABLE 2-continued

| Emulsion | Sensitizing dye | Addition amount (mol/mol Ag) |
|---|---|---|
| Em-N | Sensitizing dye 9 | $3.77 \times 10^{-4}$ |
| | Sensitizing dye 10 | $3.77 \times 10^{-4}$ |
| | Sensitizing dye 11 | $3.77 \times 10^{-4}$ |
| Em-N' | Sensitizing dye 9 | $3.00 \times 10^{-4}$ |
| | Sensitizing dye 10 | $3.00 \times 10^{-4}$ |
| | Sensitizing dye 11 | 3.00 × 10−4 |

Sensitizing dye 13

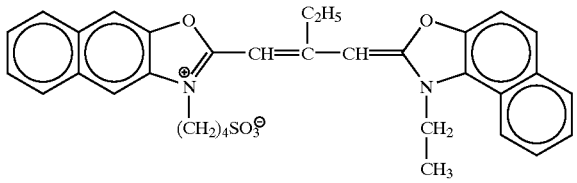

TABLE 3

| Emulsion | Average iodide content (mol %) | Equivalent sphere diameter (μm) | Aspect ratio | Equivalent circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 4.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 6.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 7.2 | 0.55 | 0.12 | Tabular |
| Em-O | 1.8 | 0.19 | — | — | — | Cubic |
| Em-A' | 4 | 0.92 | 6 | 1.51 | 0.25 | Tabular |
| Em-B' | 5 | 0.8 | 5 | 1.20 | 0.24 | Tabular |
| Em-C' | 4.7 | 0.51 | 4 | 0.71 | 0.18 | Tabular |
| Em-E' | 5 | 0.92 | 6 | 1.50 | 0.25 | Tabular |
| Em-F' | 5.5 | 0.8 | 6 | 1.29 | 0.21 | Tabular |
| Em-G' | 4.7 | 0.51 | 4 | 0.71 | 0.18 | Tabular |
| Em-J' | 5 | 0.8 | 6 | 1.29 | 0.21 | Tabular |
| Em-L' | 5.5 | 1.4 | 6 | 2.22 | 0.37 | Tabular |

Referring to Table 3, it was observed, through high-voltage electron microscope, that in the tabular emulsions grains having 10 or more dislocation lines per grain accounted for 50% or more (grain numerical ratio).

1) Support

The support employed in this Example was prepared by the following procedure.

1) First Layer and Substratum

Both major surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/$m^2$. This support was coated, in a coating amount of 5 mL/$m^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts. wt. |
| Gelatin | 0.5 pt. wt. |
| Water | 49 pts. wt. |
| Polyglycerol polyglycidyl ether | 0.16 pt. wt. |
| Polyoxyethylene sorbitan monolaurate (polymn. degree 20) | 0.1 pt. wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/$m^2$, with a coating liquid of the following composition to provide a substratum for emulsion in accordance with the bar coating method.

| | |
|---|---|
| Gelatin | 1.01 pts. wt. |
| Salicylic acid | 0.30 pt. wt. |
| Resorcin | 0.40 pt. wt. |
| Polyoxyethylene nonylphenyl ether (polymn. degree 10) | 0.11 pt. wt. |
| Water | 3.53 pts. wt. |
| Methanol | 84.57 pts. wt. |
| n-Propanol | 10.08 pts. wt. |

Furthermore, the following second layer and third layer were superimposed in this sequence on the first layer by coating. Finally, multilayer coating of a color negative lightsensitive material of the composition indicated below was performed on the opposite side. Thus, a transparent magnetic recording medium with silver halide emulsion layers was obtained.

2) Second Layer (Transparent Magnetic Recording Layer)

(1) Dispersion of Magnetic Substance 1100 parts by weight of Co-coated $\gamma$-$Fe_2O_3$ magnetic substance (average major axis length: 0.25 $\mu$m, SBET: 39 $m^2/g$, Hc: 831, Oe, $\sigma s$: 77.1 emu/g, and $\sigma r$: 37.4 emu/g), 220 parts by weight of water and 165 parts by weight of silane coupling agent (3-(poly(polymerization degree: 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (¼ G sand mill) at 2000 rpm for 4 hr. Glass beads of 1 mm diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance containing intermediate liquid was prepared.

(2) Preparation of Magnetic Substance Containing Intermediate Liquid

| | |
|---|---|
| Thus obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance containing intermediate liquid".

An $\alpha$-alumina abrasive dispersion of the present invention was produced in accordance with the following recipe.

(a) Preparation of Sumicorundum AA-1.5 (average primary grain diameter: 1.5 $\mu$m, specific surface area: 1.3 $m^2/g$) grain dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g |

In accordance with the above recipe, fine dispersion was carried out by means of a ceramic-coated sand mill (¼ G sand mill) at 800 rpm for 4 hr. Zirconia beads of 1 mm diameter were used as medium.

(b) Colloidal silica grain dispersion (fine grains)

Use was made of "MEK-ST" produced by Nissan Chemical Industries, Ltd.

This is a dispersion of colloidal silica of 0.015 $\mu$m average primary grain diameter in methyl ethyl ketone as a dispersion medium, wherein the solid content is 30%.

(3) Preparation of a Coating Liquid for Second Layer

| | |
|---|---|
| Thus obtained magnetic substance containing intermediate liquid | 19,053 g |
| Diacetylcellulose soln. (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent:, methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 $mL/m^2$ with the use of a wire bar. Drying was performed at 110° C. The thickness of magnetic layer after drying was 1.0 $\mu$m.

3) Third Layer (Higher Fatty Acid Ester Sliding agent Containing Layer)

(1) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

Liquid A:

Compd. of the formula:

| | |
|---|---|
| $C_6H_{13}CH(OH)(CH_2)_{10}COOC_{50}H_{101}$ | 399 pts. wt. |
| Compd. of the formula: $n\text{-}C_{50}H_{101}O(CH_2CH_2O)_{16}H$ | 171 pts. wt. |
| Cyclohexanone | 830 pts. wt. |
| Liquid B: Cyclohexanone | 8600 pts. wt. |

(2) Preparation of Spherical Inorganic Grain Dispersion

Spherical inorganic grain dispersion (cl) was prepared in accordance with the following recipe.

| | |
|---|---|
| Isopropyl alcohol | 93.54 pts. wt. |
| Silane coupling agent KBM903 (produced by Shin-Etsu Silicone) Cmpd. 1-1: $(CH_3O)_3Si—(CH_2)_3—NH_2$) | 5.53 pts. wt. |
| Compd. 8 Compound 8 | 2.93 pts. wt. |

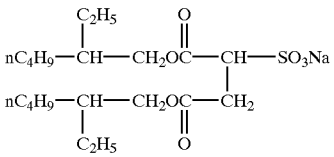

-continued

| | |
|---|---|
| Seahostar KEP50 (amorphous spherical silica, av. grain size 0.5 μm, produced by Nippon Shokubai Kagaku Kogyo | 88.00 pts. wt. |
| This composition was agitated for 10 min, and further the following was added. | |
| Diacetone alcohol | 252.93 pts. wt. |

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of Spherical Organic Polymer Grain Dispersion

| | |
|---|---|
| XC99-A8808 (produced by Toshiba Silicone Co., Ltd., spherical crosslinked polysiloxane grain, av. grain size 0.9 μm) | 60 pts.wt. |
| Methyl ethyl ketone | 120 pts.wt. |
| Cyclohexanone | 120 pts.wt. |

(solid content 20%, solvent: methyl ethyl ketone/cyclohexanone=1/1)

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC341 (produced by 3M, solid content 50%, solvent: ethyl acetate) | 2.65 g |
| BYK310 (produced by BYK ChemiJapan, solid content 25%) | 5.3 g. |

The above 3rd-layer coating liquid was applied to the 2nd layer in a coating amount of 10.35 mL/m$^2$, dried at 110° C. and further postdried at 97° C. for 3 min.

4) Application of Lightsensitive Layer by Coating

The thus obtained back layers on its side opposite to the support were coated with a plurality of layers of the following respective compositions, thereby obtaining a color negative film.

(Composition of Lightsensitive Layer)

Main materials used in each of the layers are classified as follows:

ExC: cyan coupler,

ExM: magenta coupler,

ExY: yellow coupler,

UV: ultraviolet absorber,

HBS: high b.p. org. solvent,

H: gelatin hardner.

(For each specific compound, in the following description, numeral is assigned after the character, and the formula is shown later).

The numeric value given beside the description of each component is for the coating amount expressed in the unit of g/m$^2$. With respect to the silver halide and colloidal silver, the coating amount is in terms of silver quantity.

| | | |
|---|---|---|
| 1st layer (First antihalation layer) | | |
| Black colloidal silver | silver | 0.002 |
| 0.07 μm silver iodobromide emulsion | silver | 0.01 |
| Gelatin | | 0.919 |
| ExM-1 | | 0.066 |
| ExC-1 | | 0.002 |
| ExC-3 | | 0.001 |
| Cpd-2 | | 0.001 |
| F-8 | | 0.010 |
| Solid disperse dye ExF-7 | | 0.10 |
| Cpd-2 | | 0.001 |
| HBS-1 | | 0.005 |
| HBS-2 | | 0.002 |
| 2nd layer (Second antihalation layer) | | |
| Black colloidal silver | silver | 0.001 |
| Gelatin | | 0.425 |
| ExF-1 | | 0.002 |
| F-8 | | 0.012 |
| Solid disperse dye ExF-7 | | 0.240 |
| HBS-1 | | 0.074 |
| 4th layer (Low-speed red-sensitive emulsion layer) | | |
| Em-D | silver | 0.577 |
| Em-C' | silver | 0.347 |
| ExC-1 | | 0.188 |
| ExC-2 | | 0.005 |
| ExC-3 | | 0.075 |
| ExC-4 | | 0.121 |
| ExC-5 | | 0.005 |
| ExC-6 | | 0.007 |
| ExC-8 | | 0.050 |
| ExC-9 | | 0.020 |
| Cpd-2 | | 0.025 |
| Cpd-4 | | 0.025 |
| HBS-1 | | 0.114 |
| HBS-5 | | 0.038 |
| Gelatin | | 1.474 |
| 5th layer (Medium-speed red-sensitive emulsion layer) | | |
| Em-B' | silver | 0.431 |
| Em-C' | silver | 0.432 |
| ExC-1 | | 0.154 |
| ExC-2 | | 0.002 |
| ExC-3 | | 0.018 |
| ExC-4 | | 0.103 |
| ExC-5 | | 0.001 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 1.086 |
| 6th layer (High-speed red-sensitive emulsion layer) | | |
| Em-A' | silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.064 |
| Cpd-4 | | 0.077 |
| HBS-1 | | 0.329 |
| HBS-2 | | 0.120 |
| Gelatin | | 1.245 |
| 7th layer (Interlayer) | | |
| Cpd-1 | | 0.094 |
| Cpd-6 | | 0.369 |
| Solid disperse dye ExF-4 | | 0.030 |
| HBS-1 | | 0.049 |

-continued

| | | |
|---|---|---|
| Polyethyl acrylate latex | | 0.088 |
| Gelatin | | 0.886 |
| 8th layer (Layer capable of exerting interlayer effect on red-sensitive layer) | | |
| Em-J' | silver | 0.293 |
| Em-K | silver | 0.293 |
| Cpd-4 | | 0.030 |
| ExM-2 | | 0.120 |
| ExM-3 | | 0.005 |
| ExM-4 | | 0.026 |
| ExY-1 | | 0.016 |
| ExY-4 | | 0.036 |
| ExC-7 | | 0.026 |
| HBS-1 | | 0.090 |
| HBS-3 | | 0.003 |
| HBS-5 | | 0.030 |
| Gelatin | | 0.610 |
| 9th layer (Low-speed green-sensitive emulsion layer) | | |
| Em-H | silver | 0.329 |
| Em-G' | silver | 0.333 |
| Em-I | silver | 0.088 |
| ExM-2 | | 0.378 |
| ExM-3 | | 0.020 |
| ExY-1 | | 0.017 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium-speed green-sensitive emulsion layer) | | |
| Em-F' | silver | 0.457 |
| ExM-2 | | 0.032 |
| ExM-3 | | 0.029 |
| ExM-4 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| Em-E' | silver | 0.794 |
| ExC-6 | | 0.002 |
| ExC-8 | | 0.010 |
| ExM-1 | | 0.013 |
| ExM-2 | | 0.011 |
| ExM-3 | | 0.020 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |
| Oil soluble dye ExF-6 | | 0.010 |
| HBS-1 | | 0.049 |
| Gelatin | | 0.630 |
| 13th layer (Low-speed blue-sensitive emulsion layer) | | |
| Em-O | silver | 0.112 |
| Em-M | silver | 0.320 |
| Em-N' | silver | 0.240 |

-continued

| | | |
|---|---|---|
| ExC-1 | | 0.027 |
| ExC-7 | | 0.013 |
| ExY-1 | | 0.002 |
| ExY-2 | | 0.890 |
| ExY-4 | | 6.058 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| Em-L' | silver | 0.714 |
| ExY-2 | | 0.211 |
| ExY-4 | | 0.068 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07 μm silver iodobromide emulsion | silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750 |

In addition to the above components, W-1 to E-6, B-4 to B-6, F-1 to F-17, a lead salt, a platinum salt, an iridium salt and a rhodium salt were appropriately added to the individual layers in order to improve the storage life, processability, resistance to pressure, antiseptic and mildew-proofing properties, antistatic properties and coating property thereof.

Preparation of dispersion of organic solid disperse dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total | 7.210 kg |

(adjusted to pH=7.2 with NaOH).

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-7 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

The compounds used in the preparation of each of the layers will be listed below.

ExC-1

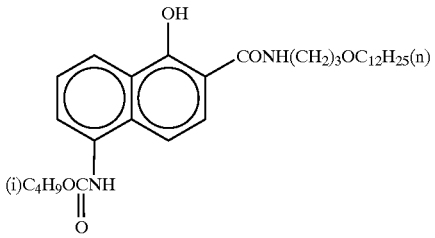

ExC-2

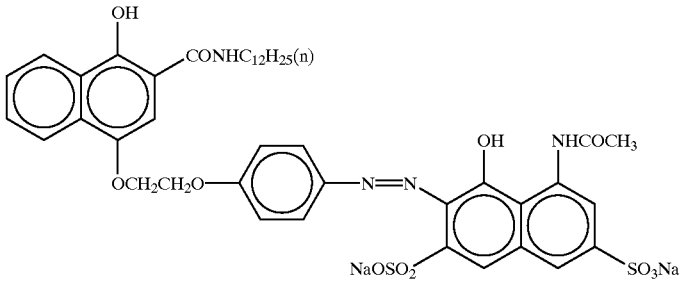

ExC-3

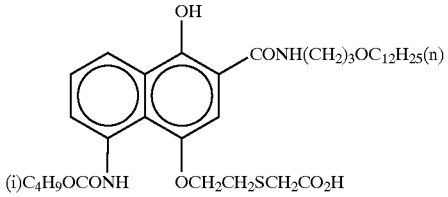

ExC-4

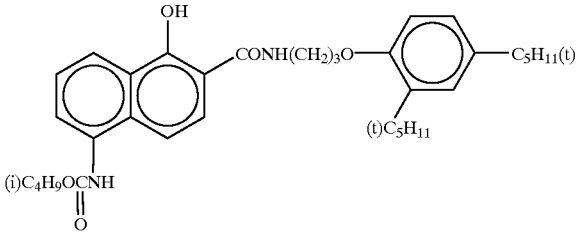

ExC-5

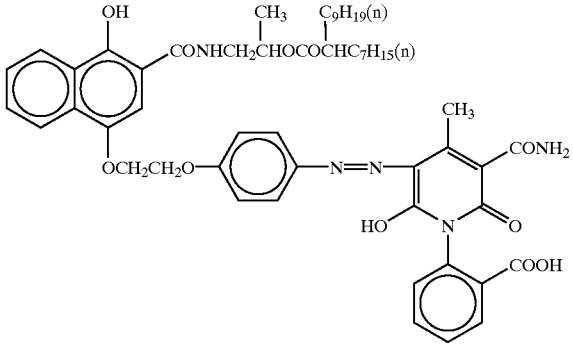

ExC-6

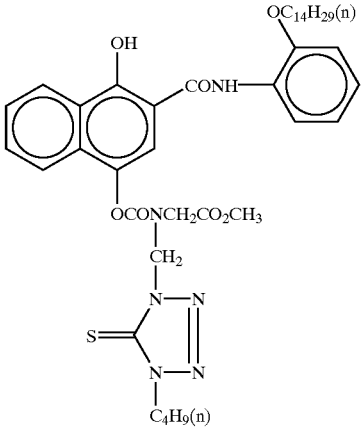

ExC-7

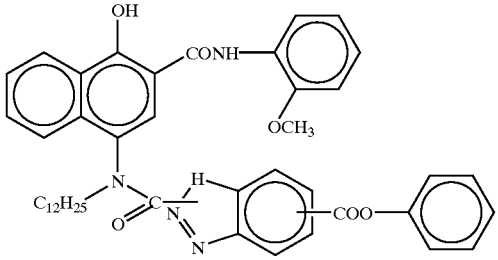

-continued
ExC-8
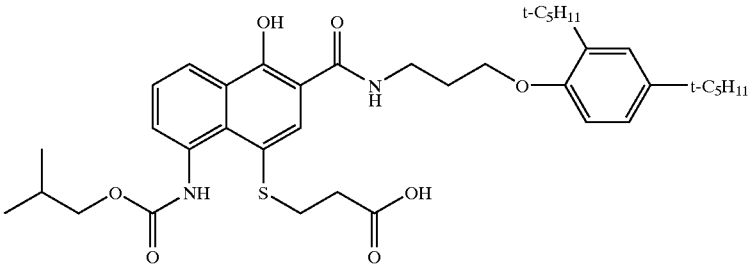
ExC-9
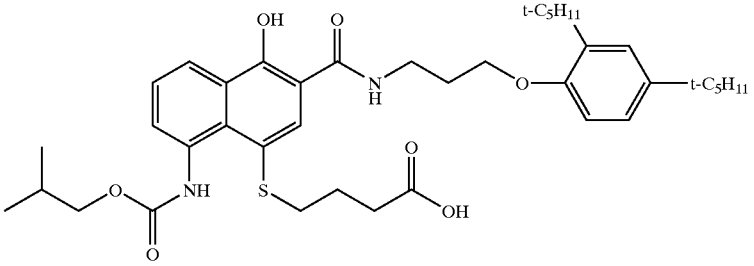
ExM-1
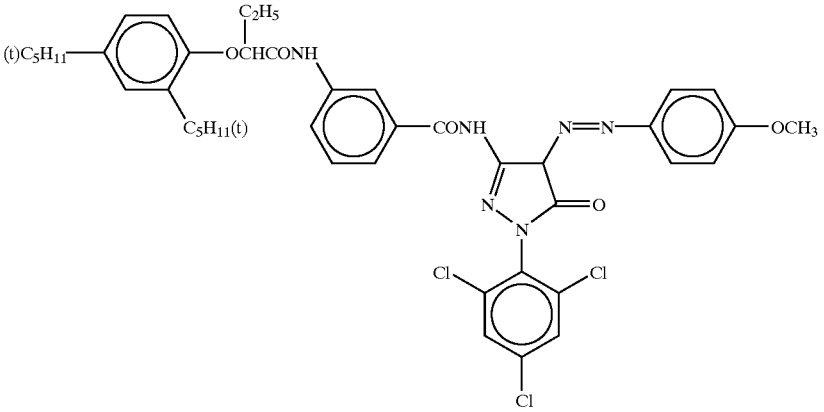
ExM-2
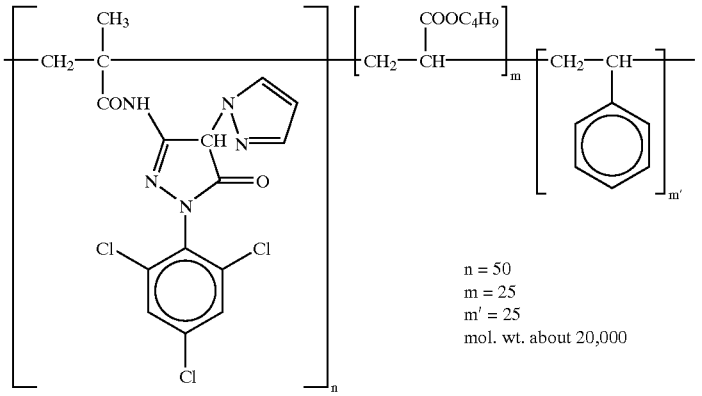
n = 50
m = 25
m' = 25
mol. wt. about 20,000

-continued
ExM-3
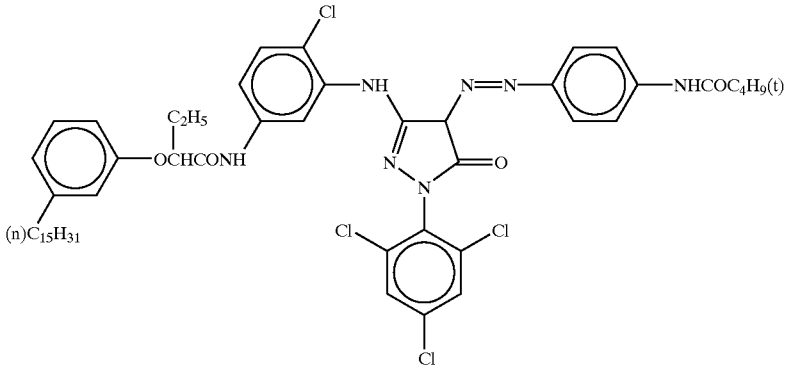
ExM-4
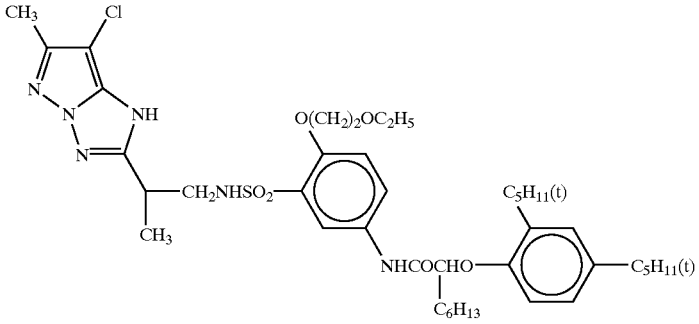
ExY-1
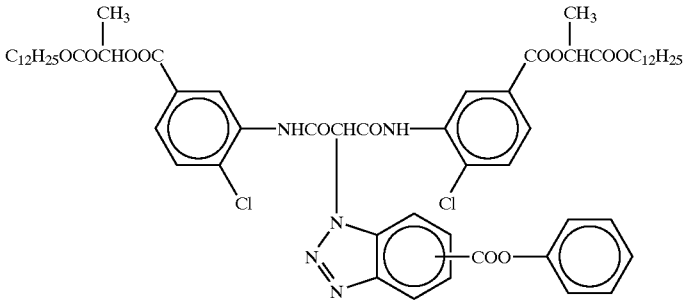
ExY-2
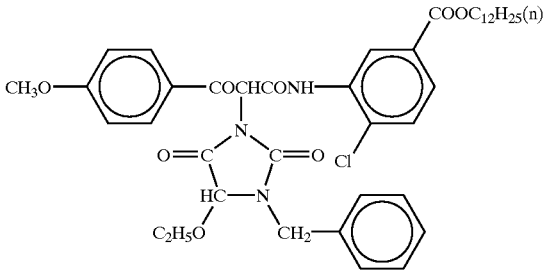
ExY-3
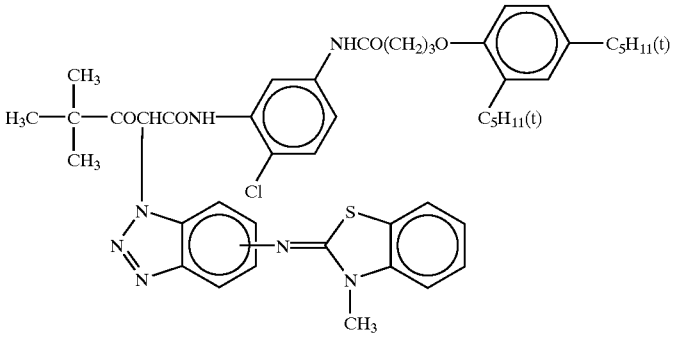

-continued
ExY-4
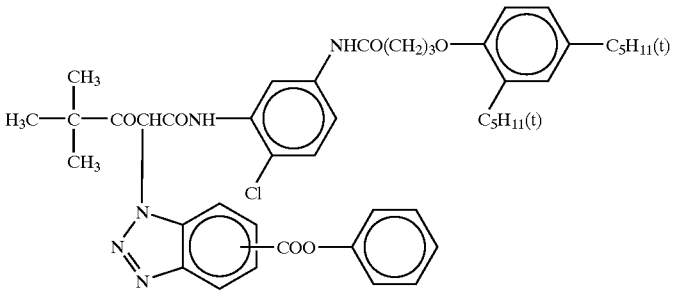
Cpd-1
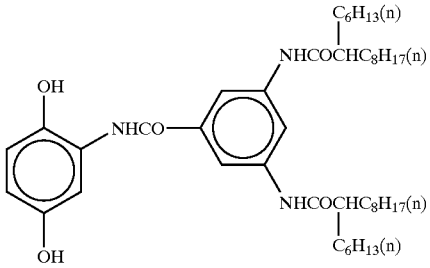
Cpd-3
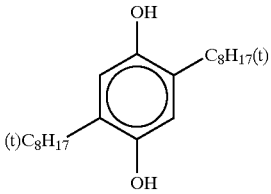
Cpd-2
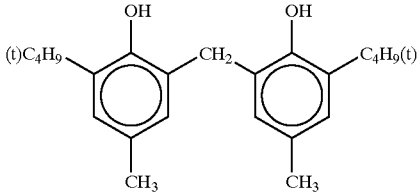
Cpd-5
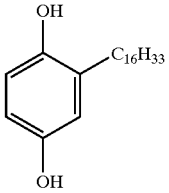
Cpd-4
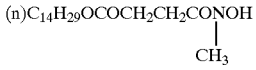
Cpd-6
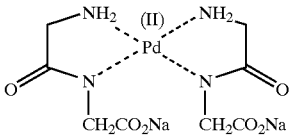
UV-1
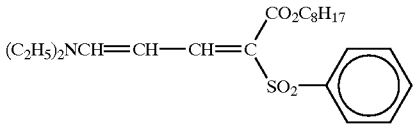
UV-2
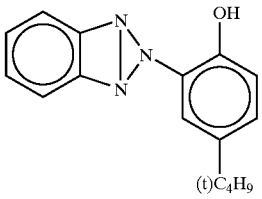
UV-3
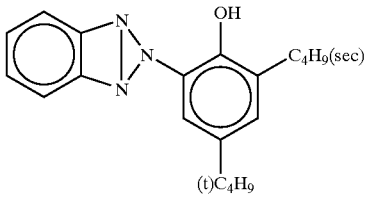
UV-4
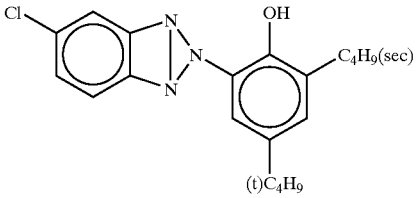
B-1
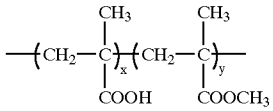
x/y = 10/90 (Weight ratio)
Average mol. wt.:
about 35,000
B-2
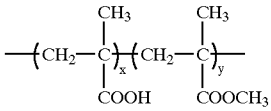
x/y = 40/60 (Weight ratio)
Average mol. wt.:
about 20,000

-continued
B-3
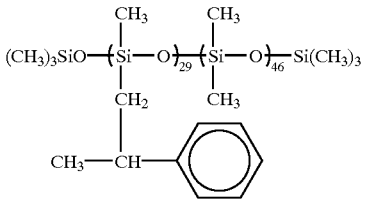
(molar ratio)
Average mol. wt.: about 8,000
HBS-1
Tricresyl phosphate
HBS-2
Di-n-butyl phthalate
HBS-3
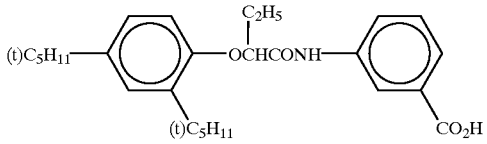
HBS-4
Tri(2-ethylhexyl)phosphate
HBS-5
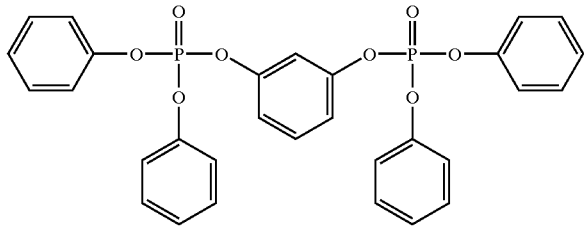
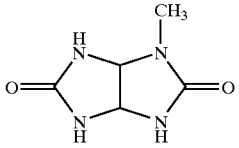
S-1
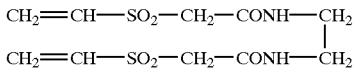
H-1
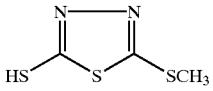
F-1
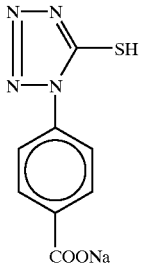
F-2
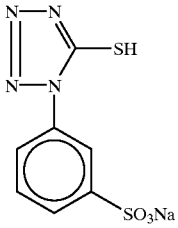
F-3
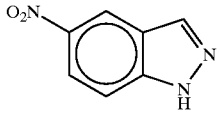
F-4
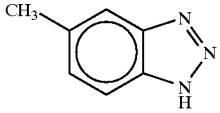
F-5
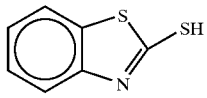
F-6

-continued
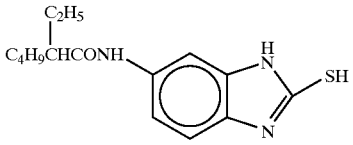
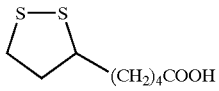
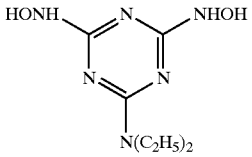
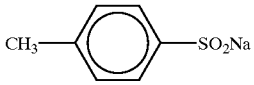
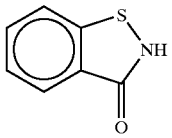
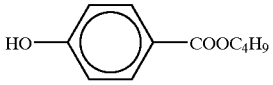
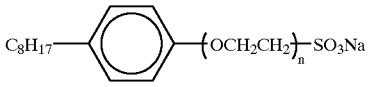
n = 2 ~ 4
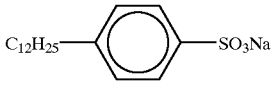
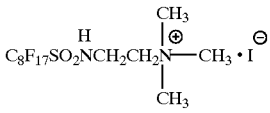
F-7
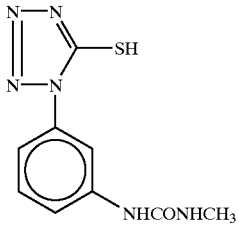
F-8
F-9
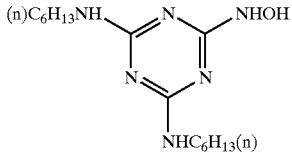
F-10
F-11
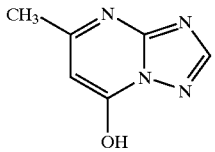
F-12
F-13
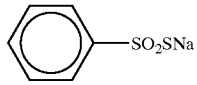
F-14
F-15
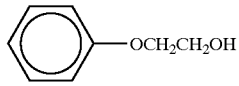
F-16
F-17
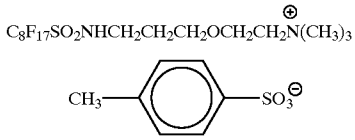
W-1
W-2
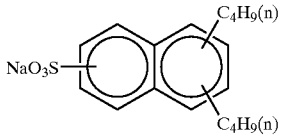
W-3
W-4
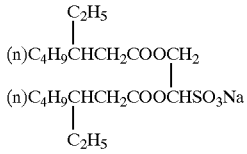
W-5
W-6
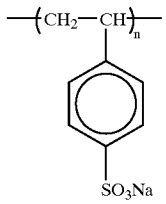
Average mol. wt.:
about 750,000
B-4

-continued

B-5

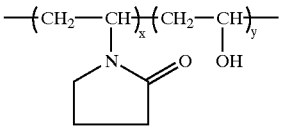

x/y = 70/30 (Weight ratio)

Average mol. wt.: about 17,000

B-6

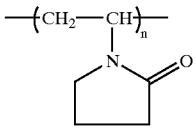

Average mol. wt.: about 10,000

ExF-1

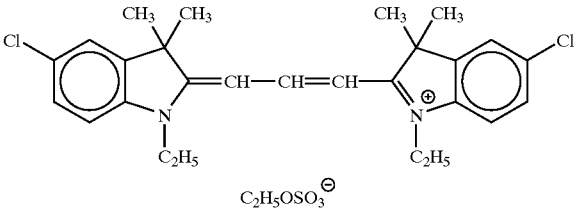

ExF-2

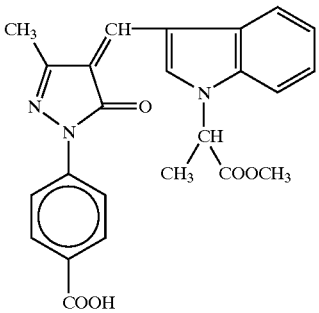

ExF-4

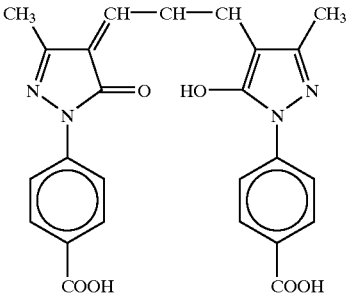

ExF-5

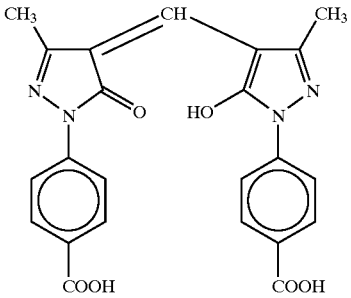

ExF-6

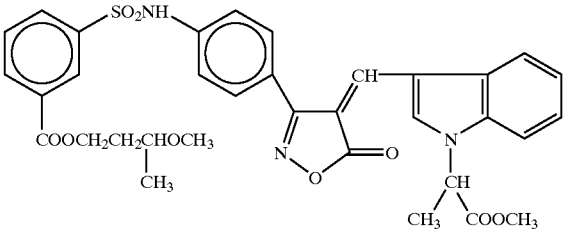

ExF-7

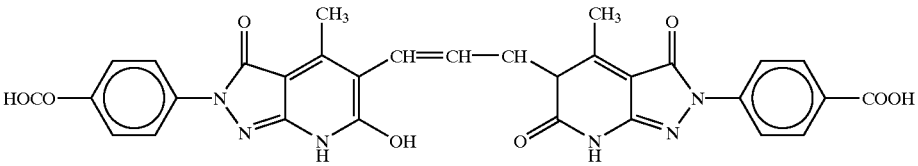

The above silver halide color photographic lightsensitive material was designated sample 101.

(Preparation of Sample 102)

Sample 102 was prepared in the same manner as sample 101, except that, in the 11th layer, the developing agent precursor DEVP-1 was incorporated in a molar amount of 1.2 times that of the coupler of the 11th layer.

(Preparation of Sample 103)

Sample 103 was prepared in the same manner as sample 101, except that, in the 11th layer, the emulsion Em-E' was replaced by emulsion Em-E.

(Preparation of Samples 104 to 107)

Samples 104 to 107 were prepared in the same manner as sample 103, except that, in the 11th layer, the developing agent precursor DEVP-1 was replaced by developing agents listed in Table 4.

(Preparation of Sample 108)

Sample 108 was prepared in the same manner as sample 103, except that, in the 11th layer, the emulsion Em-E was replaced by an emulsion with an aspect ratio of 9 which was prepared in substantially the same manner as the emulsion Em-E.

(Preparation of Sample 109)

Sample 109 was prepared in the same manner as sample 103, except that, in the 11th layer, the emulsion Em-E was replaced by an emulsion with an aspect ratio of 4 which was prepared in substantially the same manner as the emulsion Em-E.

(Preparation of Sample 110)

Sample 110 was prepared in the same manner as sample 103, except that the developing agent precursor of the 11th layer was removed and that an equal amount thereof was incorporated in the 12th layer.

(Preparation of Sample 111)

Sample 111 was prepared in the same manner as sample 103, except that the developing agent precursor DEVP-1 of the 11th layer was removed.

The thus obtained samples were subjected to a 1000 lux 1/100 sec wedge exposure using white light of 5500 K color temperature and developed through the following development process A.

(Processing Steps A)

| Step | Time | Temp. | Qty. of replenisher* | Tank vol. |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide lightsensitive material (equivalent to one role of 24 Ex. film).

The stabilizer was fed from stabilization (2) to stabilization (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |

-continued

| (Color developer) | Tank soln. (g) | Replenisher (g) |
|---|---|---|
| Water | q.s. ad 1.0 L | |
| pH | 10.05 | 10.18. |

This pH was adjusted by the use of potassium hydroxide and sulfuric acid.

| (Bleaching soln.) | Tank soln. (g) | Replenisher (g) |
|---|---|---|
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad 1.0 L | |
| pH | 4.6 | 4.0. |

This pH was adjusted by the use of aqueous ammonia.

(Fixing (1) tank soln.)

5:95 (by volume) mixture of the above bleaching tank soln. and the following fixing tank soln, pH 6.8.

| (Fixing (2)) | Tank soln. (g) | Replenisher (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water | q.s. ad 1.0 L | |
| pH | 7.4 | 7.45. |

This pH was adjusted by the use of aqueous ammonia and acetic acid.

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

| (Stabilizer): common to tank solution and replenisher. | (g) |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl)-piperazine | 0.75 |

-continued

| (Stabilizer): common to tank solution and replenisher. | (g) |
|---|---|
| Water | q.s. ad 1.0 L |
| pH | 8.5 |

With respect to the developed samples, the density was measured and the sensitivity was determined.

The sensitivity was given as the logarithm of inverse number of exposure quantity required for a magenta color image density to exhibit the minimum density+0.1 and expressed as a relative value to that of sample 101.

The graininess was evaluated by measuring the RMS granularity at a density of fog+0.1. The RMS granularity was expressed as a relative value to that of sample 101 providing that the latter was 100.

The average number of development initiating points per emulsion grain in the 11th layer was determined by the method described in the descriptive portion hereof (counted with respect to 100 grains).

The results are listed in Table 4.

TABLE 4

| Sample No. | Developing agent or its precursor in 11th layer | Number of development initiating point per grain in emulsion of 11th layer (Average among 100 grains) | Sensitivity | Graininess | Remarks |
|---|---|---|---|---|---|
| 101 | none | 2.0 | ±0.0 | 100 | Comparison |
| 102 | DEVP-1 | 3.1 | +0.10 | 110 | Invention |
| 103 | DEVP-1 | 4.1 | +0.15 | 120 | Invention |
| 104 | D-1 | 4.2 | +0.15 | 120 | Invention |
| 105 | D-21 | 4.5 | +0.18 | 124 | Invention |
| 106 | D-27 | 4.1 | +0.15 | 118 | Invention |
| 107 | D-32 | 3.7 | +0.17 | 120 | Invention |
| 108 | D-47 | 3.6 | +0.16 | 120 | Invention |
| 109 | DEVP-1 | 3.0 | +0.09 | 110 | Invention |
| 110 | DEVP-1 | 3.1 | +0.10 | 110 | Invention |
| 111 | none | 2.3 | +0.03 | 103 | Comparison |

It is apparent from the results that, by virtue of the replacement of the emulsion of the 11th layer by Em-E and the addition of developing agent or precursor thereof, the number of development initiating points per silver halide grain after development is increased and the sensitivity enhancement is realized. In such instances, the graininess deterioration is slight, and the effect of the present invention is recognized.

It is also apparent from the results of sample 110 that the effect of the present invention, although slightly reduced, is exerted even if the developing agent precursor is applied to other layers (in this instance, adjacent layer).

Moreover, comparisons between samples 103, 108 and 109 show that, with respect to the aspect ratio, 5 or more is preferred, and 8 or more is more preferred.

Example 2

Samples were prepared in the same manner as in Example 1, except that, with respect to sample 103 prepared in Example 1, the color development temperature and time of the development process A were changed as indicated in Table 5.

TABLE 5

| Test No. | Process step | Temperature (° C.) | Time (sec) | Number of development initiating point per grain in emulsion of 11th layer | Sensitivity | Graininess | Remarks |
|---|---|---|---|---|---|---|---|
| 1 | A | 37.8 | 185 | 4.1 | +0.15 | 120 | Results of Sample 103 of Example 1 |
| 2 | B | 48 | 50 | 5.2 | +0.17 | 122 | |
| 3 | C | 60 | 20 | 6.0 | +0.19 | 122 | |

It is apparent that, with respect to the temperature, 50° C. is preferred, and 60° C. is more preferred.

Example 3

Sample was prepared in the same manner as sample 101 of Example 1, except that the following changes were effected, and designated sample 301.

Em-C' of the 4th layer was changed to Em-C.

Em-B' of the 5th layer was changed to Em-B.

Em-C' of the 5th layer was changed to Em-C.

Em-A' of the 6th layer was changed to Em-A.

Em-J' of the 8th layer was changed to Em-J.

Em-G' of the 9th layer was changed to Em-G.

Em-F' of the 10th layer was changed to Em-F.

Em-E' of the 11th layer was changed to Em-E.

Em-N' of the 13th layer was changed to Em-N.

Em-L' of the 14th layer was changed to Em-L.

Developing agent precursor DEVP-1 was added to each of the above 4th, 5th, 6th, 8th, 9th, 10th, 11th, 13th a nd 14th layers in a molar amount of 1.2 times that of the coupler applied to that layer.

Development was carried out by the process A of Example 1 and the processes B, C of Example 2, and evaluation was effected in the same manner as in Example 1. With respect to all of the cyan color image, magenta color image and yellow color image, the effect of the present invention was exhibited.

Example 4

(Preparation of Emulsion)

Emulsions Em4-A to O and emulsions Em4-A', B', C', E', F', G', L' and N' with the same morphologies as the emulsions Em-A to O and emulsions Em-A', B', C', E', F', G', L' and N' of the above Example were prepared in the same manner as in the above Example.

<Method of Preparing Silver Salt of 5-amino-3-benzylthiotriazole>

11.3 g of 5-amino-3-benzylthiotriazole, 1.1 g of sodium hydroxide and 10 g of gelatin were dissolved in 1000 L of water, and the solution was maintained at 50° C. under agitation. Subsequently, a solution obtained by dissolving 8.5 g of silver nitrate in 100 mL of water was added to the above solution over a period of 2 min. The pH of the mixture was regulated so as to precipitate an emulsion, and excess salts were removed. Thereafter, the pH was adjusted to 6.0. Thus, a 5-amino-3-benzylthiotriazole silver salt emulsion was obtained with a yield of 400 g.

<Preparation of Lightsensitive Material>

For obtaining a lightsensitive material, the preparation of a support and the coating formation of substratum, antistatic layer (back 1st layer), magnetic recording layer (back 2nd layer) and back 3rd layer were carried out in the following manner.

(1) Preparation of Support

The support employed in this Example was produced according to the following procedure. 100 parts by weight of polyethylene 2,6-naphthalenedicarboxylate (PEN) and 2 parts by weight of ultraviolet absorbent Tinuvin P.326 (produced by Ciba-Geigy) were homogeneously mixed together. The mixture was melted at 300° C., extruded through T-die, longitudinally drawn at a ratio of 3.3 at 140° C., transversely drawn at a ratio of 4.0 and thermoset at 250° C. for 6 sec. Thus, a 90 $\mu$m thick PEN film was obtained. This PEN film was loaded with appropriate amounts of blue, magenta and yellow dyes (I-1, I-4, I-6, I-24, I-26, I-27 and II-5 described in JIII Journal of Technical Disclosure No. 94-6023). Further, the film was wound round a stainless steel core of 30 cm diameter and heated at 110° C. for 48 hr so as to give a heat history. Thus, the support resistant to curling was obtained.

(2) Formation of Substratum by Coating

Glow treatment of the PEN support on its both surfaces was performed in the following manner. Four rod electrodes of 2 cm diameter and 40 cm length were fixed at intervals of 10 cm on an insulating board in a vacuum tank. The electrodes were arranged so as to allow the support film to travel at a distance of 15 cm therefrom. A heating roll of 50 cm diameter fitted with a temperature controller was disposed just ahead of the electrodes. The support film was set so as to contact a ¾ round of the heating roll. The support film, 90 $\mu$m thick and 30 cm wide biaxially oriented film, was traveled and heated by the heating roll so that the temperature of the film surfaces between the heating roll and the electrode zone was 115° C. The support film was carried at a speed of 15 cm/sec and underwent glow treatment.

Glow treatment was performed under such conditions that the pressure within the vacuum tank was 26.5 Pa, and the $H_2O$ partial pressure of ambient gas 75%. Further, the conditions were such that the discharge frequency was 30 KHz, the output 2500 W, and the treating strength 0.5 KVoAomin/m$^2$. With respect to the vacuum glow discharge electrodes, the method described in JP-A-7-003056 was followed.

One side (emulsion side) of the glow-treated PEN support was furnished with a substratum of the following recipe. The dry film thickness was designed so as to be 0.02 $\mu$m. The drying was performed at 115° C. for 3 min.

| | |
|---|---|
| Gelatin | 83 pts. wt. |
| Water | 291 pts. wt. |
| Salicylic acid | 18 pts. wt. |
| Aerosil R972 (colloidal silica, produced by Nippon Aerosil Co., Ltd.) | 1 pt. wt. |
| Methanol | 6900 pts. wt. |
| n-Propanol | 830 pts. wt. |
| Polyamide-epichlorohydrin resin described in JP-A-51-3619. | 25 pts. wt. |

(3) Formation of Antistatic Layer (Back 1st Layer) by Coating

Liquid mixture of 40 parts by weight of SN-100 (conductive fine particles produced by Ishihara Sangyo Kaisha, Ltd.) and 60 parts by weight of water, while adding a 1N aqueous solution of sodium hydroxide thereto, was agitated by an agitator to thereby form a coarse dispersion and subjected to dispersion by means of a horizontal sand mill. Thus, a dispersion of conductive fine particles of 0.06 $\mu$m secondary particle average diameter (pH 7.0) was obtained.

The coating liquid of the following composition was applied onto the surface-treated PEN support (back side) so that the coating amount of conductive fine particles was 270 mg/m$^2$. The drying was performed at 115° C. for 3 min.

| | |
|---|---|
| SN-100 (conductive fine particles produced by Ishihara Sangyo Kaisha, Ltd.) | 270 pts. wt. |
| Gelatin | 23 pts. wt. |
| Rheodol TW-L120 (surfactant produced by Kao Corp.) | 6 pts. wt. |
| Denacol EX-521 (film hardener produced by Nagase Chemtex Corporation) | 9 pts. wt. |
| Water | 5000 pts. wt. |

(4) Formation of Magnetic Recording Layer (Back 2nd Layer) by Coating

Magnetic particles CSF-4085V2 ($\gamma$-$Fe_2O_3$ coated with Co, produced by Toda Kogyo Co., Ltd.) were surface treated with 16% by weight, based on the magnetic particles, of X-12-641 (silane coupling agent produced by Shin-Etsu Chemical Co., Ltd.).

The back 1st layer on its upper side was coated with the coating liquid of the following composition so that the coating amount of CSF-4085V2 treated with the silane coupling agent was 62 mg/$m^2$. The magnetic particles and abrasive were dispersed by the method of JP-A-6-035092. The drying was performed at 115° C. for 1 min.

| | |
|---|---|
| Diacetylcellulose (binder) | 1140 pts. wt. |
| CSF-4085V2 treated with X-12-641 (magnetic particles) | 62 pts. wt. |
| AKP-50 (alumina abrasive produced by Sumitomo Chemical Co., Ltd.) | 40 pts. wt. |
| Millionate MR-400 (film hardener produced by Nippon Polyurethane Co., Ltd.) | 71 pts. wt. |
| Cyclohexanone | 12000 pts. wt. |
| Methyl ethyl ketone | 12000 pts. wt. |

The $D^B$ color density increment of the magnetic recording layer through X-light (blue filter) was about 0.1. Further, with respect to the magnetic recording layer, the saturation magnetization moment, coercive force and rectangular ratio were 4.2 $Am^2$/kg, $7.3\times10^4$ A/m and 65%, respectively.

(5) Formation of Back 3rd Layer by Coating

The lightsensitive material on its magnetic recording layer side was coated with the back 3rd layer.

Wax (1-2) of the following formula was emulsified in water by means of a high-voltage homogenizer, thereby obtaining a wax water dispersion of 10% by weight concentration and 0.25 $\mu$m weight average diameter.

Wax (1-2): n-$C_{17}H_{35}COOC_{40}H_{81}$-n.

The magnetic recording layer (back 2nd layer) on its upper side was coated with the coating liquid of the following composition so that the coating amount of wax was 27 mg/$m^2$. The drying was performed at 115 ° C. for 1 min.

| | |
|---|---|
| Wax water dispersion mentioned above (10% by weight) | 270 pts. wt. |
| Pure water | 176 pts. wt. |
| Ethanol | 7123 pts. wt. |
| Cyclohexanone | 841 pts. wt. |

Furthermore, an emulsion dispersion containing a coupler and an internal developing agent was prepared.

Yellow coupler CP-107, compound DEVP-26, antifoggant (d), (e), high-boiling organic solvent (f) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

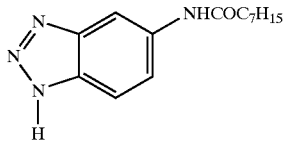

Antifoggant (d)

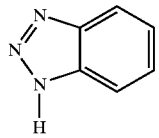

Antifoggant (e)

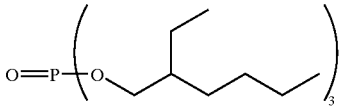

High-boiling organic solvent (f)

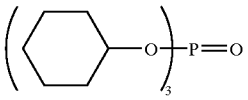

High-boiling organic solvent (j)

Subsequently, magenta coupler and cyan coupler dispersions were prepared in the same manner.

Magenta coupler CP-205, ° C.P-210, compound DEVP-26, antifoggant (d), high-boiling organic solvent (j) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

Cyan coupler CP-324, cyan coupler CP-320, developing agent DEVP-26, antifoggant (d), high-boiling organic solvent (j) and ethyl acetate were mixed together at 60° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min.

In the same manner, high-boiling organic solvent (g) and ethyl acetate were mixed together at 600° C. into a solution. This solution was mixed into an aqueous solution wherein lime-processed gelatin and sodium dodecylbenzenesulfonate were dissolved, and emulsified by means of a dissolver agitator at 10,000 revolutions over a period of 20 min. Thus, a dispersion of high-boiling organic solvent (g) was obtained.

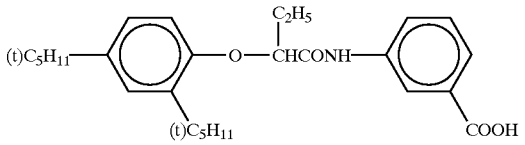

High-boiling organic solvent (g)

Further, dye dispersions for coloring interlayers for use as a filter layer and an antihalation layer were prepared in the same manner.

Various dyes, high-boiling organic solvents employed to disperse them and other additives are listed below.

Yellow dye (I)
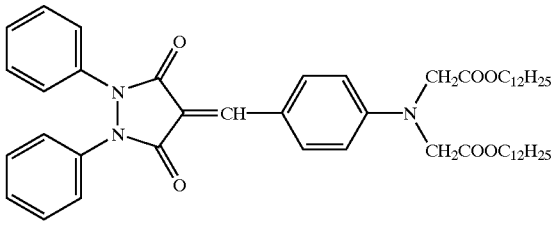
High-boiling organic solvent (m)
A 1:1 mixture of 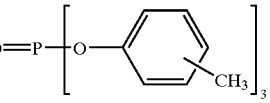 and
Ajinomoto Empara K65 manufactured by AJINOMOTO K.K.
Magenta dye (n)
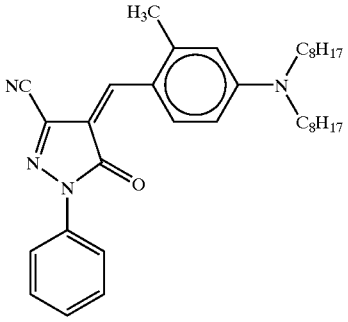
High-boiling organic solvent (o)
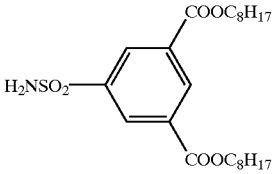
Cyan dye (p)
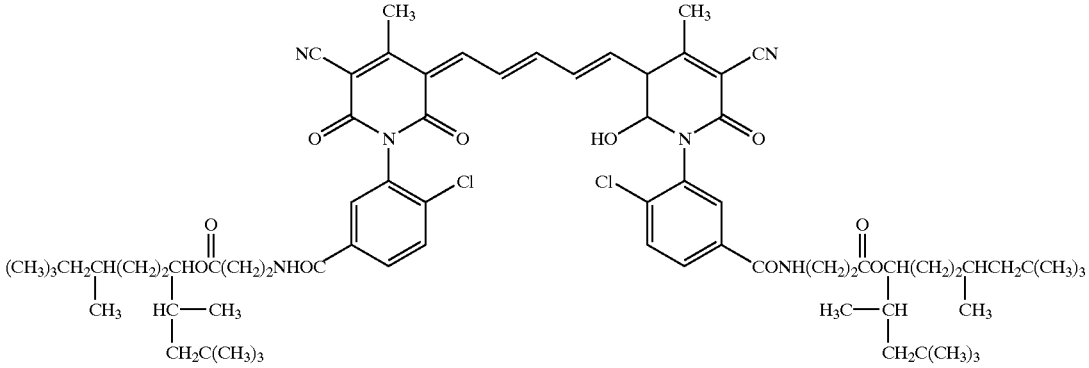
High-boiling organic solvent (Q)
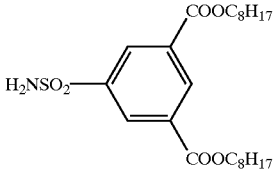
Surfactant (q)
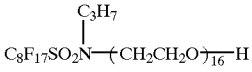
Surfactant (y)
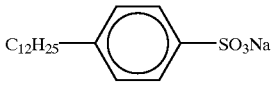
Surfactant (r)
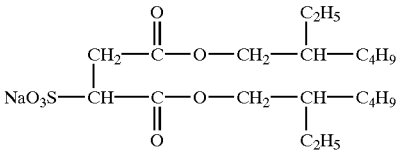
Water-soluble polymer (s)
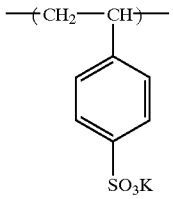
Hardening agent (t)
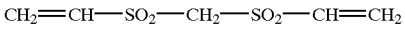

-continued

Formalin scavenger (u)

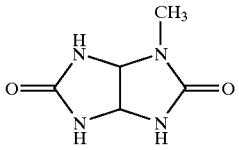

CP-107

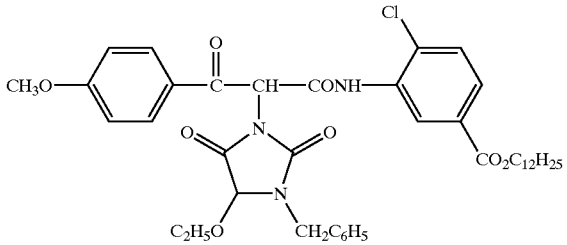

CP-205

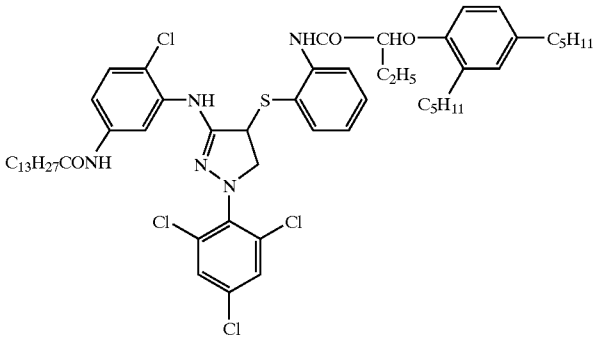

CP-210

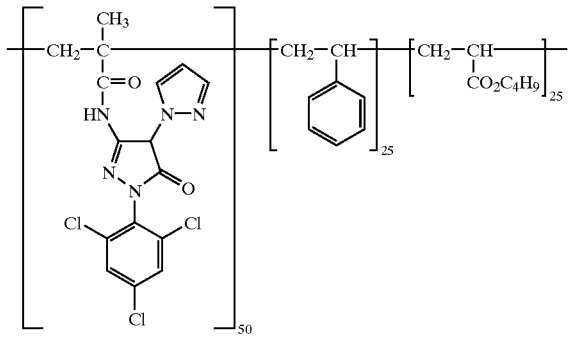

CP-320

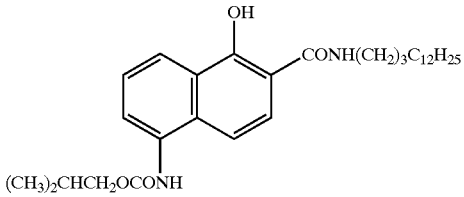

CP-324

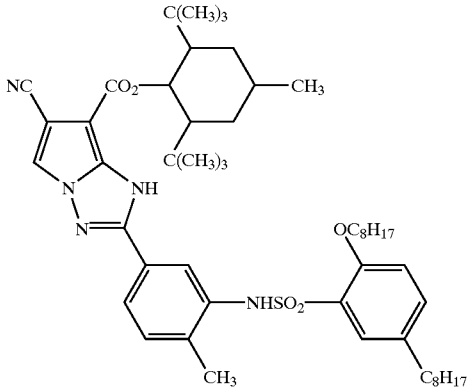

BP-41

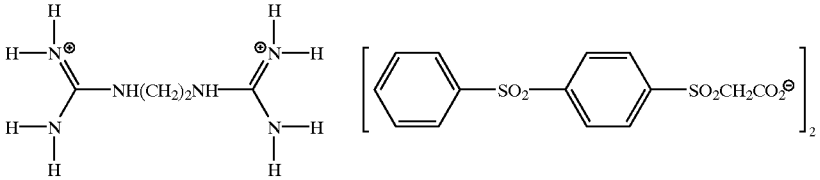

Sample 401 of a multi-layerd color light-sensitive material for heat development as set forth in Table 6 was prepared by using the emulsions.

TABLE 6

| Sample 401 | | |
|---|---|---|
| Protective layer | Alkali processed gelatin | 950 |
| | Matting agent (silica) | 55 |
| | Surfactant (q) | 32 |
| | Surfactant (r) | 43 |
| | Water soluble polymer (s) | 17 |
| | Hardening agent (t) | 105 |
| Interlayer | Alkali processed gelatin | 455 |
| | Surfactant (r) | 8 |
| | Base precursor compound | 425 |

TABLE 6-continued

| Sample 401 | | |
|---|---|---|
| | BP-41 | |
| | Formalin scavenger (u) | 312 |
| | D-sorbitor | 60 |
| | Water soluble polymer (s) | 20 |
| Yellow color layer (High-speed layer) | Alkali processed gelatin | 1750 |
| | Emulsion (in terms of coated silver) | Em4-L' 500 |
| | 5-Amino-3-benzylthiotriazole silver | 160 |
| | Yellow coupler (CP-107) | 170 |
| | DEVP-26 | 225 |
| | Antifoggant (d) | 3.3 |
| | Antifoggant (e) | 5.3 |

TABLE 6-continued

| Sample 401 | | |
|---|---|---|
| | High-boiling organic solvent (f) | 177 |
| | Surfactant (y) | 30 |
| | D-sorbitor | 210 |
| | Water soluble polymer (s) | 1 |
| Yellow color layer (Medium-speed layer) | Alkali processed gelatin | 1400 |
| | Emulsion (in terms of coated silver) | Em4-M 230 |
| | 5-Amino-3-benzylthiotriazole silver | 190 |
| | Yellow coupler (CP-107) | 175 |
| | DEVP-26 | 310 |
| | Antifoggant (d) | 5.0 |
| | Antifoggant (e) | 8.0 |
| | High-boiling organic solvent (f) | 270 |
| | Surfactant (y) | 30 |
| | D-sorbitor | 140 |
| | Water soluble polymer (s) | 2 |
| Yellow color layer (Low-speed layer) | Alkali processed gelatin | 1610 |
| | Emulsion (in terms of coated silver) | Em4-O 58<br>Em4-N' 167 |
| | 5-Amino-3-benzylthiotriazole silver | 220 |
| | Yellow coupler (CP-107) | 456 |
| | DEVP-26 | 553 |
| | Antifoggant (d) | 8.5 |
| | Antifoggant (e) | 14.0 |
| | High-boiling organic solvent (f) | 440 |
| | Surfactant (y) | 25 |
| | D-sorbitor | 140 |
| | Water soluble polymer (s) | 2 |
| Interlayer (Yellow filter layer) | Alkali processed gelatin | 580 |
| | Surfactant (y) | 20 |
| | Surfactant (r) | 20 |
| | Base precursor compound BP-41 | 510 |
| | Yellow Dye (1) | 80 |
| | High-boiling organic solvent (m) | 80 |
| | Water soluble polymer (s) | 20 |
| Magenta color layer (High-speed layer) | Alkali processed gelatin | 800 |
| | Emulsion (in terms of coated silver) | Em4-E' 450 |
| | 5-Amino-3-benzylthiotriazole silver | 65 |
| | Magenta coupler (CP-205) | 55 |
| | Magenta coupler (CP-210) | 26 |
| | DEVP-26 | 85 |
| | Antifoggant (d) | 1.0 |
| | High-boiling organic solvent (j) | 78 |
| | Surfactant (y) | 10 |
| | D-sorbitor | 105 |
| | Water soluble polymer (s) | 9 |
| Magenta color layer (Medium-speed layer) | Alkali processed gelatin | 600 |
| | Emulsion (in terms of coated silver) | Em4-F' 480 |
| | 5-Amino-3-benzylthiotriazole silver | 60 |
| | Magenta coupler (CP-205) | 98 |
| | Magenta coupler (CP-210) | 54 |
| | DEVP-26 | 170 |
| | Antifoggant (d) | 2.3 |
| | High-boiling organic solvent (j) | 155 |
| | Surfactant (y) | 13 |
| | D-sorbitor | 86 |
| | Water soluble polymer (s) | 16 |
| Magenta color layer (Low-speed layer) | Alkali processed gelatin | 700 |
| | Emulsion (in terms of coated silver) | Em4-H 106<br>Em4-G' 108<br>Em4-I 38 |
| | 5-Amino-3-benzylthiotriazole silver | 156 |
| | Magenta coupler (CP-205) | 228 |

TABLE 6-continued

| Sample 401 | | |
|---|---|---|
| | Magenta coupler (CP-210) | 123 |
| | DEVP-26 | 421 |
| | Antifoggant (d) | 5.3 |
| | High-boiling organic solvent (j) | 386 |
| | Surfactant (y) | 34 |
| | D-sorbitor | 84 |
| | Water soluble polymer (s) | 18 |
| Interlayer (Magenta filter layer) | Alkali processed gelatin | 855 |
| | Surfactant (y) | 14 |
| | Surfactant (r) | 25 |
| | Base precursor compound BP-41 | 476 |
| | Magenta dye (n) | 52 |
| | High-boiling organic solvent (o) | 50 |
| | Formalin scavenger (u) | 300 |
| | D-sorbitor | 80 |
| | Water soluble polymer (s) | 14 |
| Cyan color layer (High-speed layer) | Alkali processed gelatin | 800 |
| | Emulsion (in terms of coated silver) | Em4-A' 480 |
| | 5-Amino-3-benzylthiotriazole silver | 63 |
| | Cyan coupler (CP-320) | 22 |
| | Cyan coupler (CP-324) | 40 |
| | DEVP-26 | 75 |
| | Antifoggant (d) | 0.8 |
| | High-boiling organic solvent (j) | 76 |
| | Surfactant (y) | 6 |
| | D-sorbitor | 88 |
| | Water soluble polymer (s) | 20 |
| Cyan color layer (Medium-speed layer) | Alkali processed gelatin | 500 |
| | Emulsion (in terms of coated silver) | Em4-B' 250<br>Em4-C' 250 |
| | 5-Amino-3-benzylthiotriazole silver | 105 |
| | Cyan coupler (CP-320) | 50 |
| | Cyan coupler (CP-324) | 130 |
| | DEVP-26 | 224 |
| | Antifoggant (d) | 2.5 |
| | High-boiling organic solvent (j) | 200 |
| | Surfactant (y) | 10 |
| | D-sorbitor | 45 |
| | Water soluble polymer (s) | 10 |
| Cyan color layer (Low-speed layer) | Alkali processed gelatin | 810 |
| | Emulsion (in terms of coated silver) | Em4-D 180<br>Em4-C' 110 |
| | 5-Amino-3-benzylthiotriazole silver | 150 |
| | Cyan coupler (CP-320) | 90 |
| | Cyan coupler (CP-324) | 230 |
| | DEVP-26 | 405 |
| | Antifoggant (d) | 4.5 |
| | High-boiling organic solvent (j) | 360 |
| | Surfactant (y) | 15 |
| | D-sorbitor | 90 |
| | Water soluble polymer (s) | 7 |
| Anti-halation layer | Alkali processed gelatin | 420 |
| | Surfactant (y) | 12 |
| | Base precursor compound BP-41 BP-41 | 620 |
| | Cyan dye (p) | 260 |
| | High-boiling organic solvent (o) | 245 |
| | Water soluble polymer (s) | 15 |
| Transparent PEN base (96 $\mu$m) | | |

(Preparation of Sample 402)

This sample was prepared in the same manner as sample 401, except that, in the high speed magenta coloring layer, the emulsion Em4-E', was replaced by an emulsion with an average aspect ratio of 9 which was prepared in substantially the same manner as the emulsion Em-E'.

(Preparation of Sample 403)

This sample was prepared in the same manner as sample 401, except that, in the high-speed magenta coloring layer, the emulsion Em4-E', was replaced by emulsion Em4-E.

Test pieces were cut out from these lightsensitive materials, and subjected to 200 lux exposure of 5000 K color temperature for 1/100 sec through an optical wedge.

After the exposure, heat development was effected with the use of a heating drum at 60° C. for 20 sec, or at 80° C. for 20 sec, or at 100° C. for 20 sec.

The average number of development initiating points per emulsion grain in the high-speed magenta coloring layer was determined by the method described in the descriptive portion hereof (counted with respect to 100 grains).

The results are listed in Table 7.

TABLE 7

| Sample No. | Emulsion of high-speed magenta color layer | Emulsion of high-speed magenta color layer: Developing condition | Emulsion of high-speed magenta color layer: Average development initiating points per grain | Sensitivity | Graininess | Remarks |
|---|---|---|---|---|---|---|
| 401 | Tabular grains of A.A.R. of 6 | 60° C., 20 sec | 2.8 | ±0 | 100 | Comparison |
| 401' | Tabular grains of A.A.R. of 6 | 80° C., 20 sec | 4.1 | +0.10 | 111 | Invention |
| 401" | Tabular grains of A.A.R. of 6 | 100° C., 20 sec | 6.3 | +0.14 | 122 | Invention |
| 402 | Tabular grains of A.A.R. of 9 | 60° C., 20 sec | 4.0 | +0.10 | 110 | Invention |
| 402' | Tabular grains of A.A.R. of 9 | 80° C., 20 sec | 7.0 | +0.15 | 130 | Invention |
| 402" | Tabular grains of A.A.R. of 9 | 100° C., 20 sec | 9.9 | +0.20 | 139 | Invention |
| 403 | Tabular grains of A.A.R. of 14 | 60° C., 20 sec | 6.2 | +0.12 | 120 | Invention |
| 403' | Tabular grains of A.A.R. of 14 | 80° C., 20 sec | 9.8 | +0.20 | 140 | Invention |
| 403" | Tabular grains of A.A.R. of 14 | 100° C., 20 sec | 12.5 | +0.29 | 148 | Invention |

A.A.R. = average aspect ratio

It is apparent from the results of Table 7 that, even in the completely dry development processing system, the silver halide lightsensitive material containing such an emulsion that the average number of development initiating points per grain at the completion of color development is 3.0 or more exhibits excellent ratio of sensitivity/graininess.

Example 5

Sample was prepared in the same manner as sample 401 of Example 4, except that the following changes were effected, and designated sample 501.

Em4-C' of the low-speed cyan coloring layer was changed to Em-C.

Em4-B' of the medium-speed cyan coloring layer was changed to Em-B.

Em4-C' of the medium-speed cyan coloring layer was changed to Em-C.

Em4-A' of the high-speed cyan coloring layer was changed to Em-A.

Em4-G' of the low-speed magenta coloring layer was changed to Em-G.

Em4-F' of the medium-speed magenta coloring layer was changed to Em-F.

Em4-E' of the high-speed magenta coloring layer was changed to Em-E.

Em4-N' of the low-speed yellow coloring layer was changed to Em-N.

Em4-L' of the high-speed yellow coloring layer was changed to Em-L.

The sample 501 was exposed and heat developed, and evaluated, in the same manner as in Example 4. With respect to all of the cyan color image, magenta color image and yellow color image, the effect of the present invention was exhibited.

Example 6

Samples 601 to 603 were prepared in the same manner as sample 501 of Example 5, except that the emulsion Em-A of the high-speed cyan coloring layer was changed to the following emulsions.

Emulsions which were different in the ratio of tabular grains having 30 or more dislocation lines in grain fringe portions were prepared in the same manner as the emulsion Em-A, except that, in the grain formation of the emulsion Em-A, the addition amount of compound 1 and the grain growth temperature and grain growth potential after the addition of compound 1 were regulated.

For use in the sample 601, there was obtained an emulsion wherein the ratio of tabular grains having 30 or more dislocation lines in grain fringe portions was 40% (grain numerical ratio).

For use in the sample 602, there was obtained an emulsion wherein the ratio of tabular grains having 30 or more dislocation lines in grain fringe portions was 60% (grain numerical ratio).

For use in the sample 603, there was obtained an emulsion wherein the ratio of tabular grains having 30 or more dislocation lines in grain fringe portions was 80% (grain numerical ratio).

The samples 601 to 603 were exposed and heat developed, and evaluated, in the same manner as in Example 4. With respect to the cyan color image, the sensitivity enhancement of samples 602 and 603 was favorably superior to that of sample 601.

Example 7

Samples 701 to 706 were prepared in the same manner as sample 501 of Example 5, except that the emulsion Em-A of the high-speed cyan coloring layer was changed to the following emulsions.

In the grain formation of the emulsion Em-A, addition of $1\times10^{-5}$ mol of yellow prussiate of potash per mol of silver was not effected and no other substance was added (emulsion for use in sample 701).

In the grain formation of the emulsion Em-A, $K_4[Ru(CN)_6]$ was added in an amount of $5\times10^{-7}$ mol per mol of silver in place of the addition of $1\times10^{-5}$ mol of yellow prussiate of potash per mol of silver (emulsion for use in sample 702).

In the grain formation of the emulsion Em-A, $K_4[Ru(CN)_6]$ was added in an amount of $2\times10^{-6}$ mol per mol of silver in place of the addition of $1\times10^{-5}$ mol of yellow prussiate of potash per mol of silver(emulsion for use in sample 703).

In the grain formation of the emulsion Em-A, $K_4[Ru(CN)_6]$ was added in an amount of $1\times10^{-5}$ mol per mol of silver in place of the addition of $1\times10^{-5}$ mol of yellow prussiate of potash per mol of silver (emulsion for use in sample 704).

In the grain formation of the emulsion Em-A, $K_4[Ru(CN)_6]$ was added in an amount of $5\times10^{-6}$ mol per mol of silver in place of the addition of $1\times10^{-5}$ mol of yellow prussiate of potash per mol of silver (emulsion for use in sample 705).

In the grain formation of the emulsion Em-A, $K_4[Ru(CN)_6]$ was added in an amount of $2\times10^{-4}$ mol per mol of silver in place of the addition of $1\times10^{-5}$ mol of yellow prussiate of potash per mol of silver (emulsion for use in sample 706).

In the grain formation of the emulsion Em-A, $K_4[Ru(CN)_6]$ was added in an amount of $4\times10^{-4}$ mol per mol of silver in place of the addition of $1\times10^{-5}$ mol of yellow prussiate of potash per mol of silver (emulsion for use in sample 707).

In the grain formation of the emulsion Em-A, $K_4[Ru(CN)_6]$ was added in an amount of $6\times10^{-4}$ mol per mol of silver in place of the addition of $1\times10^{-5}$ mol of yellow prussiate of potash per mol of silver (emulsion for use in sample 708).

The samples 701 to 708 were exposed and heat developed, and evaluated, in the same manner as in Example 4. In particular, with respect to the cyan color image, the sensitivity enhancement of samples 703, 704, 705, 706 and 707 was favorably superior to that of sample 701. On the other hand, with respect to comparative sample 708, its sensitivity was considerably lower than those of samples 703 to 707.

Example 8

Sample was prepared in the same manner as sample 501 of Example 5, except that the following changes were effected, and designated sample 801.

The sample was prepared in the same manner as sample 501, except that the green-sensitive emulsions were replaced by emulsions prepared by using the following sensitizing dyes A, B and C in place of the sensitizing dyes 4, 5 and 6 or the sensitizing dyes 8, 6 and 13 and by effecting multilayer adsorption of sensitizing dyes in two layers. With respect to the sensitizing dyes, the sensitizing dyes A and B were added prior to the chemical sensitization while the sensitizing dye C was added after the addition of compounds 2 and 3 after the chemical sensitization.

Sensitizing dye A

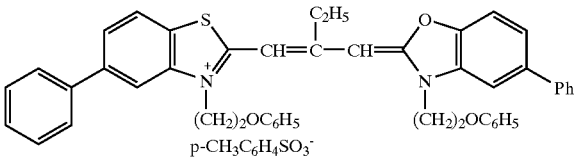

Sensitizing dye B

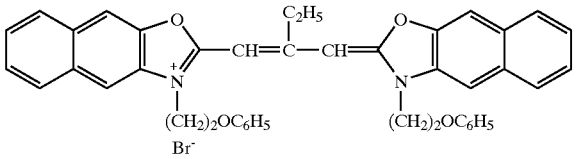

Sensitizing dye C

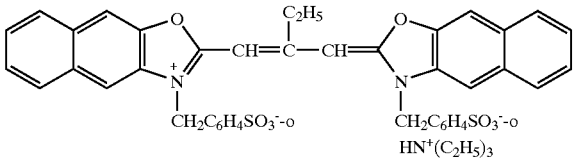

A mixture of Sensitizing dye A: Sensitizing dye B: Sensitizing dye C=7:27:66 (molar ratio)

The sample 801 was exposed and heat developed, and evaluated, in the same manner as in Example 4. With respect to the magenta color image, further sensitivity enhancement was favorably attained. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of processing a silver halide color photographic lightsensitive material comprising a support and at least one lightsensitive silver halide emulsion layer containing a binder and lightsensitive silver halide grains comprising tabular silver halide grains on the support; wherein the lightsensitive material contains a developing agent or its precursor, and a compound capable of forming a dye by a coupling reaction with the developing agent in an oxidized form, wherein the method comprises:

exposing the silver halide color photographic lightsensitive material under the following conditions:

light source: natural light of 2000 to 9000 K color temperature or artificial light corresponding thereto, exposure time: 1/10 to 1/1000 sec, and exposure amount: such that 80 to 90% (numerical ratio) of the lightsensitive silver halide grains contained in the lightsensitive silver halide emulsion layer have at least one development initiating point per grain; and color developing the exposed silver halide color photographic lightsensitive material so that the tabular silver halide grains have an average number of development initiating points of 3.0 or more per grain at the time of completion of the color development.

2. The method according to claim 1, wherein the developing agent is selected from the group consisting of the compounds represented by the following general formulae (1) to (5):

(1)

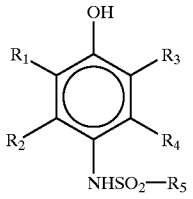

(2)

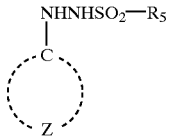

(3)

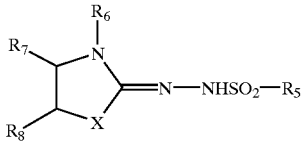

(4)

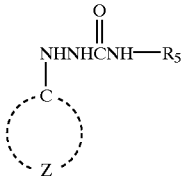

(5)

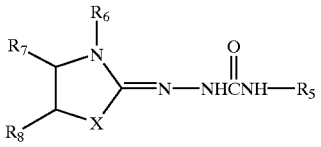

wherein each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group capable of forming an aromatic ring (including a heteroaromatic ring) together with the carbon atom, which aromatic ring may have a substituent other than —$NHNHSO_2$—$R_5$, provided that when the aromatic ring formed with Z is a benzene ring, the total of Hammett's constants (σ) of the substituents is 1 or more; $R_6$ represents a substituted or unsubstituted alkyl group; X represents an oxygen atom, a sulfur atom, a selenium atom or a tertiary nitrogen atom substituted with an alkyl group or aryl group; and $R_7$ and $R_8$ each represent a hydrogen atom or a substituent, provided that $R_7$ and $R_8$ may be bonded to each other to thereby form a double bond or a ring.

3. The method according to claim 1, wherein the developing agent is a paraphenylenediamine-type color developing agent.

4. The method according to claim 1, wherein the precursor of developing agent is represented by the following general formula (6):

(6)

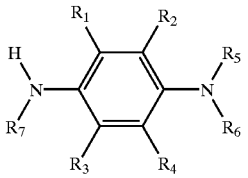

wherein each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N—$R_{18}$, each of $R_{16}$, $R_{17}$ and $R_{18}$ independently represents a hydrogen atom or an alkyl group, M represents a n-valence cation, and n is an integer of 1 to 5.

5. The method according to claim 1, wherein the average number of development initiating points is 4.0 or more.

6. The method according to claim 1, wherein the average number of development initiating points is 5.0 or more.

7. The method according to claim 1, wherein the average number of development initiating points is 7.0 or more.

8. The method according to claim 1, wherein the tabular silver halide grains have an average aspect ratio of 2 or more.

9. The method according to claim 1, wherein the tabular silver halide grains have an average aspect ratio of 8 or more.

10. The method according to claim 1, wherein at least 50% (numerical ratio) of the tabular silver halide grains have at least 30 dislocation lines per grain, which dislocation lines are positioned at fringe portions of the tabular silver halide grains.

11. The method according to claim 1, wherein the tabular silver halide grains contain a 6-cyano complex containing ruthenium as a central metal in an amount of $1\times10^{-6}$ to $5\times10^{-4}$ mol per mol of silver halide.

12. The method according to claim 1, wherein each of the tabular silver halide grains has surfaces onto which sensitizing dyes are adsorbed in multilayered form comprising a first layer and a second layer, the sensitizing dye in the second layer including both a cationic dye and an anionic dye, and the sensitizing dye in the first layer is different from the cationic dye and the anionic dye in the second layer.

13. The method according to claim 1, wherein the silver halide color photographic lightsensitive material contains an organometallic salt.

14. The method according to claim 1, wherein the color development is performed at 60° C. or higher temperatures.

15. The method according to claim 14, wherein the color development is performed for a period of 60 sec or less.

16. The method according to claim 14, wherein the color development is performed for a period of 45 sec or less.

* * * * *